US011419464B2

(12) United States Patent
Thorne

(10) Patent No.: US 11,419,464 B2
(45) Date of Patent: Aug. 23, 2022

(54) TOILET SEAT ASSEMBLY WITH CLEANING SYSTEM

(71) Applicant: Origyn LLC, Boston, MA (US)

(72) Inventor: Jason Thorne, Dover, MA (US)

(73) Assignee: Origyn LLC, Boston, MA (US)

( * ) Notice: Subject to any disclaimer, the term of this patent is extended or adjusted under 35 U.S.C. 154(b) by 149 days.

(21) Appl. No.: 16/890,625

(22) Filed: Jun. 2, 2020

(65) Prior Publication Data

US 2020/0375417 A1 Dec. 3, 2020

Related U.S. Application Data

(60) Provisional application No. 62/950,229, filed on Dec. 19, 2019, provisional application No. 62/902,025, filed on Sep. 18, 2019, provisional application No. 62/865,695, filed on Jun. 24, 2019, provisional application No. 62/856,088, filed on Jun. 2, 2019.

(51) Int. Cl.

| | |
|---|---|
| ***A47K 13/30*** | (2006.01) |
| ***A47K 13/10*** | (2006.01) |
| ***E03D 9/00*** | (2006.01) |

(52) U.S. Cl.

CPC ..... *A47K 13/302* (2013.01); *A47K 13/10* (2013.01); *E03D 9/005* (2013.01)

(58) Field of Classification Search

CPC ..... E03D 9/005; A47K 13/302; A47K 13/10
USPC ..... 4/233
See application file for complete search history.

(56) References Cited

U.S. PATENT DOCUMENTS

| | | | |
|---|---|---|---|
| 2,605,478 | A | 8/1952 | Lassiter |
| 3,302,917 | A | 2/1967 | Winkler |
| 4,291,422 | A | 9/1981 | Shoemaker et al. |

(Continued)

FOREIGN PATENT DOCUMENTS

| | | |
|---|---|---|
| AU | 31270/71 | 1/1973 |
| AU | 580689 B | 3/1987 |

(Continued)

OTHER PUBLICATIONS

Amazon.com, "Toto SW583#01 S350E Electronic Bidet Toilet Seat with Cleansing Warm, Nightlight, Auto Open and Close Lid, Instantaneous Water Heating, and EWATER+, Round,Cotton White," https://www.amazon.com/TOTO-SW583-01-Electronic-Cleansing/dp/B009IJ2N9U (accessed Aug. 24, 2020).

(Continued)

*Primary Examiner* — Christine J Skubinna
(74) *Attorney, Agent, or Firm* — Finch & Maloney, PLLC

(57) ABSTRACT

A toilet seat assembly includes a base configured to be attached to the toilet bowl, the base including a toilet seat, a lid, and an energy source. A hydraulic cylinder in the base is operable to open and close the seat and lid using water from the mains water supply. The assembly can include a cleaning assembly at least partially housed in the base, such as one that includes a cleaning cassette configured to contain a cleaning product. A processor and valve assembly are configured to control a flow of water between the mains water supply and the toilet bowl in response to sensor or user input. The assembly is configured to clean the toilet bowl automatically and can also or alternately be configured for automatic opening and closing of the lid and toilet seat.

23 Claims, 31 Drawing Sheets

(56) References Cited

U.S. PATENT DOCUMENTS

| | | | | |
|---|---|---|---|---|
| 4,975,988 | A | 12/1990 | Won | |
| 5,063,617 | A | 12/1991 | Ward et al. | |
| 5,123,124 | A * | 6/1992 | Brower | A47K 13/10 4/217 |
| 5,142,709 | A | 9/1992 | McGuire | |
| 5,177,818 | A | 1/1993 | Tsai | |
| 5,257,421 | A | 11/1993 | Rose et al. | |
| 5,280,653 | A | 1/1994 | Tsai | |
| 5,323,496 | A | 6/1994 | Blair | |
| 5,369,814 | A | 12/1994 | Denys | |
| 5,774,904 | A | 7/1998 | McWilliams | |
| 5,781,938 | A | 7/1998 | Anderson | |
| 6,035,454 | A | 3/2000 | Birchall | |
| 6,112,335 | A | 9/2000 | Gaston | |
| 6,553,585 | B1 | 4/2003 | Lundstrom | |
| 6,651,262 | B1 | 11/2003 | Tinsley | |
| 6,745,417 | B2 * | 6/2004 | Sumino | A47K 13/10 4/222 |
| 6,907,621 | B2 | 6/2005 | Stemen | |
| 8,060,953 | B1 * | 11/2011 | Dorra | A47K 13/302 4/233 |
| 8,266,730 | B2 | 9/2012 | Ricca | |
| 8,566,970 | B2 | 10/2013 | Collignon | |
| 9,044,123 | B2 | 6/2015 | Gomez Espana Collignon | |
| 9,066,841 | B2 | 6/2015 | Mastropole | |
| 9,326,649 | B1 | 5/2016 | Ophor | |
| 9,993,124 | B2 * | 6/2018 | Poleki | A47K 13/302 |
| 10,385,561 | B1 | 8/2019 | Hall et al. | |
| 2004/0199987 | A1 | 10/2004 | Stemen | |
| 2005/0188454 | A1 | 9/2005 | Bosivert | |
| 2006/0207020 | A1 | 9/2006 | Huff | |
| 2007/0256226 | A1 * | 11/2007 | Pinizzotto | E03D 9/08 4/420.4 |
| 2008/0127404 | A1 | 6/2008 | Kruger et al. | |
| 2008/0178374 | A1 | 7/2008 | Abrams | |
| 2008/0271231 | A1 | 11/2008 | Stauber et al. | |
| 2009/0100581 | A1 | 4/2009 | Mixon | |
| 2010/0257662 | A1 | 10/2010 | Huang | |
| 2011/0035866 | A1 | 2/2011 | Ricca | |
| 2011/0277228 | A1 | 11/2011 | Corbell et al. | |
| 2013/0007952 | A1 | 1/2013 | Gomez-Espana Collignon | |
| 2013/0160196 | A1 | 6/2013 | Gomez Espana Collignon | |
| 2013/0219602 | A1 | 8/2013 | Korzelski | |
| 2014/0047629 | A1 | 2/2014 | Stauber et al. | |
| 2018/0344107 | A1 | 12/2018 | Holbrook et al. | |
| 2020/0181898 | A1 * | 6/2020 | Huitron | E03D 9/005 |

FOREIGN PATENT DOCUMENTS

| | | | |
|---|---|---|---|
| AU | 2002309323 | A8 | 1/2003 |
| CA | 2139211 | | 4/1997 |
| CA | 2762799 | A1 | 11/2010 |
| CN | 203468495 | U | 3/2014 |
| CN | 109930668 | A | 6/2019 |
| CN | 109944307 | A | 6/2019 |
| GB | 751834 | A | 7/1956 |
| GB | 1153702 | A | 5/1969 |
| JP | 2003304985 | A | 10/2003 |
| MX | PA01006808 | A | 1/2003 |
| WO | 0144427 | A1 | 6/2001 |
| WO | 02062191 | A1 | 8/2002 |
| WO | 2006038005 | A1 | 4/2006 |
| WO | 2007061740 | A2 | 5/2007 |
| WO | 2009058320 | A1 | 5/2009 |
| WO | 2013190547 | A1 | 12/2013 |
| WO | 2015009751 | A1 | 1/2015 |

OTHER PUBLICATIONS

Amazon.com, "Kohler K-5401-0 Veil Skirted 1 Piece Smart, Dual Flush Toilet in White," https://www.amazon.com/dp/B016MAVHSA/ref=asc_df_B016MAVHSA5337514/?creativeASIN=B016MAVHSA&linkCode=w61&imprToken=BS. kFFLW9.Ist5Ld9GuUaw&slotNum=0&tag=apartmentth0a-20 (accessed Aug. 24, 2020).

Toto USA, "Neorest 750H Dual Flush Toilet, 1.0 & 0.8 GPF With Actilight," https://www.totousa.com/neorest-750h-dual-flush-toilet-10-and-08-gpf-with-actilight (accessed Aug. 24, 2020).

American Standard, "VorMax Collection, ActiClean Self-Cleaning Right Height Elongated 1.28 GPF Toilet. Model No. 714AA.151.020," https://www.americanstandard-us.com/bathroom/toilets/acticlean-self-cleaning-right-height-elongated-128-gpf-toilet-24152 (accessed Oct. 26, 2020).

American Standard, "VorMax Plus Effortless Self-Cleaning Toilet," https://www.americanstandard-us.com/vormaxplus (accessed Oct. 26, 2020).

Touchless.com, "White Elongated Sensor Toilet Seat," https://www.itouchless.com/white-elongated-sensor-toilet-seat-ts1ewac (accessed Oct. 26, 2020).

European Patent Office, International Search Report and Written Opinion, PCT Application No. PCT/US2020/035728 (dated Nov. 5, 2020).

Arthi, J.E. and Jagadeeswari, M., "Control of Electrical Appliances through Voice Commands," IOSR Journal of Electrical and Electronics Engineering (IOSR-JEEE), vol. 9, Issue 1, Feb. 2014. pp. 13-18.

"Acticlean HET Right Height Elongated Complete Toilet," 214AA.157S, American Standard, spec_214AA-157S_ActiClean RHel Compl 8/16, 2017. 2 pages.

"Neorest 750H Dual Flush Toilet, 1.0GPF," Neorest, Toto Model MS993CUMFX#01. 2 pages.

Amazon.com, "Kohler K-5589-0 Purefresh Quiet-Close with Grip-Tight Bumpers Round-front Toilet Seat, White," https://www.amazon.com/K-5589-0-Purefresh-Quiet-Close-Grip-Tight-Round-front/dp/B00OVA7RXS/ref=sr_1_4?keywords=toilet+seat+odors&qid=1578661431&sr=8-4 (accessed Aug. 24, 2020).

Overstock.com, "Slim Design Soft close Dual Nozzles Non-Electric Bidet Seat for Elongated Toilets in White with On/Off Solid Brass T Adapter," https://www.overstock.com/Home-Garden/Slim-Design-Soft-close-Dual-Nozzles-Non-Electric-Bidet-Seat-for-Elongated-Toilets-in-White-with-On-Off-Solid-Brass-T-Adapter/23485038/product.html?refccid=5AYWVQIN7INI3OKDDOUGO3IFSE&searchidx=28&option=39121798&kwds=&rfmt= (accessed Aug. 24, 2020).

Overstock.com, "Alpha Bidet One V2 Non-Electrc Bidet Toilet Seat—Elongated," https://www.overstock.com/Home-Garden/ALPHA-BIDET-ONE-V2-Non-Electric-Bidet-Toilet-Seat-Elongated/27793428/product.html?refccid=5AYWVQIN7INI3OKDDOUGO3IFSE&searchidx=11&option=47973641&kwds=&rfmt= (accessed Aug. 24, 2020).

Amazon.com,"Brondell Swash Ecoseat Non-Electric Bidet Toilet Seat, Fits Elongated Toilets, White—Dual Temperature, Dual Nozzle System—Bidet with Easy Installation," https://www.amazon.com/Brondell-Swash-Non-Electric Bidet-Temperature/dp/B0815B8VZR/ref=asc_df_B0815B8VZR/?tag=hyprod-20&linkCode=df0&hvadid=385265257907&hvpos=1o2&hvnetw=g&hvrand=15720639159854817215 (accessed Aug. 24, 2020).

Amazon.com, "BEMIS Radiance Heated Night Light Toilet Seat will Slow Close and Never Loosen, Elongated, Long Lasting Plastic, White, H1900NL 000," https://www.amazon.com/Bemis-Radiance-Elongated-H1900NL-000/dp/B07533MJPN/ref-sr_1_5?keywords=toilet+seat+heated&qid-1578661649&sr=8-5 (accessed Aug. 24, 2020).

Amazon.com, "iTouchless Touch-Free Sensor Controlled Automatic Toilet Seat—Round Model, Off-White," https://www.amazon.com/iTouchless-Touch-Free-Sensor-Controlled-Automatic/dp/B005IRLUOU (accessed Aug. 24, 2020).

Amazon.com, "American Standard 8019A60GPC.020 Aquawash 2.0 Manual SpaLet Bidet Seat, White," https://www.amazon.com/dp/B07PVKD2FZ?tag=amz-mkt-fox-us-20&ascsubtag=1ba00-01000-a0049-win10-dsk00-smile-us000-pcomp-feature-scomp-wm-5&ref=aa_scomp_srdg2 (accessed Aug. 24, 2020).

Amazon.com, "Bidet Toilet Seat—Temp Controlled Wash & Warm Air Dry, Round," https://www.amazon.com/dp/B07PVKD2FZ?tag=amz-mkt-fox-us-20&ascsubtag=1ba00-01000-a0049-win10-dsk00-smile-us000-pcomp-feature-scomp-wm-5&ref=aa_scomp_srdg2 (accessed Aug. 24, 2020).

(56) References Cited

OTHER PUBLICATIONS

Overstock.com, "SmartBidet SB-100R Electric Bidet Toilet Seat for Most Elongated Toilet," https://www.overstock.com/Home-Garden/SmartBidet-SB-100R-Electric-Bidet-Toilet-Seat-for-Elongated-Toilets/25659959/product.html?refccid=5AYWVQIN7INI3OKDDOUGO3IFSE&searchidx=0&option=43007655&kwds-&rfmt= (accessed Aug. 24, 2020).

Lowes.com, "American Standard ActiClean White WaterSense Elongated Chair Height 2-Piece Toilet 12-in Rough-In Size (ADA Compliant)," https://www.lowes.com/pd/American-Standard-ActiClean-White-WaterSense-Elongated-Chair-Height-2-Piece-Toilet-12-in-Rough-In-Size/1000059443?cm_mmc=aff-_-c-_-prd-_-mdv-_-gdy-_-all-_-7097578-_-2617611-_-10935405 (accessed Aug. 24, 2020).

* cited by examiner

TOILET SEAT ASSEMBLY WITH CLEANING SYSTEM

RELATED APPLICATIONS

This application claims the benefit under 35 U.S.C. § 119(e) of U.S. Provisional Patent Application No. 62/950,229, entitled "TOILET SEAT ASSEMBLY WITH CLEANING SYSTEM" filed on Dec. 19, 2019; U.S. Provisional Patent Application No. 62/902,025, entitled "TOILET SEAT ASSEMBLY WITH CLEANING SYSTEM" filed on Sep. 18, 2019; U.S. Provisional Patent Application No. 62/865,695, entitled "APPARATUS AND METHOD FOR LIFTING AND CLOSING TOILET SEAT" filed on Jun. 24, 2019; and U.S. Provisional Patent Application No. 62/856,088, entitled "APPARATUS AND METHOD FOR LIFTING AND CLOSING TOILET SEAT" filed on Jun. 2, 2019; the contents of which applications are incorporated herein by reference in their entireties.

TECHNICAL FIELD

This application is generally directed to toilet seats and methods for cleaning a toilet. More specifically, this application is directed to a toilet seat with a cleaning system.

BACKGROUND

Most toilets include both a toilet seat and a toilet lid designed to cover the toilet bowl. The user can lift the lid and the seat by hand and return them in the same manner. Mechanical devices exist for automatically lifting toilet lids and seats, but they are bulky, lack aesthetic appeal, and are often difficult to install and maintain.

SUMMARY

In one aspect, a toilet seat assembly includes a toilet seat and a lid attached to a base and movable between a closed position and an open position. A cleaning assembly is at least partially housed in the base and includes a cleaning cassette configured to contain a cleaner in liquid or solid form, valves used to control flow of water between a mains water supply and a bowl of the toilet. A processor controls operation of the valve assembly to direct water as needed for the cleaning process. The processor can be housed in the base, which also includes a power supply and a user interface, in accordance with some embodiments.

In one example, water can be directed to clean portions of the toilet bowl, seat, and lid. In one such embodiment, the water passes through the cleaning cassette containing liquid or solid cleaner (e.g., bleach, a bleach tablet, a surfactant, etc.) such that a cleaner is added to the water entering the bowl. An aqueous cleaning solution can be sprayed onto targeted regions of the toilet bowl in addition to being sprayed onto the toilet seat and rim, for example.

In another aspect, a toilet seat assembly has a seat and lid that can be automatically raised and lowered using water provided by the mains water supply. The assembly can include or omit the cleaning assembly. In one embodiment, the toilet seat assembly includes a toilet seat and lid, the toilet seat and lid each have a hinge portion operably connected to the hinge assembly that is operable at least in part with water pressure provided by the mains water supply. For example, the hinge assembly includes a hydraulic cylinder arranged so that the mains water supply moves the cylinder piston to raise the seat and/or lid. Lowering the seat and/or lid can be accomplished with a return force on the piston provided by water pressure, a spring, gravity acting on the seat/lid, or some other force or combination or forces.

In one embodiment, a hydraulic cylinder has a first volume on one side of the piston and a second volume on the opposite side of the piston. A first valve is operable to open and close the water supply to the hydraulic cylinder from the mains water supply. A second valve is operable to drain water from the hydraulic cylinder when the first valve is closed. By opening the first valve, water is directed to the first volume of the hydraulic cylinder to advance the piston in a first direction while engaging the hinge portion of the toilet seat and/or lid. In doing so, the seat and/or lid can be raised as desired. In one example, the piston includes a cam follower on its distal end. As the piston advances axially through the hydraulic cylinder, the cam follower engages a cam pathway in the hinge portions of the toilet seat and/or lid. From the raised position, water can be drained from the first volume and supplied to the second volume to move the piston in an opposite to lower the raised seat and/or lid. When the assembly is configured with automatic cleaning, the water from the hydraulic cylinder can be used for cleaning operations.

One or more sensors located on the toilet seat assembly can be used to trigger operation of the valves to automatically open or close the seat and/or lid. For example, a sensor on the lid, seat, or other portion of the assembly can sense movement or proximity of a user. The sensor signal is processed at the processor to operate the valves and open the lid. A second sensor can detect a gesture or other input to open the seat. After the user leaves the toilet, the sensor(s) signal received at the processor is used to close the seat and lid as needed.

A method of raising and lowering a toilet lid and set is also disclosed. Further, a method of cleaning a toilet and seat assembly is also disclosed.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter

Figure 1:
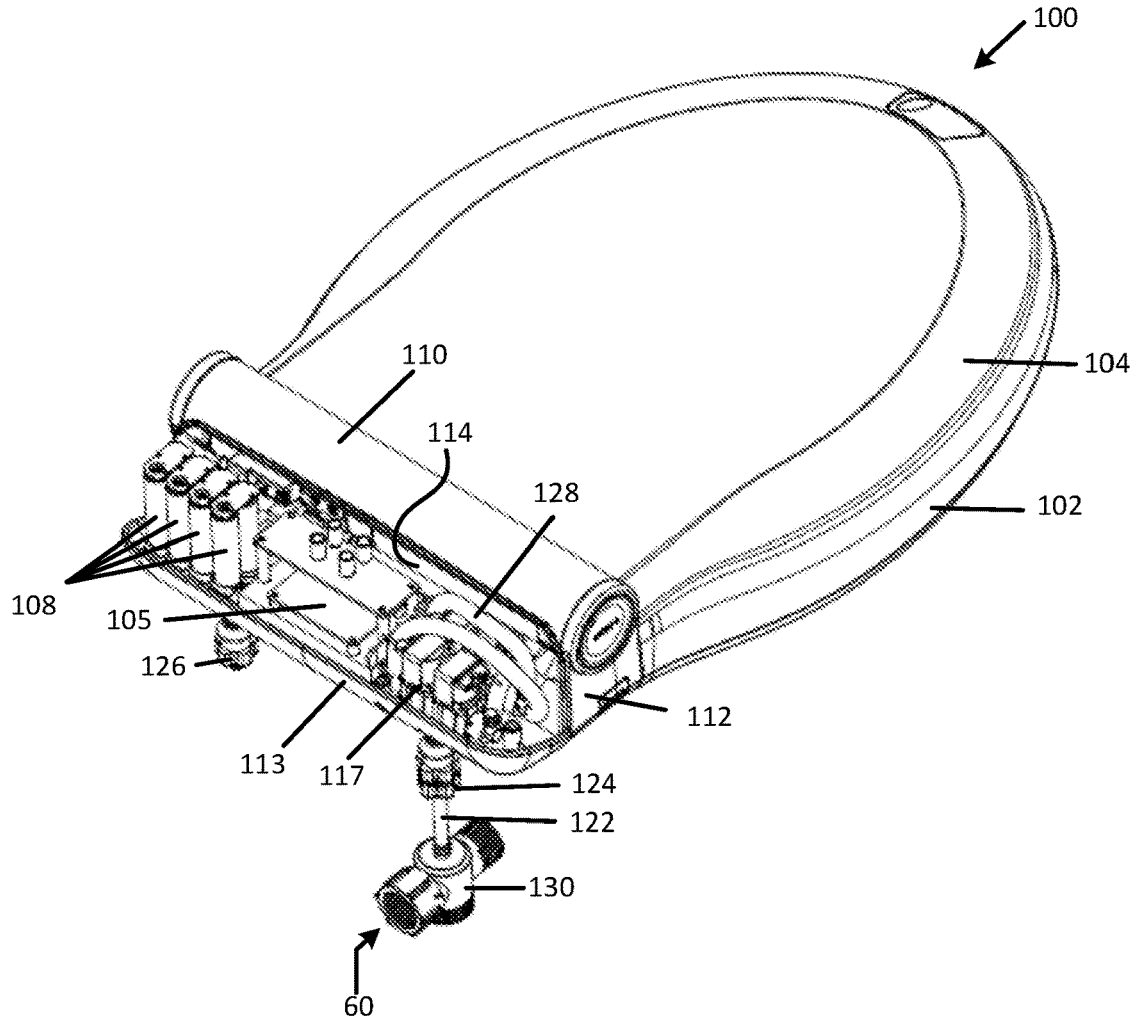
FIG. 1 illustrates a top and rear perspective view of a toilet seat assembly showing components of an operation and cleaning system, in accordance with an embodiment of the present disclosure.

The figures depict various embodiments of the present disclosure for purposes of illustration only. Numerous variations, configurations, and other embodiments will be apparent from the following detailed discussion. Furthermore, as will be appreciated, the figures are not necessarily drawn to scale or intended to limit the described embodiments to the specific configurations shown.

DETAILED DESCRIPTION

A toilet seat assembly includes lifting and closing functions for the lid and seat as well as cleaning functions, in accordance with an embodiment of the present disclosure. In some embodiments, the toilet seat assembly can automatically open and close the lid and/or seat of the toilet without user contact, allowing the user to avoid touching the lid or seat with the hands before and after using the toilet. The apparatus can also automatically close the lid after use, to assure that the seat and/or lid is not left in the raised position. In one example, the lid and/or seat is raised using a hydraulic cylinder driven at least in part by mains water pressure. Valves control the flow of water to the cylinder to raise or lower the seat and lid as needed.

In some embodiments, access to mains electricity is not required to raise or lower the seat. Instead, pressurized water provided by the mains water supply is used in a hydraulic cylinder. Electricity to power a control circuit, for actuating valves, and for operating sensors, for example, can be provided by a battery or other stored charge. The drive and control portion of the assembly can be positioned horizontally along the back of the toilet seat adjacent the tank. When installed on a toilet, for example, the housing can be constructed to fit within the space available between the tank and the rear edge of the bowl of existing toilets and also does not require components that hang or suspend from sides of the toilet.

Operational modes allow only the lid to be raised or both the lid and seat to be raised. Either the lid or both of the seat and lid may be returned to a closed position when the user departs. The action of the seat and lid may be controlled by a sensor, such as a motion sensor that triggers the action of the lid and/or seat when a user approaches the toilet, or an infrared sensor that senses a particular motion or gesture by the user. In one example, raising the seat can be triggered by an action separate from that used to raise the lid, such as waving a hand over the top of the lid when the lid is in an open position.

In another embodiment, the assembly includes a cleaning system that provides touchless cleaning of the bowl, the seat, and/or the lid in response to user input or according to programmed intervals. The cleaning system allows the user to avoid contact with the lid or seat in order to maintain a clean toilet seat, bowl, and lid, in accordance with some embodiments. In one example, water used to drive the hydraulic cylinder is flushed through a cassette containing a cleaning solution or solid, and then is sprayed into the toilet bowl. In other embodiments, the cassette can be a replaceable container with an outlet in fluid communication with the liquid pathway to the toilet. In some such embodiments, a Venturi valve, jet pump eductor, syringe pump, or other pump, can be employed to draw liquid cleaning solution from the cassette. The outlet to the toilet bowl can include one or more nozzles to provide a stream, fan, mist, or other spray of cleaning solution into the toilet bowl. In some embodiments, the cleaning system includes a piezoelectric or ultrasonic spray nozzle to dispense a mist onto portions of the seat and lid.

In some embodiments, the cleaning system includes valves that control water flow to the hydraulic cylinder and to the toilet bowl. By operating certain combinations of valves, water from the mains supply, from the hydraulic cylinder, or both, can be used to clean the toilet bowl with a pressurized jet of cleaning solution. For example, water exiting the hydraulic cylinder can pass through a cleaning cassette containing bleach or some other cleaning product to add the cleaning product to the stream of water used to clean the toilet. Cleaning solution can also be directed to a piezoelectric spray nozzle to mist portions of the seat and lid.

The toilet seat assembly need not be brand specific and can be provided as an aftermarket part that can be installed by the consumer on new or existing toilets. For example, the toilet seat assembly can be configured to fit standard round or elongated toilets. The apparatus for raising the lid and seat may be integral to the lid and seat and can be sold as a package. In many cases, the toilet does not need to be retrofitted in any way, and the seat and lid can be replaced similarly to conventional methods using bolts that extend through the toilet. In some cases, the user tightens two bolts to connect the seat assembly to the toilet as is conventionally required when installing a new seat. The user can then connect the apparatus to the mains water supply, such as by installing a T-fitting between the mains water line and the toilet tank. Numerous variations and embodiments will be apparent in light of the present disclosure.

General Overview

Existing toilet seat assemblies typically include a seat and a lid that can be attached to the toilet by a pair of bolts extending through the toilet. The user manually opens and closes the seat and lid, which requires hand contact with the toilet seat. Men sometimes use the toilet with the seat raised and women always use toilets with the seat down. Some men don't like to touch the dirty toilet seat to raise or lower the seat and sometimes forget to lower the seat after using the toilet. Women may get upset if a toilet seat is left in the raised position or if urine is on the seat. In any event, people generally dislike touching, interacting with, or cleaning toilets and toilet seats.

One approach to raising and lowering a toilet seat is an electrically operated seat for toilets and bidets. However, such seats are expensive and need specialized installation that includes connecting the toilet to the mains power supply. These seats also do not address cleaning the toilet bowl, the seat, or the lid.

Existing approaches to cleaning a toilet include manually spraying a cleaner onto portions of the bowl and seat assembly using a spray bottle with liquid cleaner or a bottle with an angled dispensing tip to apply a gel or liquid cleaner under the rim of the toilet bowl. Such approaches may assist the user in applying the cleaner, but scrubbing or other further action is generally required. Another cleaning approach includes placing a slowly dissolving bleach or disinfectant tablet into the toilet tank. This approach only addresses surface cleaning and the chemicals used in the tablet often destroy seals in the toilet tank. Yet another approach includes hanging a cleaning solid on the inside of the toilet bowl so that water mixes with and dissolves part of the solid during each flush. Such containers hanging into the toilet bowl are perceived as unsightly and the hanging apparatus may itself become disgusting and unsanitary.

Accordingly, a need exists for a toilet seat that can automatically raise and lower without user contact. A need also exists for a system that cleans portions of a toilet, such as the bowl, the seat, and the lid, without contact by the user. The present disclosure addresses these needs and others.

Structure and Operation

Figure 2:
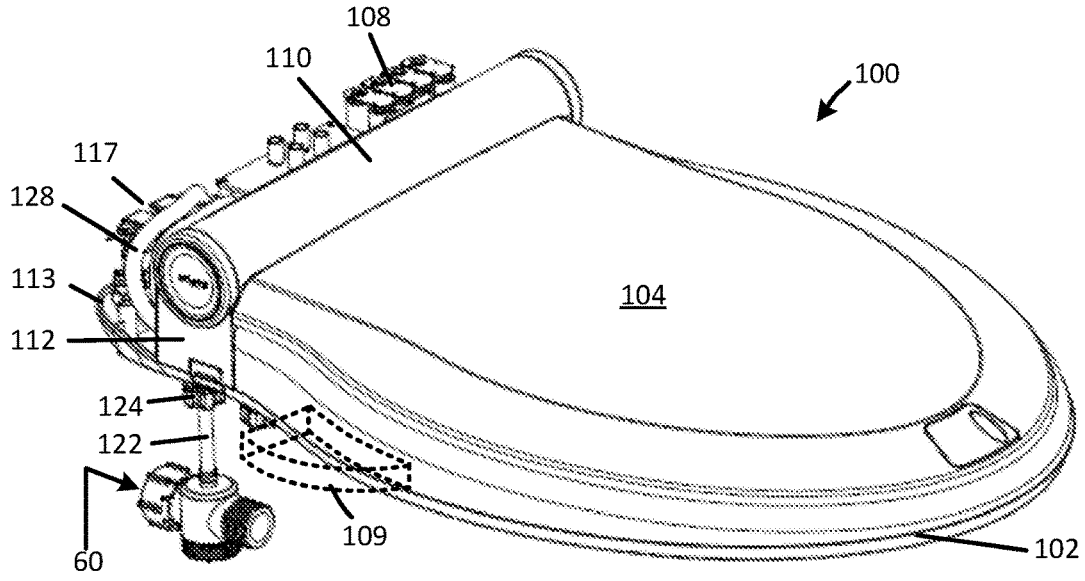
FIG. 2 illustrates a front and side perspective view of the toilet seat assembly of FIG. 1.
Figure 3:
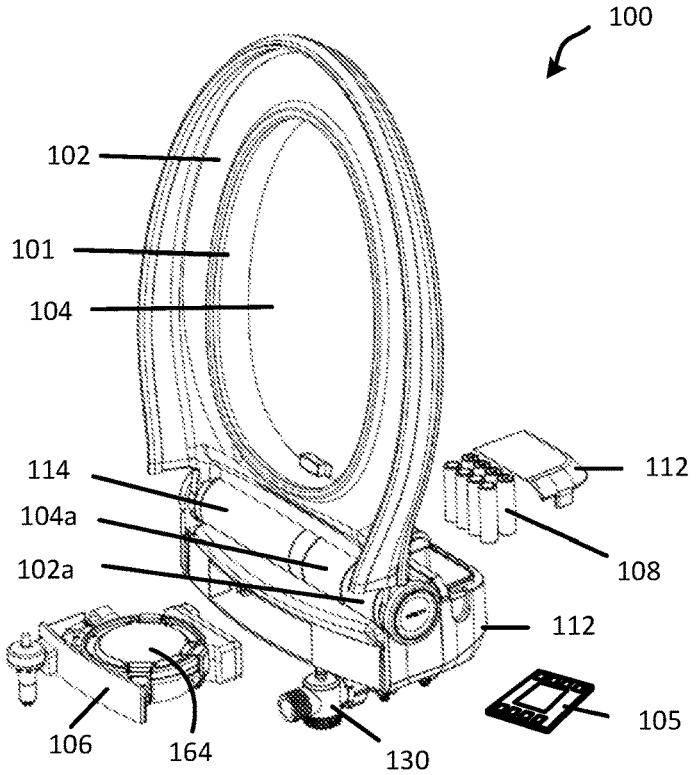
FIG. 3 illustrates a front perspective view of a toilet seat assembly showing the lid and seat in a raised position and some components removed from the housing, in accordance with an embodiment of the present disclosure.
Figure 4:
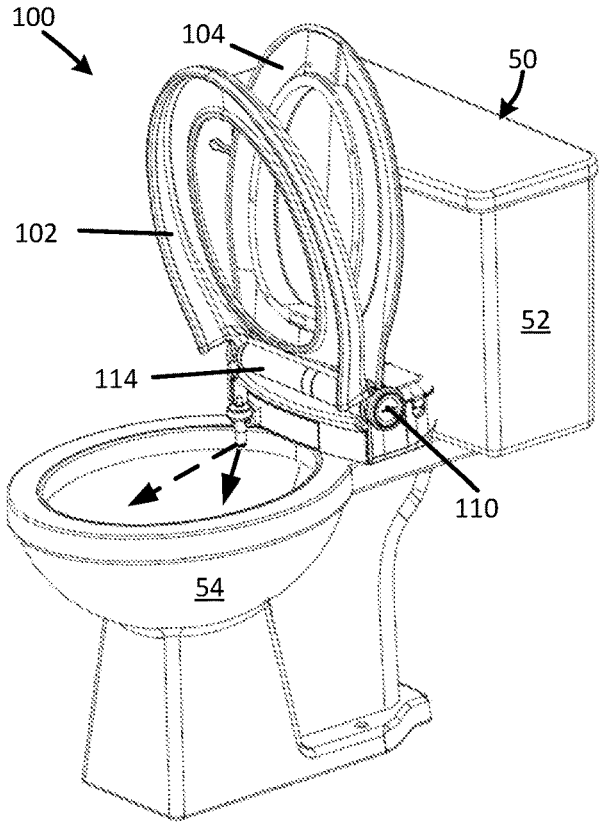
FIG. 4 illustrates a front perspective view of a toilet equipped with a toilet seat assembly, in accordance with an embodiment of the present disclosure.

FIGS. 1-4 illustrate various views of a toilet seat assembly 100 that includes a toilet seat 102, a lid 104, and a hinge assembly 110 operably connected to the seat 102 and lid 104, in accordance with some embodiments of the present disclosure. FIGS. 1 and 2 are rear and front perspective views, respectively, showing the seat 102 and lid 104 in a closed position and part of the housing 112 removed to reveal components of the hinge assembly 110. FIG. 3 is a front perspective view of a toilet seat assembly 100 showing the seat 102 and lid 104 in a raised or open position, and showing a processor 105, a cleaning cassette 106, and energy source 108 (batteries) removed from the hinge assembly 110. FIG. 4 is a front perspective view showing an example embodiment of the toilet seat assembly 100 installed on a toilet 50. Note that in some embodiments, the lid 104 is optional.

The seat 102 and lid 104 are constructed for installation on a toilet 50 that includes a tank 52 and bowl 54, such as shown in FIG. 4. The seat 102 and lid 104 are attached to the hinge assembly 110 and are operable between an open position and a closed position. The seat 102 includes a seat hinge portion 102*a* and the lid 104 includes a lid hinge portion 104*a*. The hinge portions 102*a*, 104*a* are arranged coaxially with the hydraulic cylinder 114, which is discussed below. The hinge assembly 110 extends horizontally along the back of the seat 102 and lid 104 and is positioned adjacent the base of the tank 52. In some embodiments, the housing 112 includes a vertical wall or flange 113 along the back of the hinge assembly 110 to direct any leaks into the toilet bowl 54 rather than towards the tank 52.

As with traditional seat assemblies, the seat 102 is constructed to provide a place for the user to sit while using the toilet 50 and the lid 104 covers the opening (not shown) in the seat 102 when closed. The lid 104 can be opened independently of the seat 102, and when the seat 102 is opened, it may be opened at the same time or subsequent to opening the lid 104. Similarly, the seat 102 can be closed independently or together with the lid 104. In some embodiments, such as shown in FIG. 3, the lid 104 includes a shroud 101 that extends vertically below the top of the seat 102 when the seat 102 and lid 104 are closed. The shroud 101 generally has an annular shape consistent with that of an opening of the toilet seat 102. When the lid 104 is closed, the shroud 101 blocks the seat 102 from getting wet during cleaning cycles and also blocks cleaning solution passing through a gap (if any) between the seat 102 and bowl 54. For example, the shroud 101 connects to and extends from a bottom surface of the lid 104 and extends vertically down towards the bowl 54 when the lid 104 is closed. During a cleaning cycle, for example, the cleaning solution can be sprayed or otherwise directed in various directions, including towards the lid 104, without leaving the toilet 50 or wetting the seat 102. In another example, the shroud 101 is a separate component either between the seat 102 and lid 104 or between the seat 102 and bowl 54.

In other embodiments, the seat 102 forms a liquid-tight interface with the rim 56 of the toilet bowl 54 and the lid 104 forms a liquid-tight interface with the seat 102, such as by a gasket between the rim 56 and seat 102. In other embodiments, the seat 102 may be elevated by standoffs (not shown) slightly above the rim 56 of the toilet 50 when closed. Numerous variations and embodiments will be apparent in light of the present disclosure.

The toilet seat assembly 100 has a housing 112 that contains components used to operate the toilet seat assembly 100, including a stored energy source 108 (e.g., batteries) and a processor 105 or printed circuit board assembly (PCBA). In one embodiment, the hinge assembly 110 includes a hydraulic cylinder 114 that uses water pressure of the mains water supply to advance a rod or piston to open or close the seat 102 and lid 104. In other embodiments, the hydraulic cylinder 114 can be operated at least in part with compressed gas, a spring, or a motor.

In this example, the seat includes a seat hinge portion 102*a* and the lid 104 includes a lid hinge portion 104*a*. As the piston 140 advances from a starting position, it moves laterally and engages the lid hinge portion 104*a*, then the seat hinge portion 102*a* to open the lid 104 and seat 102. Water from the pressurized main water supply is fed to valve assembly 117 via a conduit 122. In some embodiments, the conduit 122 extends through a hollow bolt 124 used to secure the assembly 100 to the bowl 54 via through-holes that are provided in conventional porcelain and other toilets. In one embodiment, the hollow bolt 124 defines part of the conduit 122, where the water supply can be connected to a lower end of the hollow bolt 124, for example. In other embodiments, the hollow bolt 124 defines a passageway that is sized to receive the conduit 122 (e.g., tubing or pipe) therethrough to connect the mains water supply to the valve assembly 117. Optionally, a filter, such as a mesh filter, may be included in the conduit 122 or other location to trap debris. A second bolt 126 extends from the bottom of the opposite side of the housing 112, where the bolts 124, 126 are positioned and spaced for through-openings on the bowl 54. Optionally, one or both bolts 124, 126 has freedom to move side to side and/or front to back to accommodate different spacings of mounting holes, different sized toilet bowls 54, or other variations, as will be appreciated. In one embodiment, tubing 128 and one or more splitters 130 and other fittings are used to direct the water to the valve assembly 117, to the hydraulic cylinder 114, and to the cleaning cassette 106. In other embodiments, the hydraulic cylinder 114 can have two inlets, each inlet connected with tubing to a different source.

In some embodiments equipped with a cleaning function, the housing 112 can be configured to retain a cleaning cassette 106 that is removable or replaceable and that contains a disinfectant, a surfactant, toilet bowl cleaner, bleach, or other suitable cleaning product 164 in liquid or solid form. In some embodiments, the cleaning product 164 is or contains one or more of a fragrance to assist in masking or neutralizing odors, a dye or the like to mask the color of urine, or a product that establishes a thin film barrier on water in the toilet bowl to contain odors and germs in the toilet water. The cleaning cassette 106 may contain a combination of cleaning products 164 in liquid, solid, or both liquid and solid forms, in accordance with some embodiments. Some variants of the cleaning product 164 can reduce the need to flush the toilet as often, resulting in reduced water usage, as will be appreciated. In one such embodiment, water in the hydraulic cylinder 114 passes through the cleaning cassette 106 to mix with or otherwise draw the cleaning product into the water stream as it is dispensed into the toilet bowl 54. In one example embodiment, a Venturi valve connected to or otherwise in communication with the cassette 106 draws liquid cleaning product 164 from the cassette 106 as water from the hydraulic cylinder 114 passes to the toilet bowl 54.

As shown in dashed lines in FIG. 2, the seat 102 optionally includes a handle 109 that can be selectively extended from the side of the seat 102 for manually raising or lowering the seat 102. The lid 104 can be similarly equipped. In one example embodiment, the handle 109 is stored in a pocket or other opening defined in the toilet seat 102. The handle 109 can be slidably or pivotably mounted in the pocket, for example. In one embodiment, the handle 109 can be pushed in and pulled out of the side of the seat 102 like a tray or drawer. In another example, the handle 109 pivots about a hinge pin located adjacent a rear side of the opening and rotates into or out from the opening. Optionally, the handle 109 operates as a push button with a spring latch, where the user can push the handle 109 against spring pressure into the seat 102 to stow the handle 109, and then push the stowed handle 109 to release it from the seat 102.

Figure 5:
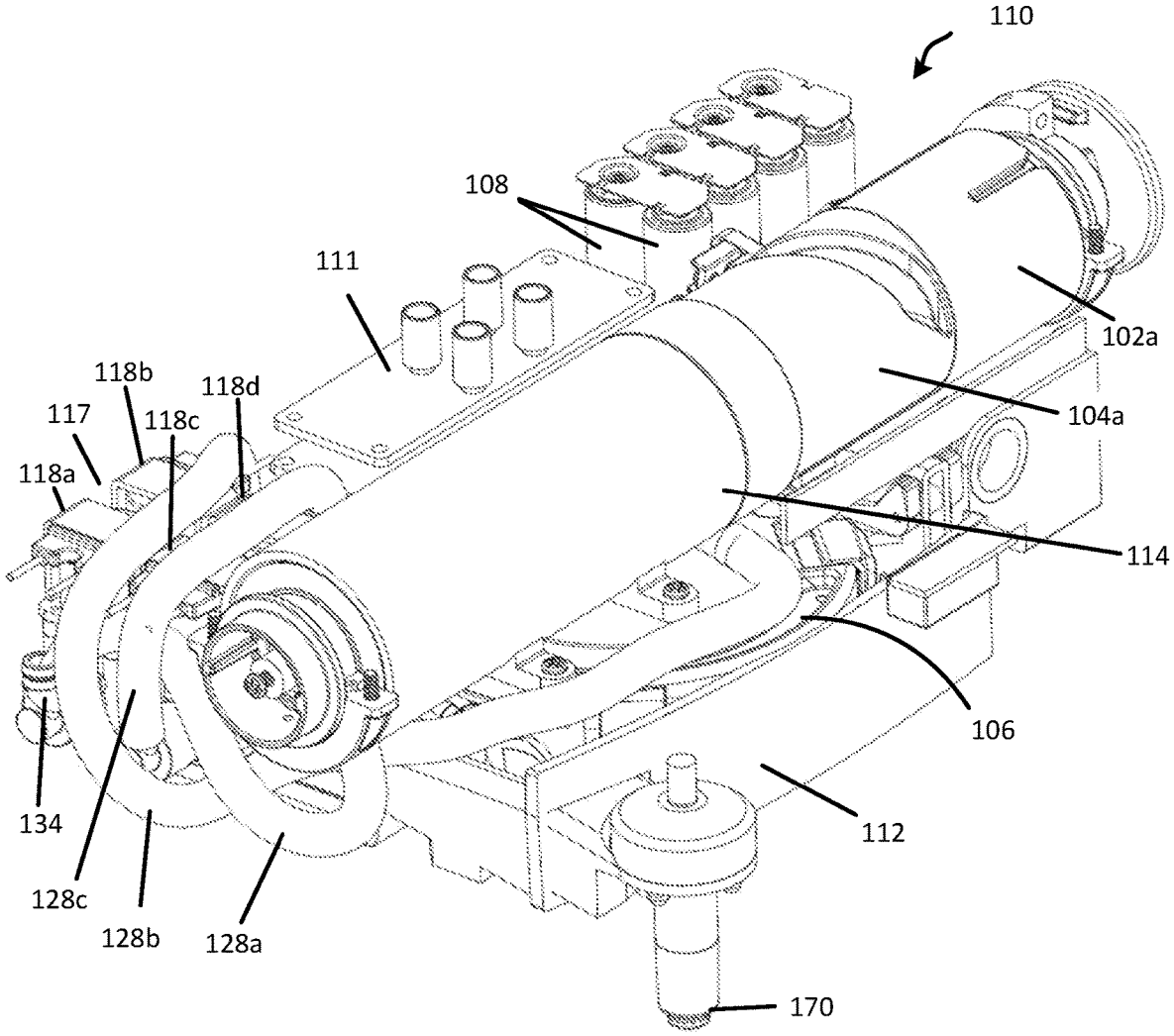
FIG. 5 illustrates a top, side, and front perspective view of part of a toilet seat assembly showing components of a hinge assembly and a cleaning assembly, in accordance with an embodiment of the present disclosure.
Figure 6:
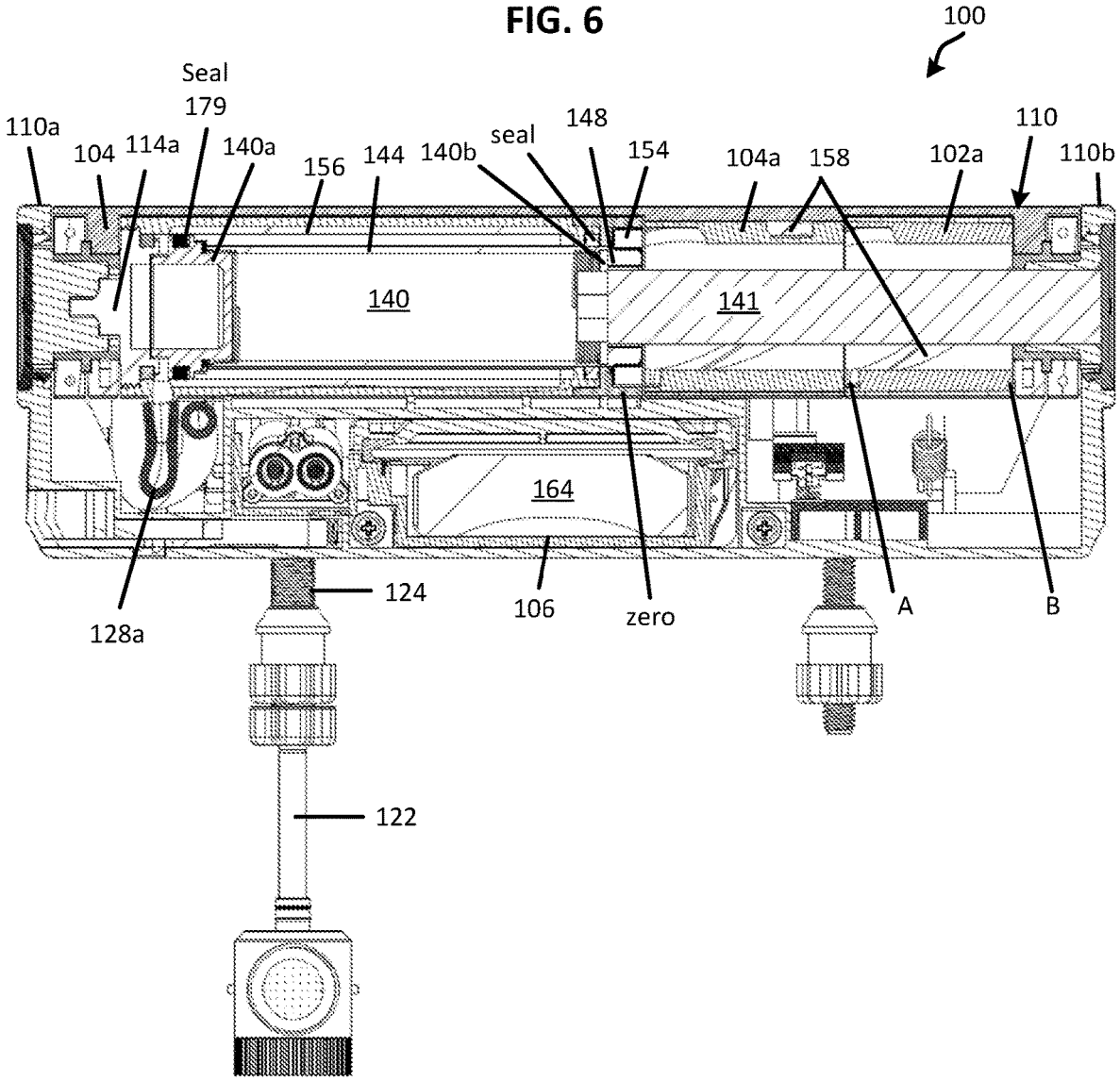
FIG. 6 illustrates a front view of a cross-section taken through the hinge assembly of a toilet seat assembly, in accordance with an embodiment of the present disclosure.

In more detail, FIGS. 5-6 illustrate a front perspective view and a rear cross-sectional view, respectively, showing components of the hinge assembly 110, in accordance with an embodiment of the present disclosure. Components used to direct water flow can be seen in FIG. 5. As noted above, water can be supplied to the valve assembly 117 via conduit 122 extending through a hollow bolt 124. In one example, tubing 128 (e.g., metal, plastic, or flexible polymer tubing) directs water into the first valve 118*a* where water is directed either to the second valve 118*b* or to the hydraulic cylinder 114. Tubing 128*a* connected between the first valve 118*a* and the hydraulic cylinder 114 can function as both an inlet and an outlet conduit in some embodiments. The first valve 118*a* controls water flow into and out of the hydraulic cylinder 114. The second valve 118*b* controls water flow exiting the hydraulic cylinder 114 to the cleaning cassette 106 or toilet bowl 54 via tubing 128*b*. A third valve 118*c* controls water flow from the hydraulic cylinder 114 either to the cleaning cassette 106 via tubing 128*c* or to the toilet bowl 54 via the fourth valve 118*d* and nozzle 170. Example water flow and valve positions are discussed in more detail below with reference to FIGS. 28-36. Note that valve assembly 117 can be replaced with other equivalent combinations of valves and fittings, as will be appreciated.

In some embodiments, the hydraulic cylinder 114 is operable with a valve assembly 117 that includes a first valve 118*a* and a second valve 118*b*. In one such embodiment, the hydraulic cylinder 114 can include a spring to assist in returning the cylinder to the start position with cylinder empty of water. When only the first valve 118*a* is open, water can enter from the water supply and pass into the hydraulic cylinder 114 to open the lid 104 and/or seat 102. When both the first valve 118*a* and the second valve 118*b* are open, water can also flow to the cleaning cassette 106. When only the second valve 118*b* is open, water may drain from the hydraulic cylinder 114 through the second valve 132 to the cleaning cassette 106 or directly to the toilet bowl 54, while closing the seat 102 and/or lid 104. Note that gravity acting on the closing seat 102 and/or lid 104 can be a contributing force that pushes water out of the hydraulic cylinder 114. Also note that a spring is not required and water pressure acting on the hydraulic cylinder 114 in the opposite direction can be used to operate the hydraulic cylinder 114 in the opposite direction (e.g., to close the lid 104), in accordance with some embodiments. When both valves 118*a*, 118*b* are closed, the system maintains the status quo, whether the seat 102 and/or lid 104 are open or closed.

In some embodiments, valves 118 of the valve assembly 117 are solenoid valves. Other suitable valves can be used, such as rotary-drive disk valves, motorized ball valves, and the like. In some embodiments, some or all of the fittings 134 are quick connect fittings, such as a push-to-connect fitting. Other suitable fittings can also be used, such as quick connect/quick disconnect fittings, barbed fittings, compression fittings, bayonet fittings, threaded fittings, and solder fittings, to name a few examples. In one example embodiment, the tubing 128 is 6 mm flexible polyurethane tubing and the fittings 134 are bite-type quick-connect fittings. Other suitable tubing materials include nylon, fluorescein polymer, polyolefin, metal, and others. Also note that valves 118 of the valve assembly 117 are shown as an integrated assembly; however, in other embodiments, individual valves 118 and suitable plumbing between them can be used, as will be appreciated. Numerous variations and embodiments will be apparent in light of the present disclosure.

In some embodiments, the water flow and pressure to hydraulic cylinder 114 can be controlled by one or more valves. For example, the speed of the filling of hydraulic cylinder 114 can be controlled by a separate valve that may be upstream of the first valve 118*a* or can be downstream of the first valve 118*a* or of the hydraulic cylinder 114 itself. The one or more valves 118 can be controllable so that, for example, the downstream pressure can be adjusted and maintained and so that the amount of water fed to the hydraulic cylinder 114 can be controlled. For instance, the feed to the hydraulic cylinder 114 may be maintained in a range of from 15 to 25 psi (~100-170 KPa) and water may be fed to the hydraulic cylinder 114 in increments of, for example, 1, 5 or 10 mL. The size of tubing 128 into and out of the hydraulic cylinder 114 can be selected to provide the desired flowrates into and out of the hydraulic cylinder 114, and in turn, to provide the desired opening and closing speeds of the seat 102 and lid 104, as will be appreciated. The travel of piston 140 can be controlled, hydraulically or otherwise, in continuous or stepwise increments of, for example, 1 mm, 5 mm or 1 cm. Such function can be carried out by two valves, for example. In one such embodiment, the first valve 118*a* is configured to control downstream pressure over a broad range of upstream pressures, and the first valve 118*a* can be opened and closed by a switch, such as solenoid. An additional shuttle valve can be positioned downstream of the first valve 118*a* and configured to open or close in response to the presence or absence of upstream pressure capable of shifting shuttle valve against the return force on the piston 140 provided by water pressure, a spring, or other return force or combination of forces.

Piston 140 may be sized to adequately provide a force sufficient to raise the seat 102 and lid 104 given standard mains water pressures such as, for example, 15, 20, 30 and 40 psi (100 KPa, 150 KPa, 200 KPa, and 275 KPa). In some municipalities, normal water pressure is about 40 to 45 psi (275 KPa-310 KPa), but the pressure generally does not exceed 60 psi (~415 KPa). In some instances, the piston 140 may have a cross-sectional area that is greater than 5 $cm^2$, greater than 10 $cm^2$, greater than 20 $cm^2$, greater than 30 $cm^2$ or greater than 40 $cm^2$. In one example embodiment, the piston 140 has a cross-sectional area of about 5-10 $cm^2$, including 7-9 $cm^2$, or about 8 $cm^2$. In the same and other embodiments, the piston 140 may have a cross-sectional area less than 100 $cm^2$, less than 50 $cm^2$, less than 30 $cm^2$, less than 20 $cm^2$ or less than 10 $cm^2$. In embodiments that include a spring, the spring provides a force adequate to push the piston 140 towards the starting position when it is no longer subjected to water pressure. The spring may also exert force sufficient to allow the seat 102 and/or lid 104 to be closed from a position greater than 90°, for example 110° with respect to rim 56 of the toilet bowl 54 or with respect to the horizontal, as the case may be.

Referring to FIG. 6 a front view illustrates a cross-section taken through the hydraulic cylinder 114, in accordance with an embodiment of the present disclosure. The hydraulic cylinder 114 is operably connected to the toilet seat 102 and lid 104 such that movement of the piston 140 through the hydraulic cylinder 114 moves the seat 102 and/or lid 104 between open and closed positions. As shown in FIG. 6, the hydraulic cylinder 114 is in a start or zero position with the piston head 140*a* adjacent the first end 110*a* of the hinge assembly 110 and the cam body 148 towards an end of the lid hinge portion 104*a*. This position is an example of one starting point for operating the toilet seat assembly 100. In the first position, for example, both the seat 102 and lid 104 are closed. Although illustrated as extending horizontally along the rear of the toilet seat assembly, the hydraulic cylinder 114 can be oriented horizontally in a front-to-back position with respect to the toilet 50, or oriented vertically. For example, the hinge assembly 110 can include a gear assembly (e.g., a rack and pinion, a sprocket, or a worm drive) used to open and close the seat and lid, where piston 140 moves perpendicularly to the hinge's axis of rotation.

The hydraulic cylinder 114 houses a main cylinder 156 containing a piston 140 or portions thereof. The piston 140 can move axially along an inside of the main cylinder 156 in response to water pressure and/or spring force provided by spring 142. As noted above, water can be supplied to the hydraulic cylinder 114 by a conduit 122 extending through a hollow bolt 124. Water supplied under pressure from the main water supply via tubing 128*a* (e.g., household water supply) enters the hydraulic cylinder 114 at a first end 114*a*, where water pressure displaces the piston 140 horizontally along an inside of the main cylinder 156 towards the second end 110*b* of the hinge assembly 110. When water pressure is relieved, and/or a counter force is applied, piston 140 returns toward the first end 110*a* of the hinge assembly 110.

In one embodiment, the piston 140 has a hollow cylindrical shape that receives part of an inner cylinder, a rod, a shaft or piston guide 141. In some embodiments, the piston 140 houses a spring that provides a return force on the piston 140. The piston 140 need not be truly cylindrical in all embodiments and instead can have an oval, hexagonal, octagonal, rectangular, or other cross-sectional shape, as will be appreciated. In one embodiment, the piston 140 moves along the inside of the main cylinder 156 and along a piston guide 141 that engages a cam body 148 in or on the distal end 140*b* of the piston 140. In some embodiments, the piston guide 141 has a T-shape, an H-shape, a rectangular ridge, a rail, or other geometry that can be used to guide movement of the cam body 148 and prevent rotation of the piston 140 as the cam follower 154 follows the helical pathway 158 in the lid hinge portion 104*a* and seat hinge portion 102*a*, as will be appreciated.

In one example embodiment, the piston 140 moves about 40-50 mm (~1.5-1.75 inches) from the start or zero position (e.g., as shown in FIG. 6) to a first position A (shown in FIG. 7), at which point the lid 104 is raised due to engagement between the cam follower 154 and the lid hinge portion 104*a*. The piston 140 moves an additional 40-50 mm from position A to a second position B, at which point the seat 102 is also raised due to engagement between the cam follower 154 and the seat hinge portion 102*a*. In one embodiment, the cam follower 154 rotates about 100-110°, such as 105°, as the cam body 148 moves from the start position to position A (e.g., raising the lid 104), and about the same amount as the cam body 148 moves from position A to position B (e.g., raising the seat 102). In other embodiments, the axial movement of the cam body 148 from the zero position to the first position A and from the first position A to the second position B can be different. The stop point for the toilet seat and lid in the open position can be selected to comply with industry standards and/or can be defined by part of the toilet or other structure (e.g., the toilet tank), for example.

A cam body 148 on the distal end 140*b* of the piston 140 moves with the piston 140 along the hydraulic cylinder 114. As the piston 140 moves towards the second end 110*b* of the hinge assembly 110, a cam follower 154 on the cam body 148 engages a helical pathway 158 defined in the lid hinge portion 104*a* and the seat hinge portion 102*a*, converting axial motion to rotational motion to raise or lower the seat 102 and lid 104. In one embodiment, each of the hinge portions 102*a*, 104*a* define a helical pathway 158 engaged by the cam follower 154. As the cam body 148 moves linearly along the piston guide 141, the rotational position of the cam follower 154 is maintained and engagement between the cam follower 154 and the helical pathway 158 on the hinge portions 104*a*, 102*a*, causes the lid 104 and seat 102 to rotate.

Hydraulic cylinder 114 can be made of any material capable of being exposed to water and air without damage. For example, hydraulic cylinder 114 and its components may be made of polymer or metal. Examples of suitable materials for the hydraulic cylinder 114 include acetal homopolymer known as Pom-H, including variants with or without a glass fiber filler, aluminum, and stainless steel. Some such materials exhibit higher creep resistance. Example materials for the inner cylinder 144 include nylon MDF with 25% glass filler. Such a material has good resistance to moisture absorption. Example materials for the cam follower 148 include nylon MDF, which desirable in some embodiments due to being soft and slippery. Components can be molded, machined or extruded. Numerous variations and embodiments will be apparent in light of the present disclosure.

In other embodiments, the hydraulic cylinder 114 uses a spring and a diaphragm. For example, the piston 140 is advanced in one direction by a spring and is advanced in an opposite direction by filling a diaphragm with pressurized water. When filled or partially filled with water, the diaphragm provides a force to move the piston 140 against the return force of the spring force. In yet other embodiments, the hydraulic cylinder 114 has a first diaphragm on one side of the piston 140 and a second diaphragm on an opposite second side of the piston 140. Filling the first diaphragm with water while draining water from the second diaphragm, or vice versa, can be used to advance the piston 140, as will be appreciated.

Figure 7:
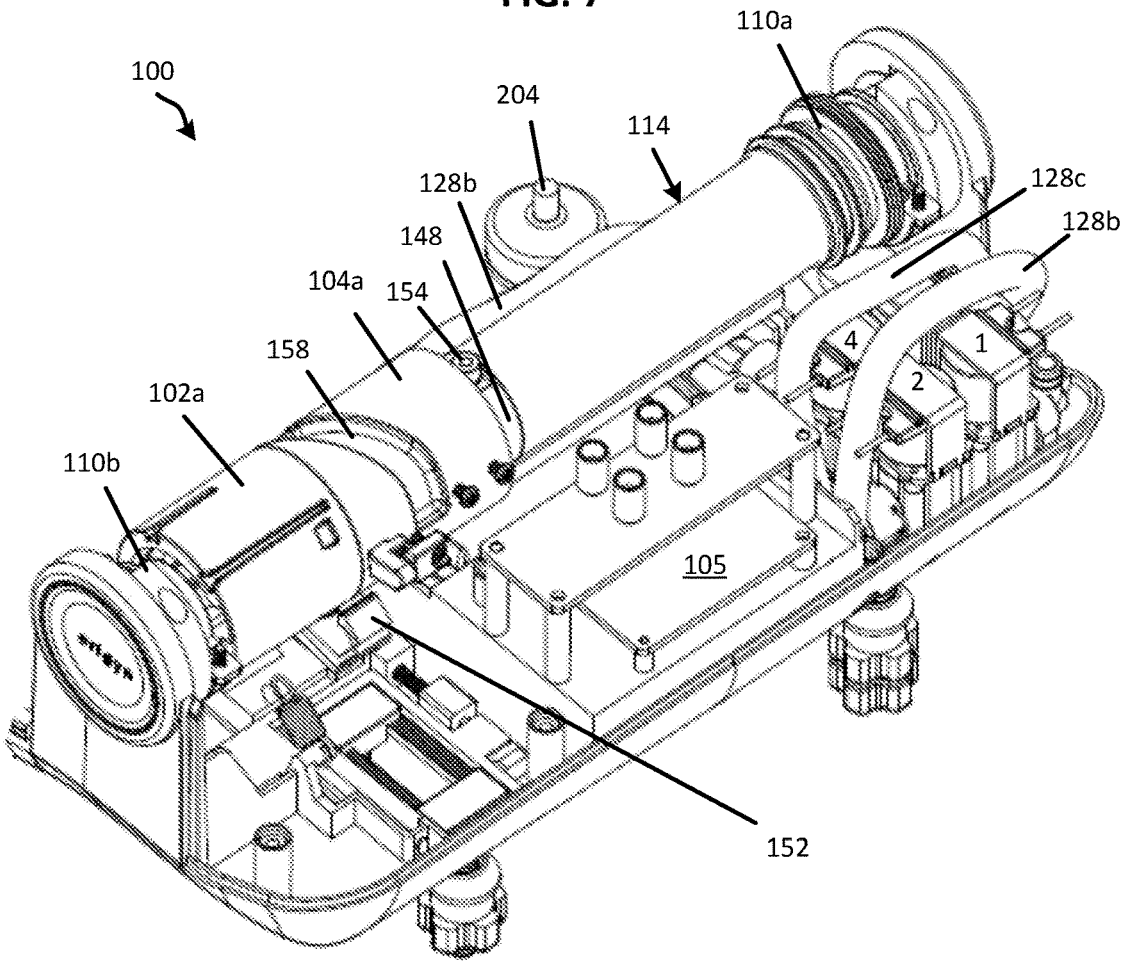
FIG. 7 illustrates a top and rear perspective view of a hinge assembly and valve assembly, in accordance with an embodiment of the present disclosure.
Figure 8:
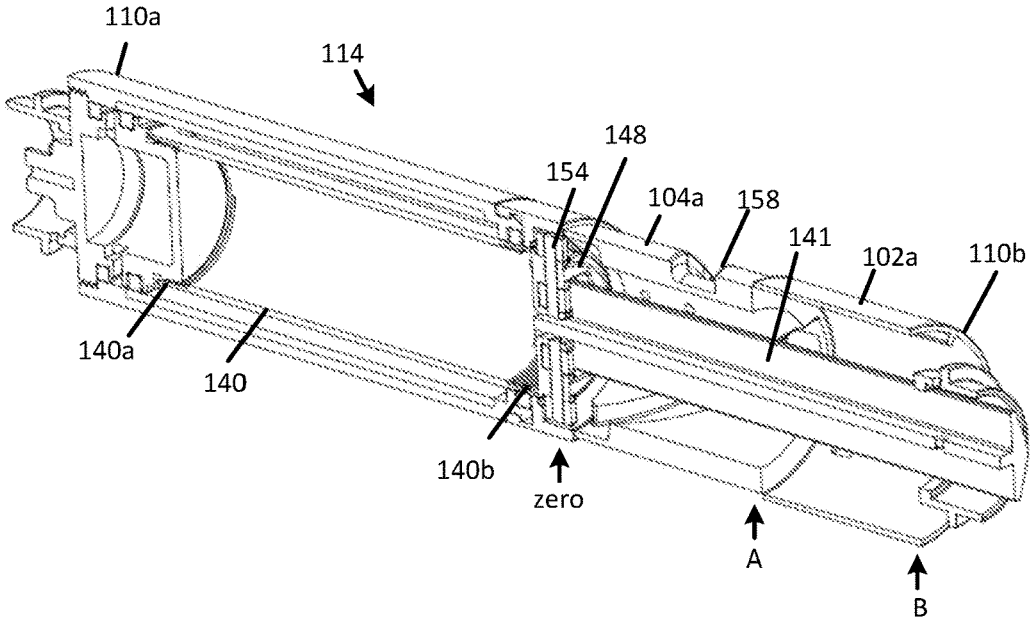
FIG. 8 illustrates a front cross-sectional view of a hydraulic cylinder, in accordance with an embodiment of the present disclosure.

FIG. 7 shows a top and rear perspective view of a hinge assembly 110 with part of the housing 112 removed to show the hydraulic cylinder 114, in accordance with an embodiment of the present disclosure. FIG. 8 illustrates a front perspective view showing a cross section of the hydraulic cylinder 114. In these examples, the cam body 148 is in the zero position, at which the seat 102 and lid 104 (not shown) are closed. Upon moving to first position A part way towards the second end 110*b* of the hinge assembly 110, the lid 104 is raised and the seat 102 remains closed. Upon receiving the appropriate input, the controller opens the first valve 118*a* to advance the piston 140 through the seat hinge portion 102*a* so that the cam follower 154 reaches second position B, at which point the seat 102 is also raised by action of the cam follower 154 in the helical pathway 158. At the second position B, the first valve 120 again closes to maintain the seat 102 and lid 104 in the open position. In some embodiments, when the first and second valves 118*a*, 118*b* are closed, such as when the piston 140 stops at first position A or second position B, the water is maintained in the hydraulic cylinder 114, so the position of piston 140 is maintained and the positions of the seat 102 and lid 104 are also maintained.

In some embodiments, the cam follower 154 can be used to prevent manual operation of the lid 104 and seat 102, in certain situations. For example, in some embodiments, the cam follower 154 is in clearance with the seat hinge portion 102*a* or lid hinge portion 104*a* when the seat 102 and lid 104 are closed, allowing the user to manually open and close the toilet seat and lid. For example, at the zero position the cam follower 54 has not started to engage the helical pathway 158 in the lid hinge portion 104*a*. In such position, the lid 104 and seat 102 can be operated manually without engagement with the hydraulic cylinder 114. Optionally, the toilet seat assembly 100 can include a lockout switch to prevent manual operation of the seat 102 or lid 104 unless the system is the off state. In such an embodiment, the system can be turned off and manually operated for cleaning. In one such embodiment, turning the system off returns the hydraulic cylinder 114 to the zero position. In another example, when the cam follower 154 has moved beyond the lid hinge portion 104*a* (e.g., first position A), and when the cam follower 154 is positioned at the second end 110*b* (e.g., second position B), the cam follower 154 engages the seat hinge portion 102*a* to prevent manual operation of the seat 102 or lid 104 when the system is turned on, in accordance with some embodiments. At first position A, for example, the cam follower 154 engages the seat hinge portion 102*a* and prevents the user from closing the seat 102 manually when the system is in the "on" state.

In some embodiments, one or more switches 152 are located at certain locations along the hydraulic cylinder 114 to signal or control opening or closing of valves when the cam follower 154 or other portion of the piston 140 reach the position of the switch 152. Each switch 152 can be a mechanical disconnect, a sensor, or some other device used to control operation of the valves 118, as will be appreciated. For example, as the cam follower 154 passes or reaches a first switch 152 in a first direction, at which point the lid 104 is raised, the first valve 118*a* closes to stop operation of the hydraulic cylinder 114. The first valve 118*a* may open again after the system receives an input signal that allows the piston 140 to move towards the second end 110*b* and raise the seat 102. Upon reaching the second end 110*b*, a second switch 152 detects the position of the piston 140 and signals the processor 105 to close the first valve 118*a*. For example, when the cam follower 154 reaches the second switch 152, the first and second valves 118*a*, 118*b* are closed to hold the seat 102 and lid 104 in the open position. Upon sensing an appropriate input, the second valve 118*b* can be opened to allow the piston 140 to return to the zero position and empty water from the hydraulic cylinder 114. The initial portion of return movement of the piston 140 also lowers and seat 102. If the first switch 152 does not signal the processor 105 to change the valve status as the cam follower 154 reaches the first switch 152, the piston 140 will continue towards the first end 110*a* of the hinge assembly 110 and lower the lid 104. Switches 152 can be configured to provide a setting where the system only raises the seat 102 and always leaves the lid 104 open, or a setting where the system only raises the lid 104 and never the seat 102, for example. Numerous variations and embodiments will be apparent in light of the present disclosure.

Figure 9:
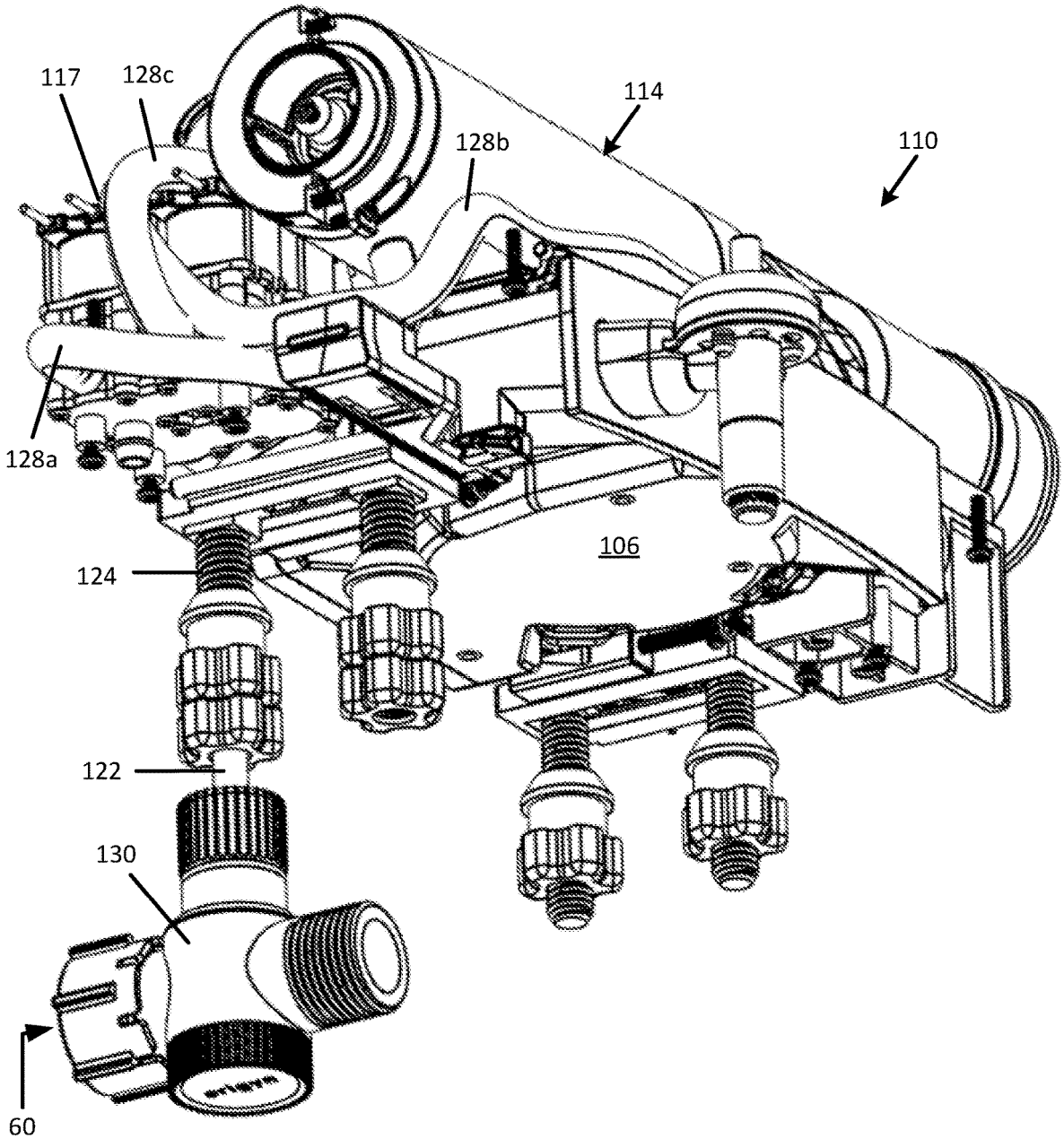
FIG. 9 illustrates a bottom and front perspective of part of a toilet seat assembly showing an example connection to the mains water supply and portions of the hydraulic cylinder and cleaning assembly, in accordance with an embodiment of the present disclosure.

Referring now to FIG. 9, a bottom and front perspective view illustrates part of a hinge assembly 110 that includes a cleaning cassette 106 and a splitter 130 configured to receive water from the mains water supply 60, in accordance with an embodiment of the present disclosure. In this example, a conduit 122 is connected to splitter 130 extends through the hollow bolt 124 that is used to secure the toilet seat assembly 100 to the toilet 50. In some embodiments, operation of the hydraulic cylinder 114 and valve assembly 117 can provide water used in part or in whole to flush the toilet. For example, water from the mains water supply 60 can be directed through the cleaning cassette 106 and to the bowl 54. The second valve assembly 117 can be controlled to adjust the flow rate of water to the bowl 54 and the total volume of water delivered to the bowl 54. In one embodiment, the water supplied to the bowl supplements the water delivered from the tank 52 when the toilet 50 is flushed. In some embodiments, the tank 52 is not used except for manually flushing the toilet. Accordingly, the tank 52 may be optional.

In one example, the tank 52 is configured to provide water sufficient to flush urine and other liquid waste. When the toilet is flushed after being used with both the lid 104 and seat 102 open, the processor 105 can be configured to use only the water supplied by the tank 52 during the flush cycle. On the other hand, for example, when only the lid is open during toilet use, the processor may supplement the water supplied by the tank 52 with water supplied from the mains water supply 60, such as to flush solid waste. In some embodiments, additional water needed to flush solid waste can be supplied by the tank 52.

In another example, the processor 105 controls the valve assembly 117, and any additional valves as needed, to provide water flow to the bowl 54 sufficient to flush either liquid waste or solid waste. In some embodiments, water supplied through the conduit 122 may be the only water used to flush the toilet (e.g., no water is supplied from the tank 52). In some such embodiments, the processor 105 can control the volume of water used for the flush. For example, the user may press a button by hand, push a button with the foot or leg, step on a mat, provide an audible command, make a hand gesture, or other detectable action so that the processor 105 initiates the appropriate flush cycle or other process. In another example, the appropriate flush cycle for solid or liquid waste is initiated based at least in part by input from one or more sensors. In yet other example, the appropriate flush cycle is determined by the position of the seat 102 prior to initiating the flush cycle. Numerous variations and embodiments will be apparent in light of the present disclosure.

Figure 10:
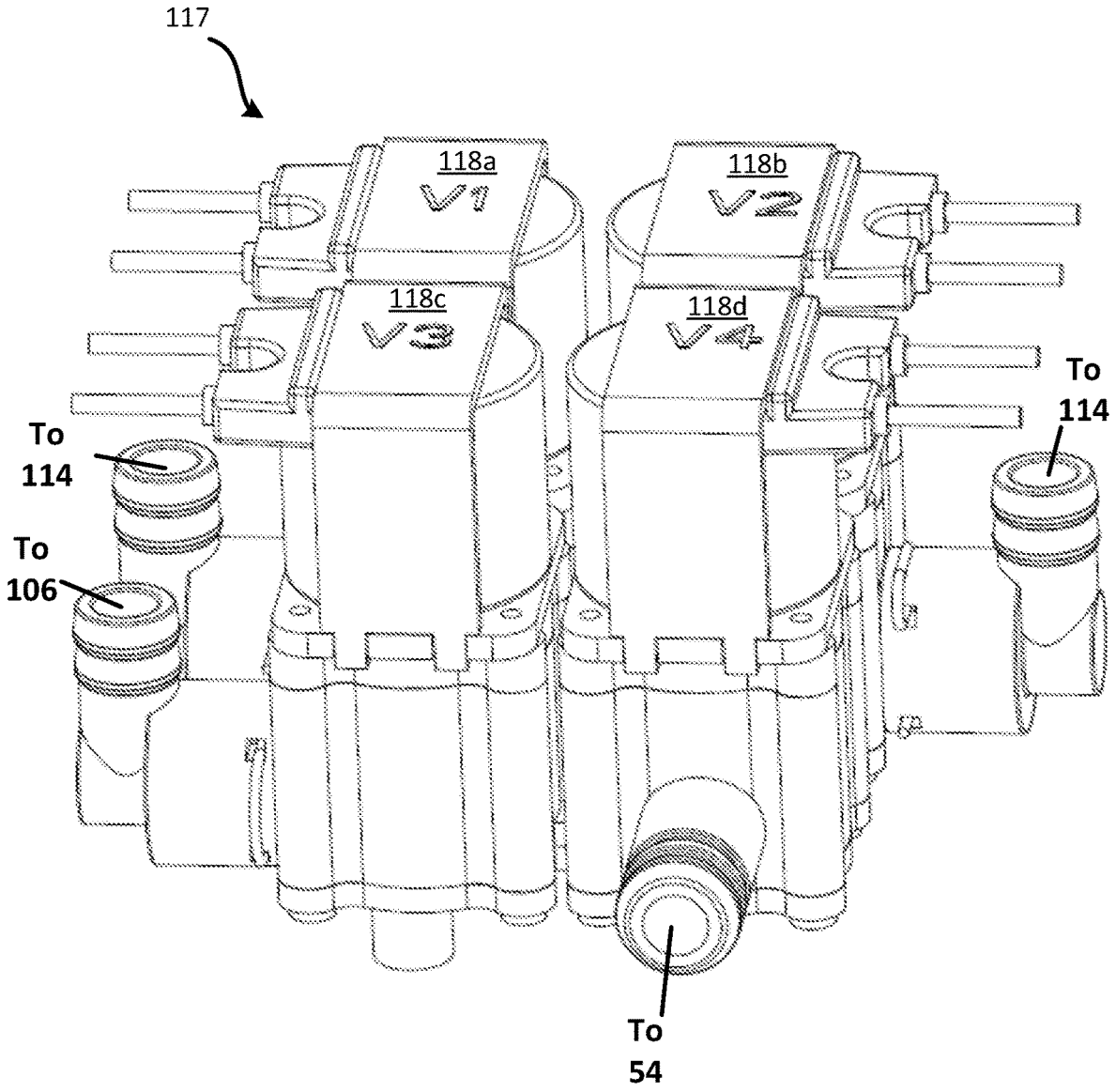
FIG. 10 illustrates a perspective view of a valve assembly that includes four valves, in accordance with an embodiment of the present disclosure.

Referring now to FIG. 10, a perspective view illustrates a valve assembly 117 that includes a first valve 118*a* and a second valve 118*b*, a third valve 118*c*, and a fourth valve 118*d*, in accordance with an embodiment of the present disclosure. In this example, the first valve 118*a* controls water supplied to the hydraulic cylinder 114 and the second valve 118*b* controls water draining from the hydraulic cylinder 114. The third valve 118*c* controls water flow to the cleaning cassette 106, and the fourth valve 118*d* controls water flow to the toilet bowl 54. Some or all of the valves can be a two-way, a three-way valve, or other type of valve as needed. Example positions of valves 118 of valve assembly 117 are discussed in more detail below with reference to FIGS. 28-36.

Figure 11:
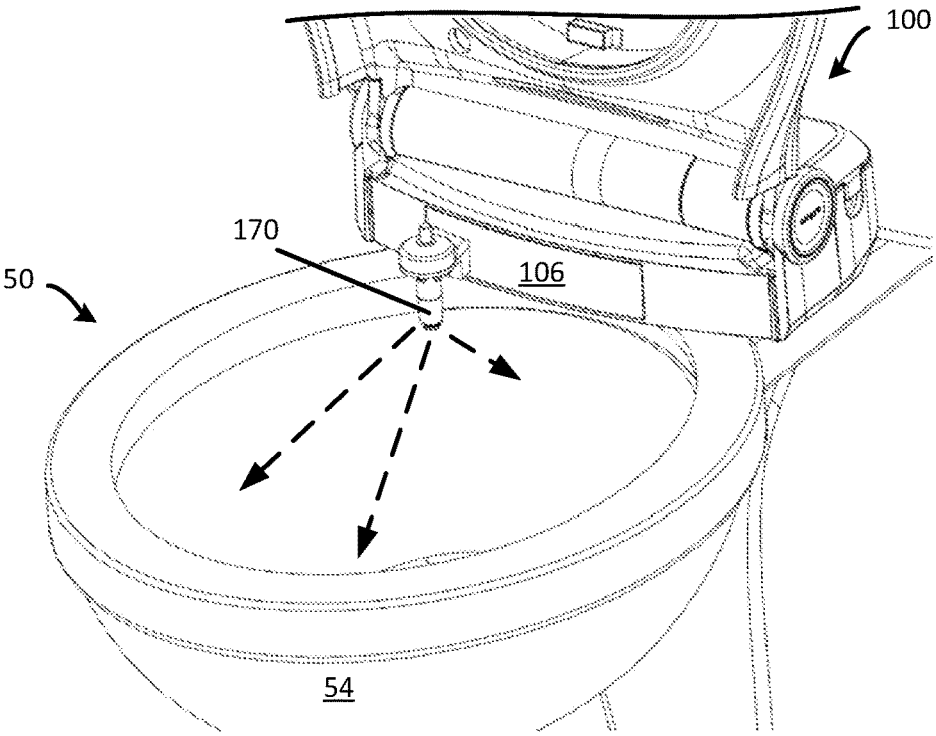
FIG. 11 illustrates a front perspective view of a toilet seat assembly with the lid and seat in an open position, in accordance with an embodiment of the present disclosure.

FIG. 11 illustrates a front view of a toilet 50 equipped with a toilet seat assembly 100 that includes a cleaning cassette 106, in accordance with an embodiment of the present disclosure. In this example, water from the hydraulic cylinder 114 (not visible) passes into the cleaning cassette 106 and is flushed out of the cleaning cassette 106 and into the bowl 54 through nozzles 170 or other suitable openings, for example. In one such embodiment, the water exiting the cleaning cassette 106 is delivered into the bowl 54 in a pressurized stream or jet that disturbs the water in the bowl 54 and aids in cleaning.

Figure 12:
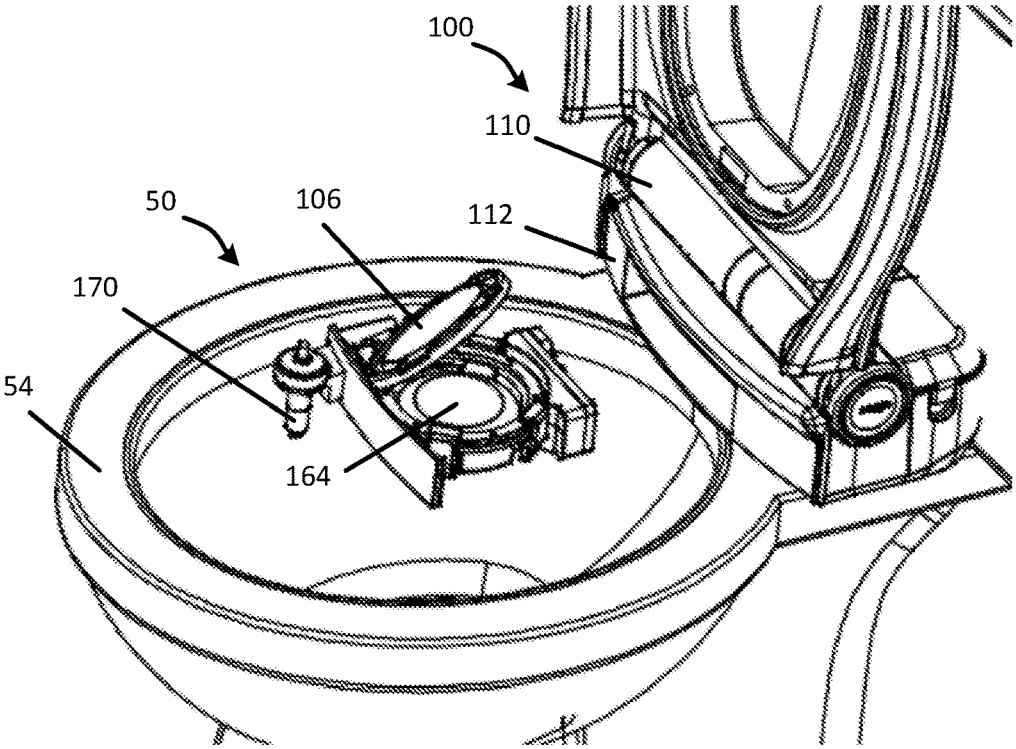
FIG. 12 illustrates a perspective view of a toilet seat assembly with a removable cleaning cassette shown removed from the assembly, in accordance with an embodiment of the present disclosure.

FIG. 12 is a perspective view showing toilet 50 and toilet seat assembly 100 of FIG. 11 with the cleaning cassette 106 removed from the housing 112. In this example, the cleaning cassette 106 is removable so that the user can refill the cassette 106 with additional cleaning product 164. For example, the user may provide cleaning product 164 in solid or liquid form, such as bleach, detergent or detergent boosters, ammonia, vinegar, tea tree oil, or other suitable cleaner. As discussed above, water from the hinge assembly 110 can be plumbed to pass through the cleaning cassette 106 or to draw cleaning product 164 from the cleaning cassette 106 on the way to the toilet bowl 54. Numerous variations and embodiments will be apparent in light of the present disclosure.

Figure 13:
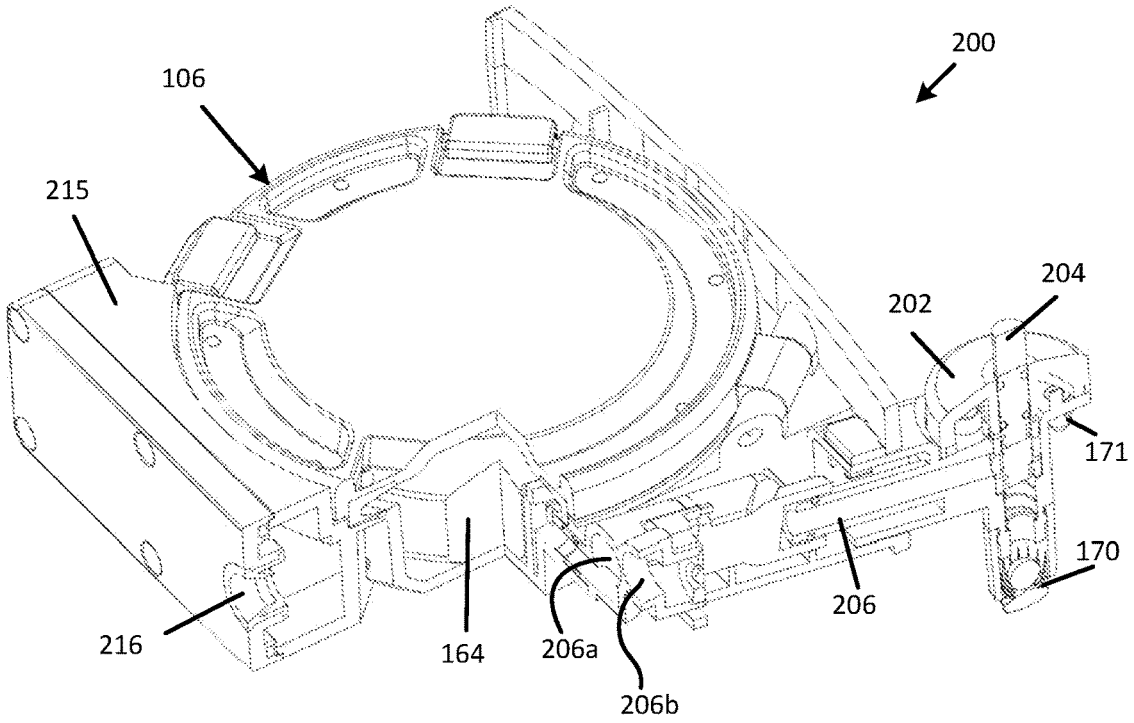
FIG. 13 illustrates a top perspective view of cleaning cassette and plunger valve shown partially cut away to reveal internal components, in accordance with an embodiment of the present disclosure.
Figure 14:
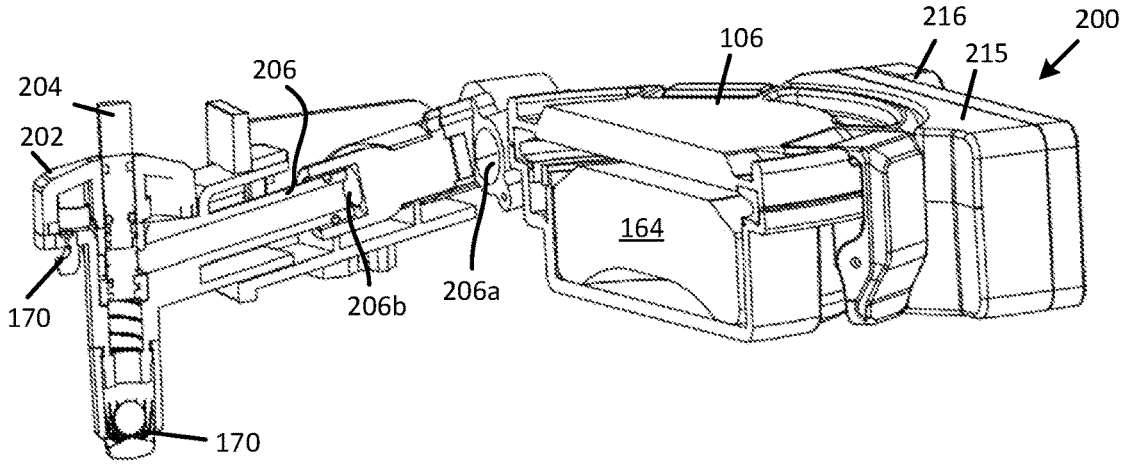
FIG. 14 illustrates a top and rear perspective view of a cleaning cassette and plunger valve shown partially cut away, in accordance with an embodiment of the present disclosure.
Figure 15:
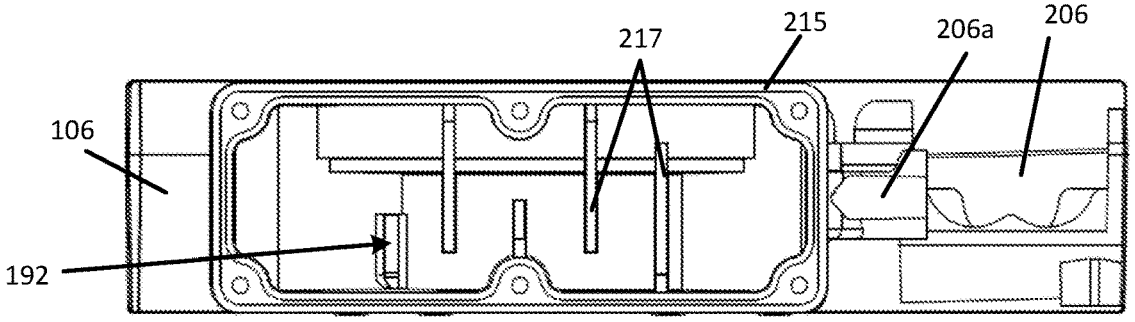
FIG. 15 illustrates a rear, cross-sectional view of a maze portion of a cleaning cassette, in accordance with an embodiment of the present disclosure.
Figure 16:
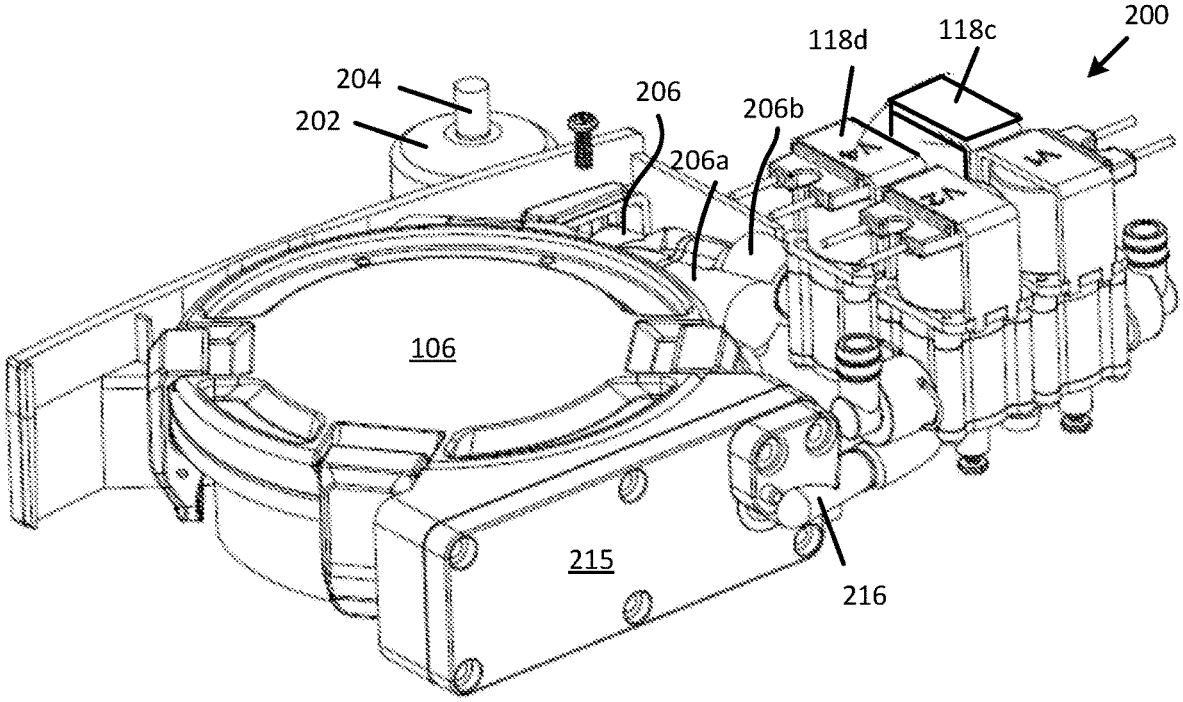
FIG. 16 illustrates a top and rear perspective view of a cleaning assembly, in accordance with an embodiment of the present disclosure.
Figure 17:
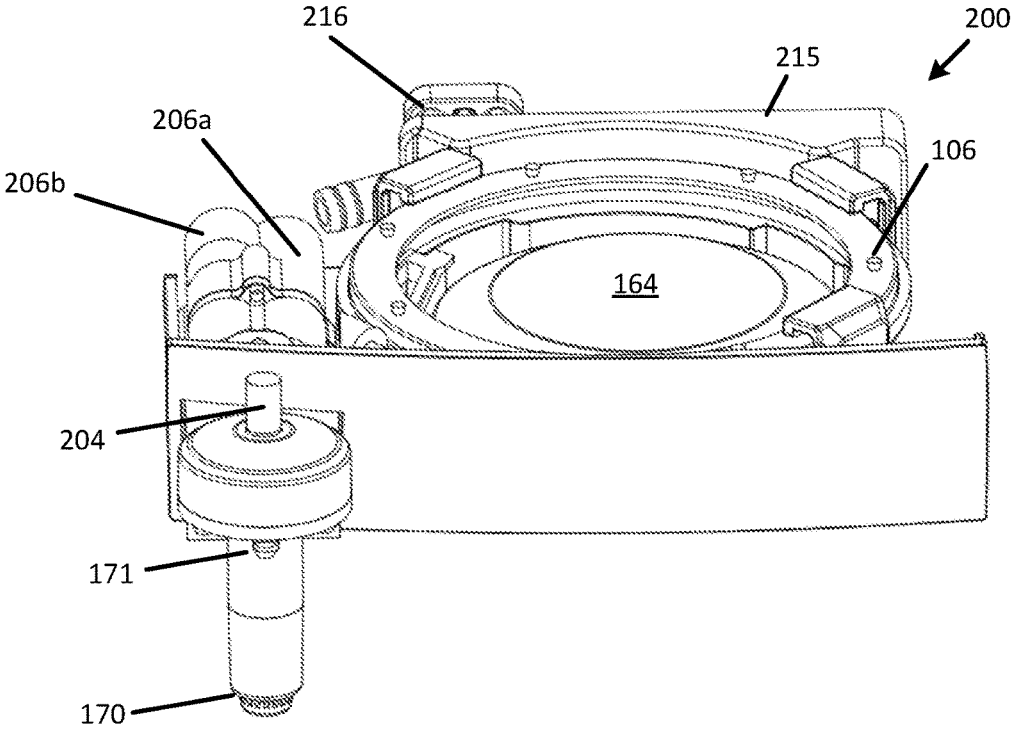
FIG. 17 illustrates a front perspective view of part of a cleaning assembly, in accordance with an embodiment of the present disclosure.
Figure 18:
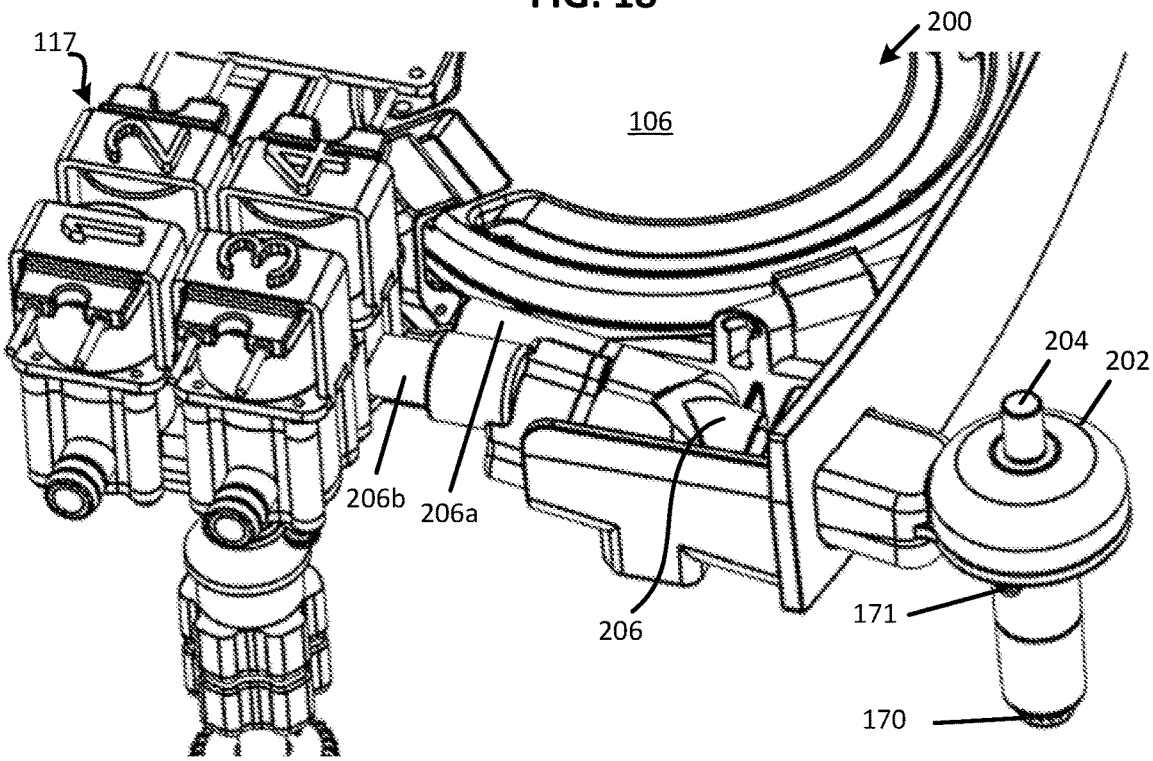
FIG. 18 illustrates a top perspective view showing portions of a cleaning assembly and inlets from a valve assembly and cleaning cassette, in accordance with an embodiment of the present disclosure.
Figure 19:
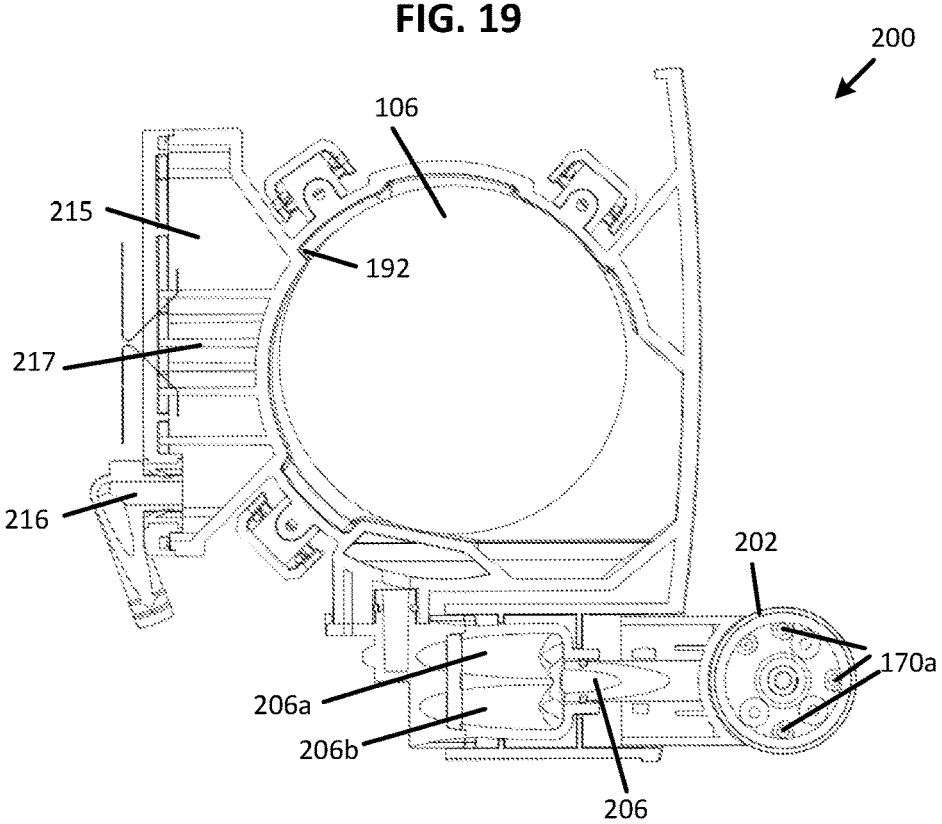
FIG. 19 illustrates a top section view of a cleaning assembly, where the section is taken along a horizontal plane through the cleaning assembly, in accordance with an embodiment of the present disclosure.

Referring now to FIGS. 13-19, a cleaning assembly 200 that includes a cleaning cassette 106 with a maze 215 is shown, in accordance with an embodiment of the present disclosure. FIG. 13 illustrates a top, side, and rear perspective view of the cleaning assembly 200, where the cleaning assembly is partially cut away to reveal details of the inside, in accordance with one embodiment. FIG. 14 illustrates front and opposite side perspective view of the cleaning assembly 200 shown partially cut away. FIG. 15 illustrates a rear sectional view of the cleaning assembly 200 as taken along line A-A of FIG. 13. FIG. 18 illustrates a top and side perspective view showing the valve assembly 117, plunger valve 202, and part of the cleaning cassette 106. FIG. 19 is a top view of the cleaning assembly 200 shown as cross section taken along a horizontal plane through the cleaning cassette 106.

In this embodiment, pressurized water from third valve 118*c* enters the maze 215 at a maze inlet 216, then proceeds through the maze 215 in a serpentine pathway that includes going over and under baffles 217 arranged in an alternating pattern. After water passing through the maze 215, the liquid enters the cleaning cassette 106 where it flows around the outside of a cleaning product 164 (e.g., a solid bleach tablet) contained in the cleaning cassette 106, then to an inlet 206 of the plunger valve 202. In some embodiments, the cleaning cassette 106 is sealed and becomes pressurized by the incoming water from the third valve 118*c*. In some embodiments, the maze 215 or the cleaning cassette 106 can also receive water from the mains water supply 60.

In some embodiments, each compartment between adjacent baffles 217 introduces a small amount of the cleaning product 164 to the clean water such that upon entering the cassette 106 the water has a desired concentration of cleaning product 164. After leaving the maze 215, water passes into the cleaning cassette 106 via cassette inlet 192, where a portion of the cleaning product 164 is dissolved into the water. Diluted cleaning solution leaves the cleaning cassette 106 and flows to the inlet 206 of a plunger valve 202. When the plunger 204 of the plunger valve 202 is in the up position, such as when the lid 104 is open, the cleaning solution from the cleaning cassette 106 drains to the toilet 50 via the nozzle 170. When the plunger 204 is in the down position, such as when the lid 104 is closed, cleaning solution is dispensed to the toilet bowl 54 through the nozzle 170 and/or upper spray nozzle 171. Diluted cleaner can be misted or sprayed onto the toilet seat 102 using the upper spray nozzle 171.

In some embodiments, the plunger valve 202 is biased to an open or up position by a spring or other biasing force. The plunger valve 202 has a plunger 204 that can be raised or lowered to change the valve opening. For example, the plunger 204 extends up from a top of the valve body and can be depressed by contact with the lid 104 as it closes. The plunger valve 202 in this example is biased to the up position by a spring. In other embodiments, the plunger valve 202 can be replaced with a valve of equivalent operation and that uses another mode of actuation, such as a solenoid valve, a flexible dome top, a diaphragm, a plunger valve actuated by electromagnetic control, or other suitable valve and actuation method.

In the example of FIGS. 13-19, the inlet 206 of the plunger valve 202 is configured to include a first inlet portion 206*a* and a second inlet portion 206*b*. The first inlet portion 206*a* receives fluid from the cleaning cassette 106 and the second inlet portion 206*b* receives water from the fourth valve 118*d*. One or both sources can deliver water or solution to the plunger valve 202. Additional inlet portions and sources can be added, such as a line from the mains water supply 60. In some embodiments, the first inlet portion 206*a* is isolated from the second inlet portion 206*b*. In other embodiments, the first inlet portion 206*a* and the second inlet portion 206*b* are constructed to merge fluid streams or otherwise result in a single fluid stream entering the plunger valve 202 that can be directed to the nozzle 170, upper spray nozzle 171, or both.

In one embodiment, the upper spray nozzle 171 and nozzle 170 are positioned below the toilet seat 102 adjacent the hinge assembly 110. The nozzle 170 and upper spray nozzle 171 can be any type of nozzle, such as a nozzle delivering a fan spray, a nozzle with a conical spray, a misting nozzle, an adjustable spray nozzle, a piezo valve or atomizer that directs a fine mist onto the bottom of the lid 104, shroud 101, exposed portions of the seat 102, and exposed portions of the bowl 54. In this example, nozzle 170 has a plurality of spray openings 170*a* and is positioned below the toilet seat 102 to spray cleaning liquid onto various portions of the toilet bowl 54. For example, the nozzle 170 has spray openings 170*a* that direct a jet or stream of cleaning liquid forward and rearward into the bowl 54. The nozzle 170 can also function as a drain to the bowl 54 for the hydraulic cylinder 114 when the lid 104 is open.

In some embodiments in which the cleaning cassette 106 contains a solid cleaning product 164, the cleaning product 164 may be partially submerged in water after use of the toilet and it partially dissolves in the water in the cassette 106. The cleaning solution is subsequently dispensed to the toilet bowl 54 as part of the cleaning cycle, either directly or indirectly. In some embodiments, the inlet 206 includes an eductor in communication with the cleaning cassette 106. As water passes through the second inlet portion 206*b*, a restriction in the eductor increases the flow velocity and decreases the pressure, drawing liquid into the inlet 206 from the cleaning cassette 106. In one such embodiment, the second inlet portion 206*b* includes the eductor along a flow path from the mains water supply 60 and the fourth valve 118*d*. The eductor can be used to rapidly draw cleaning product 164 from the cleaning cassette 106 and spray into the bowl 54, such as for a deep cleaning cycle.

In other embodiments, the cleaning cassette 106 is filled with water between cleaning cycles, during raising the lid 104, or after the lid 104 is raised, such as when a solid cleaning product 164 (e.g., bleach tablet) is contained in the cassette 106. For example, raising the lid 104 opens a valve to fill the cassette 106 with water; closing the lid 104 transfers the cleaning solution from the cassette 106 into the toilet bowl. In another embodiment, the processor 105 actuates a solenoid valve to fill the cleaning cassette 106 after the lid 104 is opened. Similarly, cleaning solution can be dispensed from the cleaning cassette 106 during or after the lid 104 and/or seat 102 close, or while the lid 104 is open. In other embodiments, the cleaning cassette 106 utilizes one-way valves in conjunction with one or more plunger valves 202. These and other embodiments can be used alone or in conjunction with valves 118 that control water flow. Numerous variations and embodiments will be apparent in light of the present disclosure.

In some embodiments, valves 118 of the cleaning assembly 200 can include mechanical valves operated by opening and closing the lid 104 and/or the seat 102. For example, manually opening the lid opens a valve to flood the cleaning cassette 106 with water, where the cleaning cassette 106 contains a solid cleaner, such as a bleach tablet. When the lid 104 is manually closed, a valve on the cleaning cassette 106 is opened and sprays cleaner and water into the toilet bowl. In another embodiment, such as where the system uses a liquid cleaning product 164 in the cleaning cassette 106, a valve 118 opens when the lid is closed. The flow of water through a Venturi connector can be used to draw the liquid cleaning product 164 from the cleaning cassette 106 an into the water stream that is sprayed into the bowl 54. In yet another embodiment, closing the lid 104 actuates an eductor or pump to dispense cleaning product 164 from the cleaning cassette 106 directly to the toilet bowl 54, such as when the cleaning cassette 106 contains liquid cleaning product 164.

Note that the cleaning cassette 106 is described and shown as being plumbed downstream of the hydraulic cylinder 114. In other embodiments, the cleaning cassette 106 can be upstream of the hydraulic cylinder. Also, other suitable techniques can be used to draw or extract the cleaning product 164 from the cleaning cassette 106, such as a jet pump, a Venturi eductor, a solenoid pump, a motorized pump, a diaphragm pump, a peristaltic pump, a piezo-electric pump, an impeller, a displacement pump or syringe pump, or other suitable technique. In yet other embodiments, the cleaning cassette 106 is pressurized to expel liquid cleaning product 164. For example, a quantity of liquid cleaning product 164 is expelled from the cleaning cassette 106 by action of a diaphragm, pressurized air, or push from the hydraulic cylinder 114.

In other embodiments, the cleaning assembly 200 includes two or more plunger valves 202 that include a first plunger valve 202 and a second plunger valve 202. For example, the first plunger valve 202 is placed in the plumbing sequence to receive water directly from the mains water supply 60, from the hydraulic cylinder 114, or both. The first plunger valve 202 can be configured as a three-way valve with an outlet and a bypass. When the plunger 204 is in the up or open position, water or other liquid entering the inlet of the first plunger valve 202 can flow to the outlet on the bottom of the valve body and then pass to the cleaning cassette 106. When the plunger 204 is in the down or closed position, water or other liquid entering the inlet flows to the bypass exit on the side of the valve body. The pressure associated with water entering the second plunger valve 202 depresses the plunger 204 and sprays a mixture of water and cleaning product through the nozzle 170.

The second plunger valve 202 operates as a displacement pump between an up position and a down position. For example, the second plunger valve 202 moves to the down position due to hydraulic pressure applied by water or other liquid entering inlet and dispenses liquid into the toilet bowl 54. The inlet of the second plunger valve 202 receives water flow from the bypass of the first plunger valve 202. Water entering the second plunger valve 202 provides hydraulic pressure that pushes down the plunger 204 to draw and expel a quantity of liquid from the cleaning cassette 106. In the absence of such pressure, the second plunger valve 202 normally occupies the up position.

Optionally, a third plunger valve 202 is positioned with an inlet to receive water overflowing from the cleaning cassette 106, which is filled from the first plunger valve 202. The third plunger valve 202 is configured as an on-off valve, in accordance with one embodiment. In the up or open position, liquid flow is open into the third plunger valve 202 from the cleaning cassette 106 and to the toilet 50 via the outlet. For example, liquid entering the third plunger valve 202 flows to the outlet 208 at the bottom of the valve and drains into the toilet bowl 54. In the down or closed position, the third plunger valve 202 closes flow of water between the cleaning cassette 106 and the valve.

When the lid 104 is open, the first, second, and third plunger valves 202 are normally in the up or open position. Accordingly, water enters the first plunger valve 202 and is directed into the cleaning cassette 106. Overflow from the cleaning cassette 106 flows through the third plunger valve 202 to drain into the toilet bowl 54. The act of raising the lid 104 raises the plunger 204 of the first plunger valve 202, closing flow to the second plunger valve 202 and allowing spring force to raise the plunger 204 to the up position. Raising the plunger 204 of the second plunger valve 202 draws in cleaning solution from the cleaning cassette 106, which is stored in the second plunger valve 202 until the plunger 204 is lowered, in accordance with some embodiments.

When the lid 104 is closed, the plunger 204 on both the first plunger valve 202 and third plunger valve 202 are moved to the down/closed position by contact with the lid 104 as it closes. Accordingly, water entering the first plunger valve 202 is diverted to exit through the bypass exit, enters the second plunger valve 202, and depresses the plunger 204 of the third plunger valve 202. Depressing the plunger 204 in the second plunger valve 202 functions as a displacement pump to expel liquid contained in the valve and/or to draw liquid from the cleaning cassette 106 and expel it through the nozzle 170.

An upper spray nozzle 171 (e.g., a nozzle with a conical or fan spray, an ultrasonic sprayer, a piezo sprayer, an air-assisted sprayer, or an atomizer) can be placed in fluid communication with the reservoir of the second plunger valve 202, in accordance with one embodiment. For example, when actuated, the upper spray nozzle 171 uses a portion of the cleaning solution contained the second plunger valve 202 and dispenses it as a fine mist, spray, or stream of cleaning solution. In another example, the upper spray nozzle 171 is plumbed directly to the cleaning cassette 106 so that when actuated, the upper spray nozzle 171 draws liquid from the cleaning cassette 106 and dispenses it as a fine mist. In some embodiments, the upper spray nozzle 171 can be operated electronically by the processor 105 and its operation can be triggered by movement of the hydraulic cylinder 114, a signal received from a position sensor 153, a signal received from a sensor 180, a signal received from user action (e.g., pressing a button on the user interface), or other input.

Figure 20:
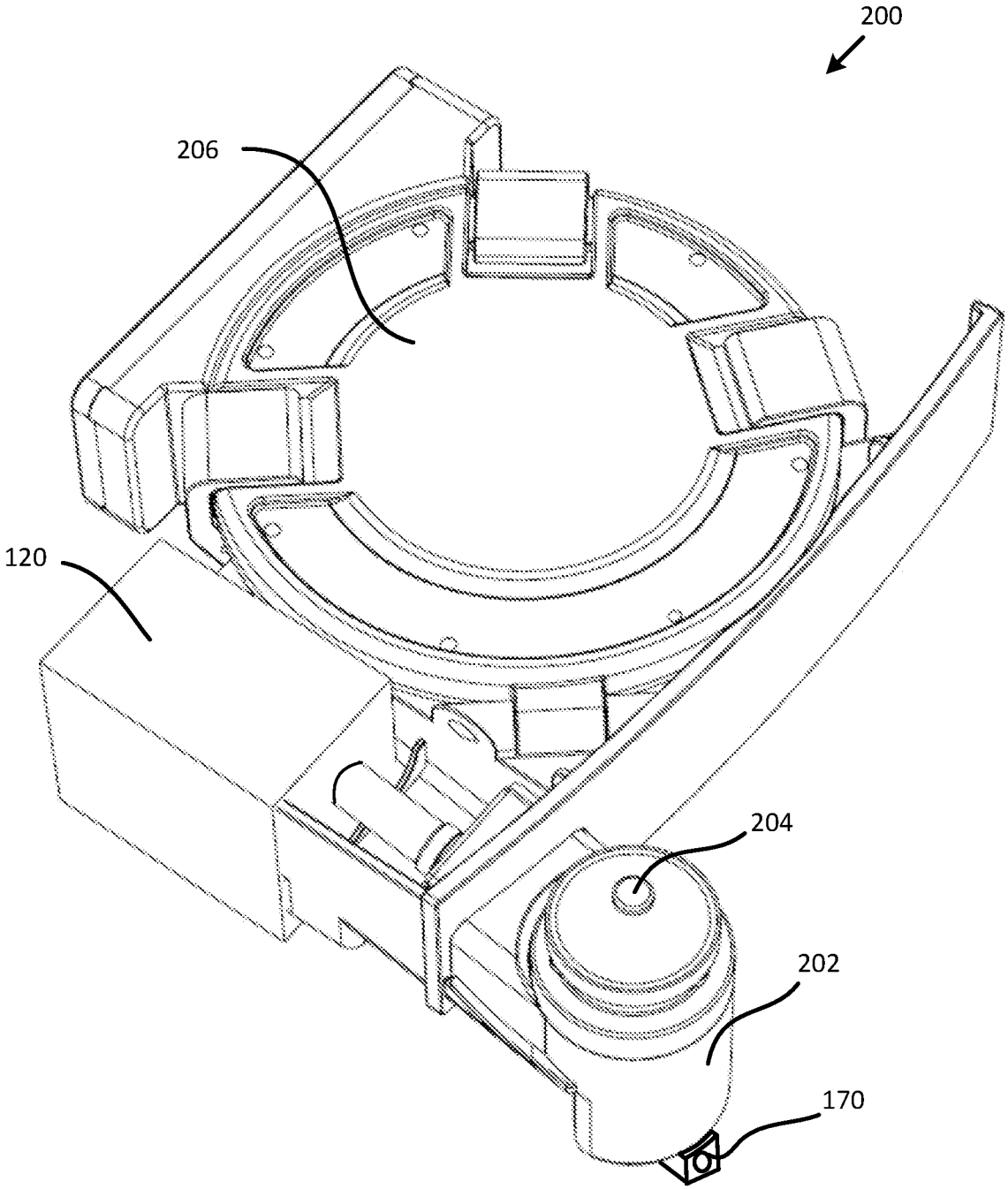
FIG. 20 illustrates a top perspective view of a cleaning assembly, in accordance with another embodiment of the present disclosure.

Referring now to FIG. 20, a top perspective view illustrates a cleaning assembly 200, in accordance with another embodiment of the present disclosure. In this example, the cleaning assembly 200 includes a cleaning cassette 106 configured to contain a cleaning product 164 (e.g., liquid, not visible) and to dispense a quantity of cleaning product 164 to the toilet bowl 54. As noted above, the pump 120 can be a jet pump, a solenoid pump, a motorized pump, a diaphragm pump, a peristaltic pump, a piezo-electric pump, an impeller, a displacement pump, a syringe pump, or other suitable pump 120.

In one example, closing the lid 104 depresses a plunger 204 on a plunger valve 202 and in turn draws and a quantity of the cleaning product 164 from the cassette 106 and dispenses it into the toilet bowl 54. In another example, the cleaning assembly 202 includes an electrically-activated pump 120 between the cleaning cassette 106 and a nozzle 170. The processor 105 operates the pump 120 while the lid 104 is open, while the lid 104 closes, after the lid 104 closes, or a combination of these conditions. In one such embodiment, the toilet seat assembly 100 includes a sensor or switch 152 (not visible) that communicates the position of the lid 104 to the processor. For example, the switch 152 is part of the plunger 204. After toilet use and after the lid 104 closes, the processor 105 operates the pump 120 to dispense cleaning solution 164 into the toilet bowl 54.

In yet another example, the toilet seat assembly 100 is not connected to the mains water supply 60 and no other water flow occurs through the toilet seat assembly 100. For example, the pump 120 dispenses cleaning product 164 into the toilet bowl 54 after the toilet 50 is flushed. In other embodiments, the toilet seat assembly 100 includes a valve assembly 117 configured to control a flow of water between the mains water supply 60 and the toilet bowl 54. The processor may concurrently operate the valve assembly 117 to flow water from the mains water supply 60 to the toilet bowl 54. Numerous variations and embodiments will be apparent in light of the present disclosure.

Figure 21:
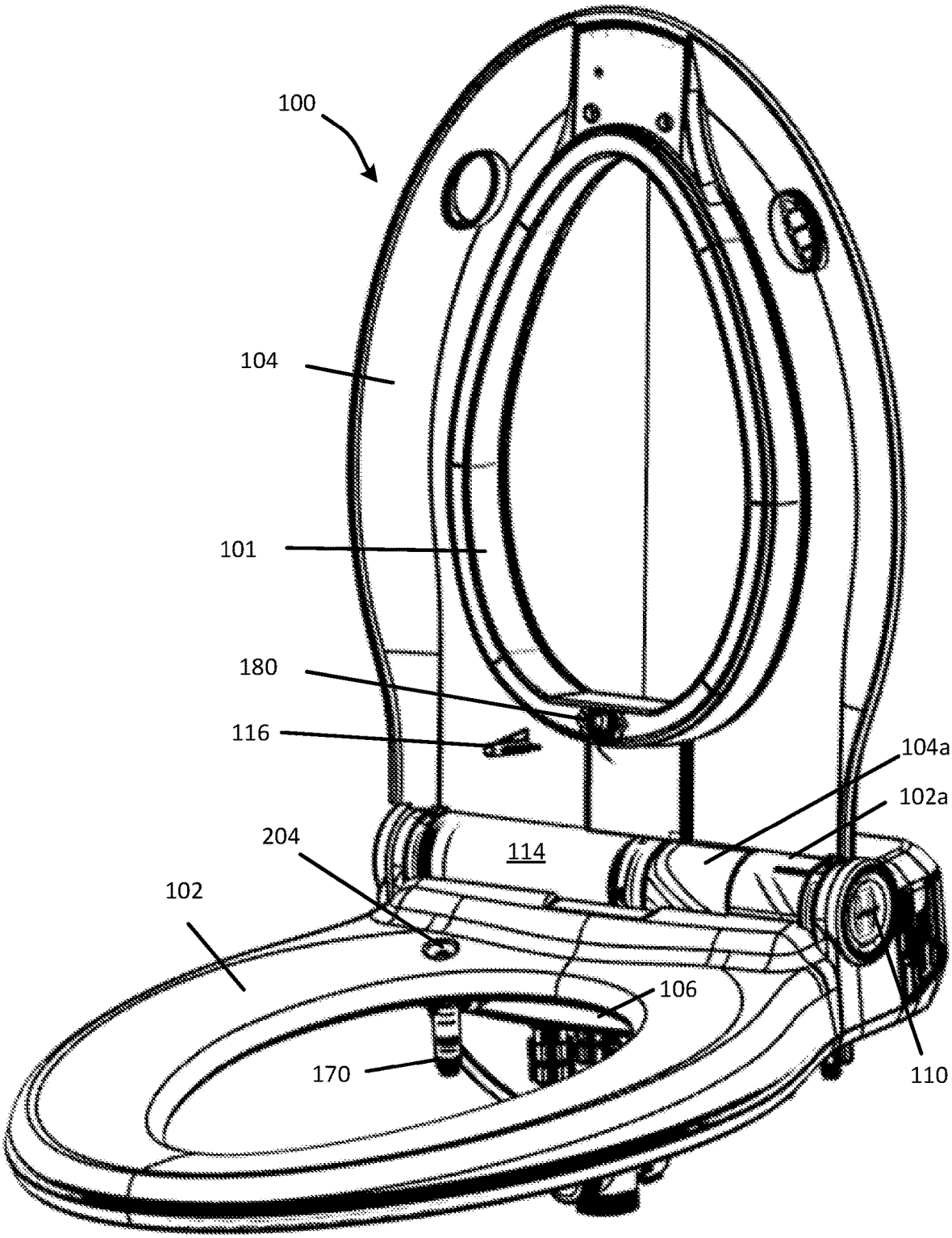
FIG. 21 illustrates a front perspective view of a toilet seat assembly with the lid in an open position, in accordance with an embodiment of the present disclosure.

Referring now to FIG. 21, a front perspective view illustrates a toilet seat assembly 100 with the lid 104 shown in an open position, in accordance with an embodiment of the present disclosure. Since the seat 102 and lid 104 are primarily or exclusively raised and lowered by the hydraulic cylinder 114, the seat 102 and lid 104 need not be made to include gaps between them or rounded edges that facilitate finger purchase for manual lifting. Accordingly, the seat 102 and lid 104 can be made with close-fitting and relatively sharp edges that enable forming an optional seal 179 (shown in FIG. 27) between the lid 104 and seat 102 and/or between the seat 102 and the toilet bowl 54. In some embodiments, the seal 179 extends around only a portion of the seat 102 to enable the toilet seat assembly 100 to "breathe" when the toilet 50 is flushed. Embodiments that include a seal 179 or partial seal can effectively trap microscopic particles and odors inside the toilet 50 and therefore result in a more pleasant and healthier environment. In one such embodiment, a gasket 187 (shown in FIG. 27) or sealing ring disposed in the interface between the seat 102 and bowl 54 provides a seal 179 when the seat 102 is in the down or closed position. The lid 104 may similarly form a seal 179 with the seat 102 when the lid 104 is closed on the seat 102. In another embodiment, each seal 179 can be formed by a flexible portion on an edge of the seat 102 and/or lid 104. For example, an edge of the lid 104 is made more flexible than the lid 104 as a whole, or includes a flexible edge, for example. In some such embodiments, the flexible edge deforms when the lid 104 is drawn against the seat 102 when both are in either the up or down positions. The seat 102 can be similarly configured. A variety of spray patterns, rotating valve on the dispenser (e.g., tubing 128*c* with nozzle 162) can be included to increase the regions within the bowl 54 and seat 102/lid 104 that are sanitized. For example, liquid or aerosol spray can be directed to exposed surfaces of the lid 104, seat 102, and bowl 54. Optionally, the lid 104 and seat 102 are made of a hydrophobic material or include a hydrophobic coating to facilitate water-based cleaning solutions leaving the surface of these components to provide a dry surface for subsequent use. Seals between various components can be of a polymeric material including elastomers, silicone, polytetrafluoroethylene (PTFE), or natural rubber.

In some embodiments, the cleaning assembly 200 includes a diverting nozzle (not shown) that includes a nozzle portion and a diverter portion. For example, the nozzle portion can pivot with respect to the diverter portion. Pins on the nozzle portion restrict the range of pivoting movement of the nozzle portion. As water flows through the diverting nozzle, the nozzle portion and diverter portion toggle back and forth between pins on the cleaning cassette 106 so that cleaning solution is sprayed throughout a range of motion across the toilet bowl 54.

Figure 22A:
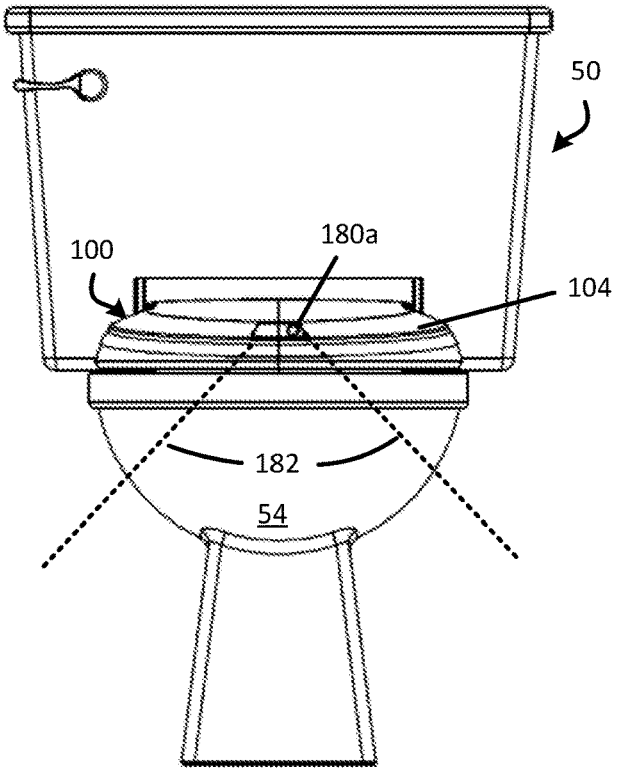
FIGS. 22A and 22B illustrate front views of a toilet equipped with a toilet seat assembly and show example sensing regions of sensors, in accordance with an embodiment of the present disclosure.
Figure 22B:
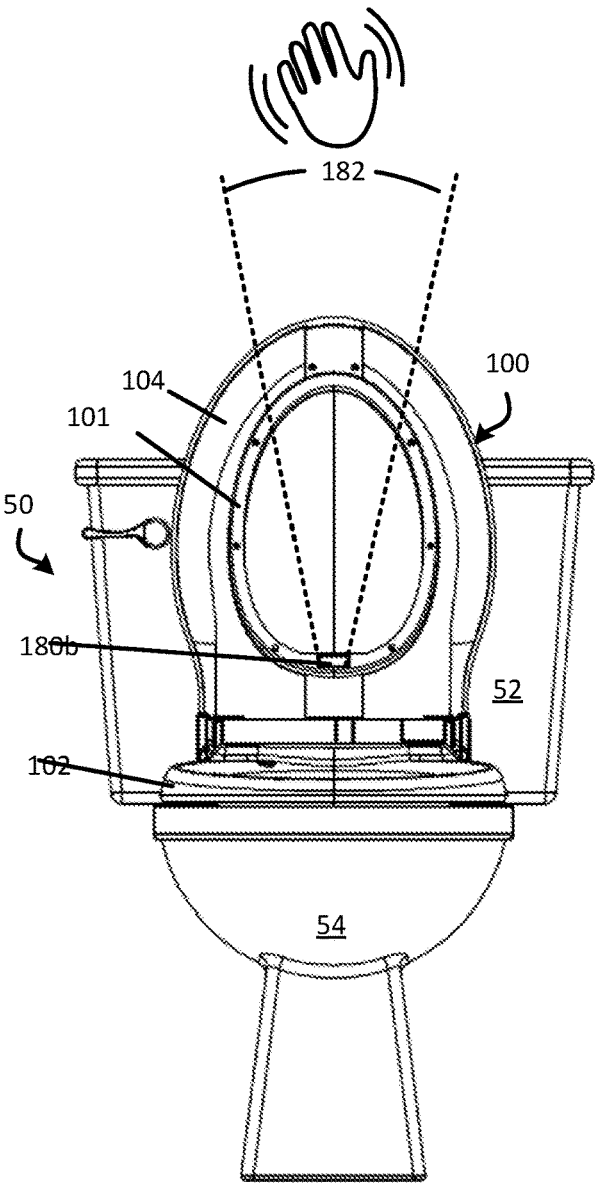

Referring now to FIGS. 22A and 22B, front views illustrate an example of toilet 50 equipped with a toilet seat assembly 100 that includes one or more sensors 180 used to trigger various functions, in accordance with some embodiments of the present disclosure. The toilet seat assembly 100 includes three conditions or positions: in a first condition both the seat 102 and lid 104 down, in a second condition the seat 102 is down and the lid 104 up, and in a third condition both the seat 102 and lid 104 up. The processor 105 can be configured to await input from a sensor 180 (or other signal) when the toilet seat assembly 100 is any of these conditions. In one example, a lack of a sensed condition can be used to trigger an action, such as inactivity or failure to sense a change in a sensed condition for a predetermined length of time. Depending on the desired functionality, numerous variations and embodiments of control can be used, as will be appreciated.

In addition to electronic control using sensors 180 and processor 105, the toilet assembly 100 optionally includes mechanical switches and actuators. As shown in FIG. 21, for example, the lid 104 includes an actuator 116 that protrudes from the bottom of the lid 104. As the lid 104 closes, the actuator 116 extends through an opening in the seat 102 to depress the plunger 204 of the plunger valve 202 (e.g., shown in FIG. 17). In another example, sensors in the hydraulic cylinder 114 may be replaced with a mechanical switch. Numerous variations and embodiments will be apparent in light of the present disclosure.

Each sensor 180 can be configured to detect generalized or specific motion, proximity, thermal signature, sound, or other input. For example, a sensor 180 can detect specific verbal commands (e.g., "open lid" or "close and flush"), body temperature or temperature differentials within a predetermined range of sensor 180 (e.g., within 30 cm, 45 cm, or 60 cm), sounds having a particular frequency, waveform, duration, or spacing (e.g., hand claps or finger snaps), or specific movements or sequences of movements (e.g., hand wave, Z-shape). A given sensor 180 can use infrared or passive infrared sensing techniques, for example. Each sensor 180 is disposed in wired or wireless communication with the processor 105 and a stored energy source 108 (e.g., batteries) or continuous power source (e.g., AC line voltage or solar cell). In some embodiments, the stored energy source 108 can be a capacitor or battery that is charged by, for example, movement of the lid and/or seat or action of the piston 140 (typically during closing). The power source can be used to supply power to the infrared sensor, the solenoid and any other components that require electric power. Note that components such as the sensor 180 can be in an energy saving mode where they are off most of the time and only turned on for a few milliseconds each second.

In some embodiments, a sensor 180 can be positioned in or on the lid 104, seat 102, or hinge assembly 110, or contained within the lid 104 or housing 112 and not visible to the user. In one example, a sensor 180 is positioned on the bottom of the lid 104 or shroud 101. In another example, the sensor 180 is contained in the hinge assembly 110. In another example, a sensor 180 is positioned on the front end of the toilet seat 102 distant from the hinge assembly 110.

In the embodiment of FIGS. 22A-22B, the toilet seat assembly 100 includes two sensors 180. A first sensor 180*a* is located on a front portion of the lid 104 and a second sensor 180*b* is located on an underside or bottom face of the lid 104. For example, the second sensor 180*b* is on a bottom face of the shroud 101. The first sensor 180*a* can be configured to detect general or specific movement in front of the toilet 50 (when the lid 104 is down), to detect general or specific movement vertically above the lid 104 (when the lid 104 is open), or a combination of such regions. Sensor detection is not limited to movement and may include temperature, color, light/dark, distance, a sound or voice command, a change in any of these conditions, or any other suitable sensed condition or combination of sensed conditions to indicate the presence of a user who wishes to use the toilet 50, has completed using the toilet 50, or has left the area of toilet 50. For example, the first sensor 180*a* is an infrared (IR) motion sensor or passive infrared (PIR) sensor configured to detect motion or other action based on a change in infrared radiation. When the lid 104 is closed, for example, first sensor 180*a* may detect the presence of a user within a predetermined range of the toilet 50, such as within 3 feet (~1 meter), within 2 feet (~60 cm), within 18 inches (~45 cm), within 12 inches (~30 cm), or other distance. In another example, the first sensor 180*a* senses a particular motion or group of particular motions, such as a hand wave, movements in opposite directions across the sensor 180*a* within a short time (e.g., within 1.5 sec.). A particular movement or sequence of movements may trigger, for example, raising the lid 104 or both the seat 102 and lid 104.

The second sensor 180*b*, located on the bottom face of the lid 104 in one example, can be configured to sense movement in a direction perpendicular to the lid 104 (e.g., in front of toilet 50 when the lid 104 is open), vertically above the toilet 50, or combination of such regions. For example, the second sensor 180*b* is configured to detect the presence or absence of a person, or an additional signal to trigger opening the seat 102 or flushing the toilet 50. In one example, second sensor 180*b* detects movement or proximity of an object within a two-dimensional or three-dimensional sensing region 182. The proximity of a user can be used by the processor 105 to indicate a person sitting on the toilet or standing next to the toilet. Within certain distances, for example, second sensor 180*b* detects the user seated on the toilet and, as a result, may disable first sensor 180*a*. In one embodiment with the lid 104 open, the sensing region 182 can be a cone or angle with its vertex located at the second sensor 180*b* and extending out from the lid 104 over the bowl 54. Other geometries for the sensing region 182 are acceptable.

Input from sensor(s) 180 (or lack thereof) may be used alone or in combination with the positions of the seat 102 and lid 104 to trigger an action. In one example where the lid 104 is open and the seat 102 is down, sensor(s) 180 may be triggered by one sensed condition to initiate closing the lid 104 and triggered by another sensed condition to raise the seat 102. When both the seat 102 and lid 104 are open, the sensor(s) 180 may detect one or more sensed conditions to trigger closing the seat 102 and lid 104, followed by initiating a cleaning cycle. In this condition, a first sensed condition (e.g., a short hand wave) may trigger lowering the seat 102 and a second sensed condition (e.g., a long hand wave) may trigger closing the seat 102 and lid 104 in addition to initiating a cleaning cycle.

In another example, a first sensor 180*a* is located on the housing 112 between the lid 104 and the tank 52. The first sensor 180*a* can be particularly useful when both the seat 102 and lid 104 are closed. Second sensor 180*b* and third sensor 180*c* may be located on the underside of the lid 104. In another embodiment, second sensor 180*b* is located on the front edge of the lid 104 and the third sensor 180*c* is located on the underside of the lid 104. Sensors 180 can be used to detect various motions or other inputs, or a lack of input, to open or close the lid 104 and/or seat 102. In one example, a hand wave detected by the first sensor 180*a* opens the lid 104. A hand wave detected by second sensor 180*b* located on the lid 104 and having a sensing region 182 above the lid 104 can be used to open the seat 102. A third sensor 180*c* located on the lid 104 and having a sensing region 182 in front of the tank 52 can be used to detect a user leaving the toilet 50 and then to initiate closing the seat 102 and lid 104 followed by a flush. Numerous variations and embodiments will be apparent in light of the present disclosure.

Figure 23:
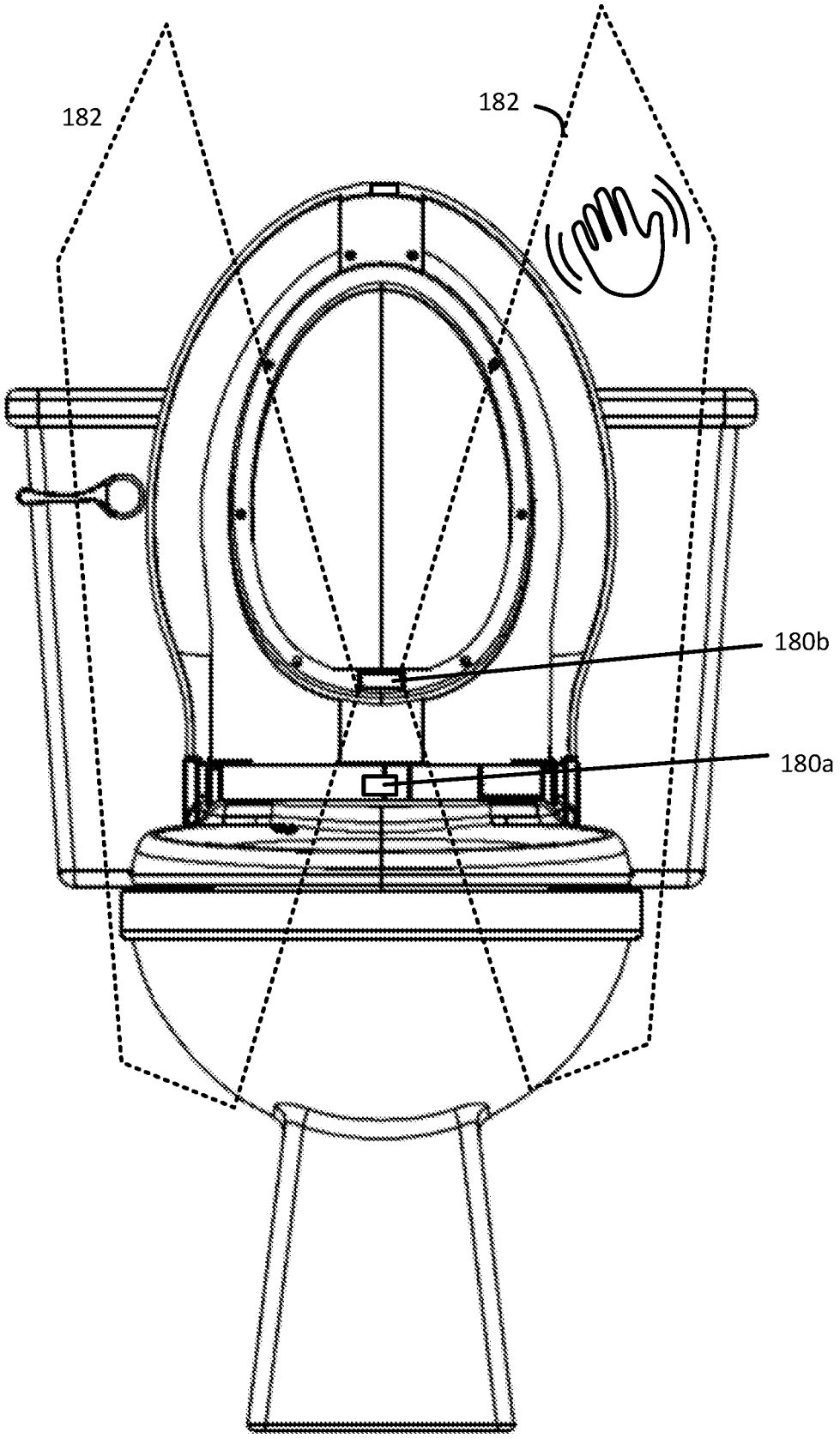
FIG. 23 illustrates a front view of a toilet equipped with a toilet seat assembly and shows example sensing regions of a sensor, in accordance with an embodiment of the present disclosure.

FIG. 23 illustrates a front view a toilet 50 equipped with a toilet seat assembly 100 in accordance with an embodiment of the present disclosure. In this example, the toilet seat assembly 100 includes sensors 180 with a variety of different sensing regions 182. A first sensor 180*a* positioned on or near the hinge assembly 110 and a second sensor 180*b* is positioned on a bottom face of the lid 104. The first sensor can use room-scale sensing in a low power mode to detect general movement within a sensing region generally having a size of the room. Such input can be used to "wake up" the toilet seat assembly 100 for detecting further input, such as when a potential user enters the bathroom.

Second sensor 180*b* includes one or more specific sensing regions 182 (e.g., on opposite lateral sides of toilet 50) or may sense movement generally using a hemispherical sensing region 182, for example. In one such embodiment, for example, a hand wave detected on a right side raises the seat 102 and lid 104 and a hand wave detected on the left side raises only the lid 104. In another example, second sensor 180*b* detects an input consistent with the user leaving the toilet 50, such as a change in infrared radiation within a range of up to 18 inches (45 cm) from the tank 52 and that occurs within a predefined timeframe (e.g., 30 minutes) subsequent to raising the seat 102. Such input can be used by processor 105 to close the seat 102 and lid 104 and initiate a cleaning cycle.

Figure 24:
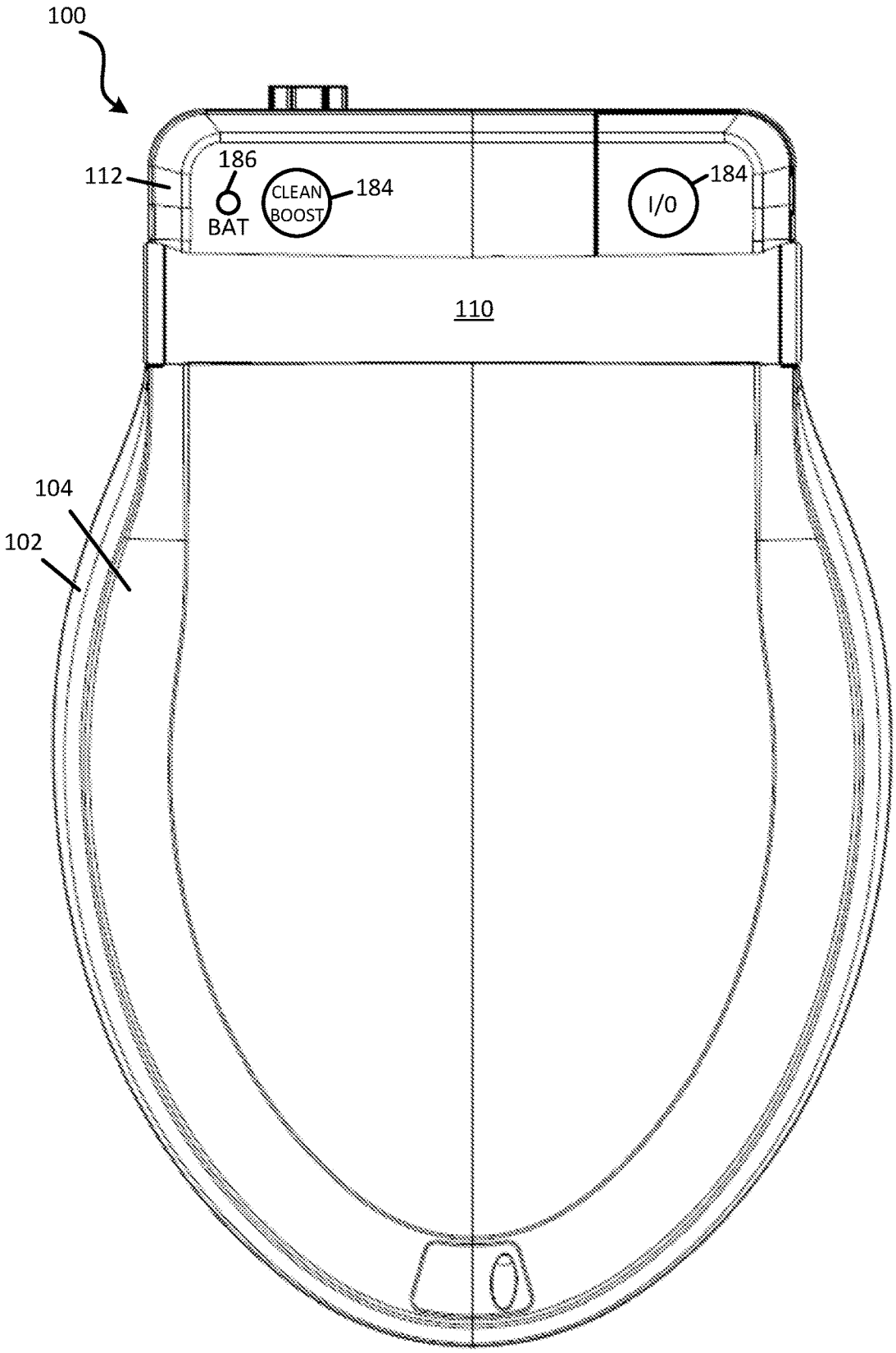
FIG. 24 illustrates a top view of a toilet seat assembly and shows buttons of the user interface, in accordance with an embodiment of the present disclosure.

FIG. 24 illustrates a top view of a toilet seat assembly 100, in accordance with an embodiment of the present disclosure. Here, the housing 112 includes one or more buttons 184 that enable the user to control certain functions of the assembly 100. In one example, a button 184 can be pressed to activate a cleaning cycle, such as an enhanced cleaning mode or boost mode. In one such embodiment, the cleaning boost closes the seat 102 and lid 104 (if not already closed), then proceeds to flush water into the toilet bowl 54 while also drawing cleaning product 164 into the water stream. The cleaning boost may operate for an extended time or use more water compared to a standard cleaning cycle. In another embodiment, the cleaning boost directs cleaning water to the seat 102 and lid 104 in addition to the bowl 54, or other areas as appropriate. The user can press another button 184 to turn the assembly 100 on and off as needed. The assembly 100 optionally includes an indicator 186 to signal to the user that the stored energy source 108 is low, the cleaning cassette 106 is empty, or that some other maintenance is needed. Numerous variations and embodiments will be apparent in light of the present disclosure.

Figure 25:
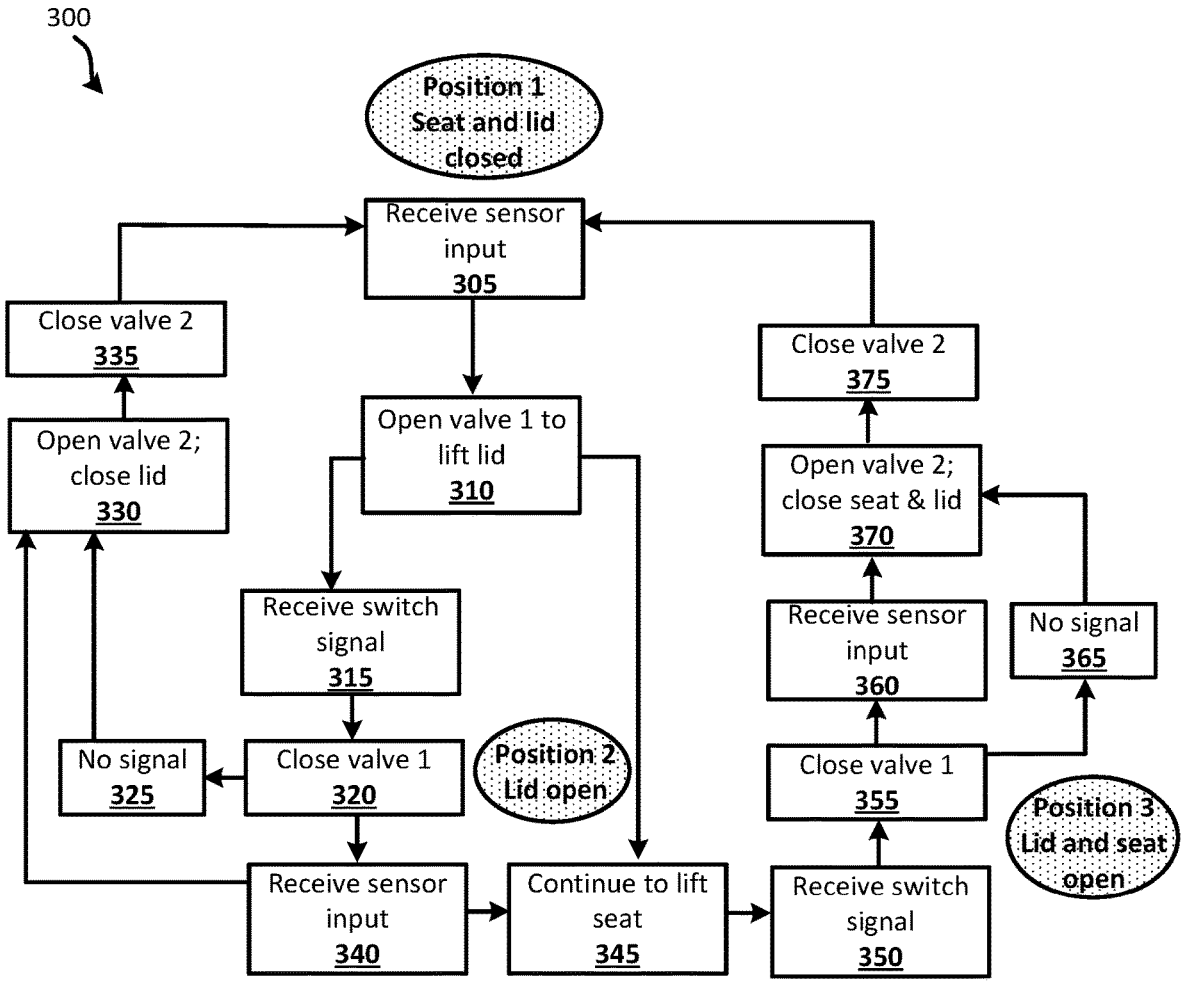
FIG. 25 illustrates a flow diagram showing processes in a method of controlling a toilet seat assembly, in accordance with an embodiment of the present disclosure.

Referring now to FIG. 25, a flow chart illustrates operations performed in a method 300 of operating a toilet seat assembly 100, in accordance with some embodiments. In this example, method 300 begins at Position 1, in which both the seat 102 and lid 104 are in the closed position. Note that operations in method 300 may be performed in a loop such that other positions may be considered the start, such as Position 2 in which only the lid 104 is open, or Position 3 in which both the lid 104 and seat 102 are open. To facilitate discussion, method 300 will be discussed with reference to a toilet seat assembly 100 having a seat 102 and a lid 104 that are both in the down or closed position, and the assembly also including at least one sensor 180. The toilet seat assembly 100 further includes a first valve ("valve 1") and a second valve ("valve 2"). Method 300 is not limited to an assembly having only two valves and additional valves or functional equivalent may be used, as will be appreciated.

Various actions may be triggered by one or more sensors in communication with a processor. For example, raising the lid can be triggered by a signal from a first sensor, raising the seat can be triggered by a signal from a second sensor, and lowering both the seat and lid can be triggered by a signal from a third sensor. More or fewer sensors can be used. In some embodiments, sensor(s) can be used to detect the approach of a user, the departure of a user, or a command or action by the user to raise the toilet seat. In some embodiments, all of these functions can be controlled by a single sensor. Sensors can be, for example, a sound detector, a smart speaker, a capacitive sensor, an infrared sensor, a Hall effect sensor, or other suitable sensor.

At block 305, the toilet seat and lid are down, and the assembly receives input from one or more sensors. In some embodiments, the input is a sensed motion or change in conditions that is processed by the circuit (e.g., a printed circuit board assembly (PCBA)) electrically coupled to the sensors and valves of the assembly. The sensor input at block 305 is processed to open valve 1, which causes the hydraulic cylinder to fill with water and open the lid at block 310. At block 315, a signal from a switch (e.g., a microswitch) is received at the PCB after the cam follower opens the lid, which is processed to close valve 1 and maintain the assembly in Position 2 with the lid open at block 320. From Position 2, the assembly may await additional sensor input or may be configured to operate in the absence of a signal from a switch or from a sensor, for example. If no signal is received after a predetermined length of time, block 325, method proceeds to open valve 2 at block 330. Opening valve 2 allows spring force to evacuate the water from the hydraulic cylinder into the toilet bowl, which may include passing the water through or along a cleaning cassette to draw cleaner into the water for cleaning purposes. In some embodiments, valve 2 may remain open only as needed for the cleaning process using water from the hydraulic cylinder. In other embodiments, valve 2 may remain open for a longer period of time as needed to flush and clean the toilet, for example. At block 335, valve 2 is closed, at which point the toilet is again in Position 1 with the seat and lid closed with the assembly awaiting input to initiate action.

In another scenario, sensor input is received at block 340, which is processed to open the seat. For example, the input at block 305 is a sensor detecting movement within about 3 feet (~1 m) of the toilet, indicating an approaching user. The input at block 305 could be a user approaching the toilet, the user waving or making another hand gesture over the sensor, or an audible command received at the sensor, for example. The input at block 340 is an additional input received by the same or a different sensor. The input at block 340 is processed at block 345 to continue operation of the hydraulic cylinder to lift the seat. Opening the seat may be continuous with opening the lid, or it may be performed after a pause in method 300. The input at block 340 can be, for example, a gesture received at the same or a different sensor, a different action detected compared to that at block 305 (e.g., a second motion, a different motion, a different proximity value, or an audible command), or a continued sensed action (e.g., the user remains within about 3 feet (~1 m) of the toilet).

In another scenario, the input received at block 305 is processed to open valve 1 for a length of time sufficient to open both the lid and the seat. For example, a gesture sensed on the right side of the toilet is processed to open only the lid at blocks 310-320 and a gesture sensed on the left side of the toilet is processed to open both the lid and seat at blocks 310 and 345.

At block 350, the circuit receives a signal to halt operation of the hydraulic cylinder, such as from a microswitch positioned at the end of travel for the piston of the hydraulic cylinder. At block 355, the signal received at block 350 is processed to close valve 1. In such condition, the assembly is in Position 3 with both the lid and seat open. Method 300 may continue from block 355 by either receiving a sensor input at block 360 or not receiving an input within a predefined period of time at block 365.

The input at block 360 can be a sensor or sensors detecting the user departing the toilet, a user gesture, a command or some other action. For example, after using the toilet, the user waves the hand along the left side of the toilet. The sensor sends a signal to the processor to proceed to block 370. Other conditions can be sensed, such as a change in proximity, an audible command, a change in light, or other condition. Alternately, at block 365, no signal is received for a period of time from 10 s to 30 minutes and method 300 proceeds to block 370. Here, "no signal" can be interpreted to mean no change in the input or no input. For example, while the user is sitting on the toilet, the sensor may continue to sense the user's temperature within a given distance from the tank (e.g., within 15 cm, 30 cm, 45 cm, or 60 cm); so long as this condition is sensed, the assembly maintains Position 3. In another example, no input is received from a sensor or switch for a set length of time, such as 10 seconds, 30 seconds, 1 minute, 2 minutes, 3 minutes, 5 minutes, 10 minutes, 20 minutes, or 30 minutes, for example. In such situation, the circuit At block 370, method 300 opens valve 2 for a time sufficient to close the seat or both the seat and lid. Opening valve 2 allows spring force to evacuate the water from the hydraulic cylinder into the toilet bowl, which may include passing the water through or along a cleaning cassette to draw cleaner into the water for cleaning purposes. In some embodiments, valve 2 may remain open only as needed for the cleaning process using water from the hydraulic cylinder. In other embodiments, valve 2 may remain open for a longer period of time as needed to flush and clean the toilet, after both the seat and lid are closed, for example. At block 375, valve 2 is closed, at which point the toilet is again in Position 1 with the seat and lid closed with the assembly awaiting input to initiate action.

Figure 26A:
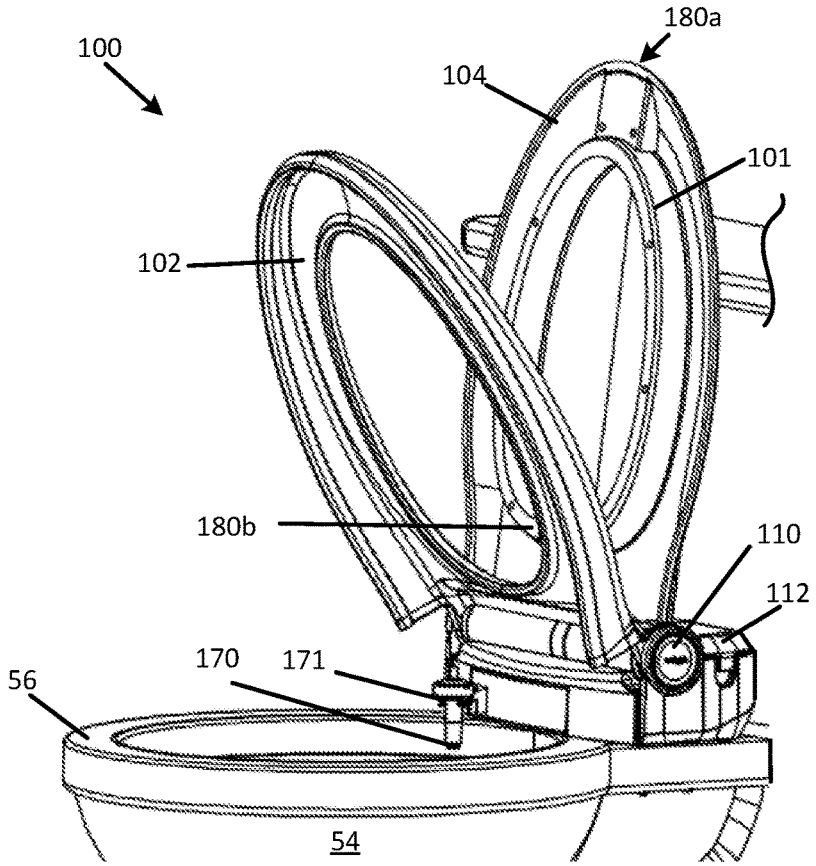
FIG. 26A illustrates a front perspective view of a toilet seat assembly including a lid, toilet seat, and a shroud, in accordance with another embodiment of the present disclosure.
Figure 26B:
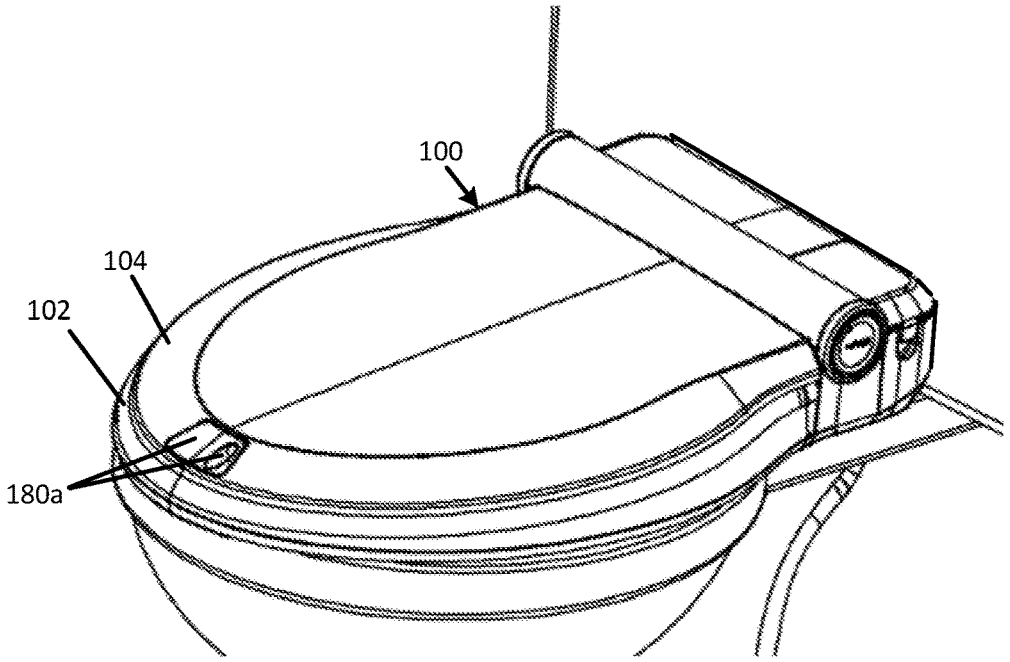
FIG. 26B illustrates a front perspective view of the toilet seat assembly of FIG. 26A showing the lid and seat in a closed position, in accordance with an embodiment of the present disclosure.
Figure 26C:
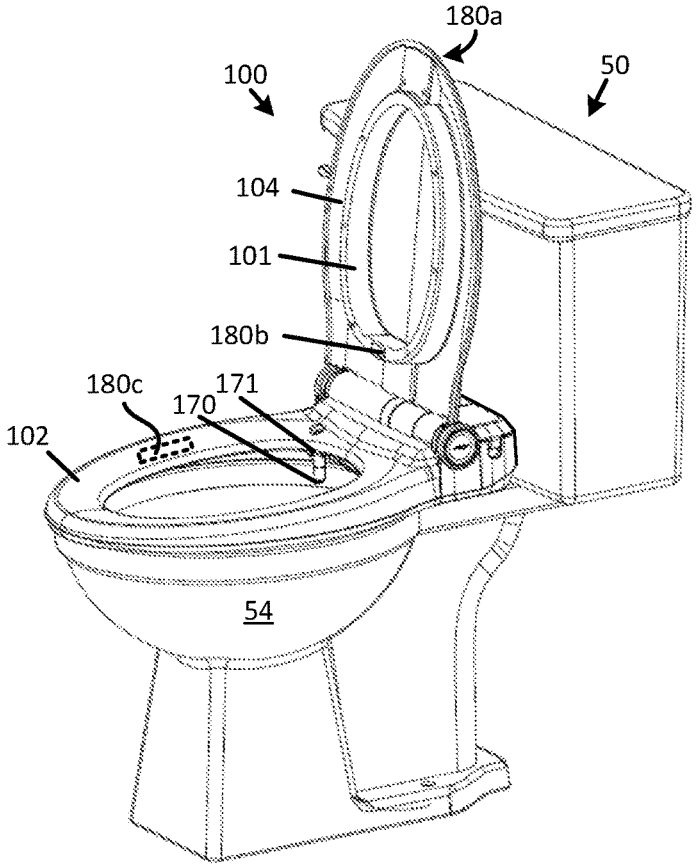
FIG. 26C illustrates the toilet seat assembly of FIG. 26A installed on a toilet with the lid in an open position, in accordance with an embodiment of the present disclosure.

Referring now to FIGS. 26A-26C, front perspective views show a toilet 50 with toilet seat assembly 100 that includes a lid 104, toilet seat 102, and a shroud 101, in accordance with an embodiment of the present disclosure. In FIG. 26A, the lid 104 is open and the seat 102 is partially open. In FIG. 26B, the lid 104 and seat 102 are shown in a closed position. In FIG. 26C, the lid 104 is shown in an open position and the seat 102 is shown in a closed or down position. When the lid 104 is closed, the seat 102 covers the rim 56 of the toilet bowl 54 and the shroud 101 extends down from the lid 104 to prevent the seat 102 from getting wet and/or to obstruct a direct exit path of liquids from the upper spray nozzle 171 or nozzle 170.

In this example embodiment, the toilet seat assembly 100 includes one or more sensors 180 to trigger operation of the toilet seat assembly 100, including at least one first sensor 180*a* on the lid 104. For example, the first sensor 180*a* includes a pair of forward-facing IR sensors that individually or together are configured to detect the presence of a person on the toilet 50 when the lid 104 is closed. For example, sensors 180*a* have a field that is about 3-4 inches (~7-10 cm) wide and extends about 8 inches (~20 cm) from the front of the lid 104. In another example, the first sensor 180*a* includes a passive infrared sensor configured to detect a person entering the room. In response to a signal from the first sensor 180*a*, the processor 105 activates one or more infrared sensors 180 on the front of the toilet seat assembly 100. In one embodiment, first sensors 180*a* are the only sensors that are "awake" when the lid 104 is closed. When first sensors 180*a* are triggered by a person approaching the toilet 50, for example, the lid 104 raises. When the lid 104 is open or when both the lid 104 and seat 102 are open, a second sensor 180*b* on the shroud 101 can detect the presence of a person at or approaching the toilet 50. If the second sensor 180*b* is not further triggered within a predetermined amount of time, the lid 104 closes. Various embodiments of operating a toilet seat assembly 100 are discussed in more detail below with reference to the flow diagrams of FIGS. 38 and 39.

The lid 104 includes one or more second sensors 180*b* on the shroud 101. Second sensor 180*b* can be configured to detect a hand swipe or the like when the lid 104 is open. Triggering second sensor 180*b* can be used to open the seat 102 after the lid 104 is open. For example, a first hand wave is detected by first sensor 180*a* and processed to open the seat 102 and, after using the toilet, a second hand wave is detected by second sensor 180*b* and processed to close the seat 102 and lid 104.

Optionally, a third sensor 180*c*, such as a capacitive sensor or other suitable sensor, is retained in or on the seat 102 to detect the presence of a person sitting on the toilet seat 102. For example, the third sensor 180*c* detects the presence of a person by a change in capacitance, temperature, proximity, or other condition. In one such embodiment, second sensor 180*b* on the shroud 101 may be disabled while the third sensor 180*c* on the seat 102 is triggered. Numerous variations and embodiments will be apparent in light of the present disclosure.

Figure 27:
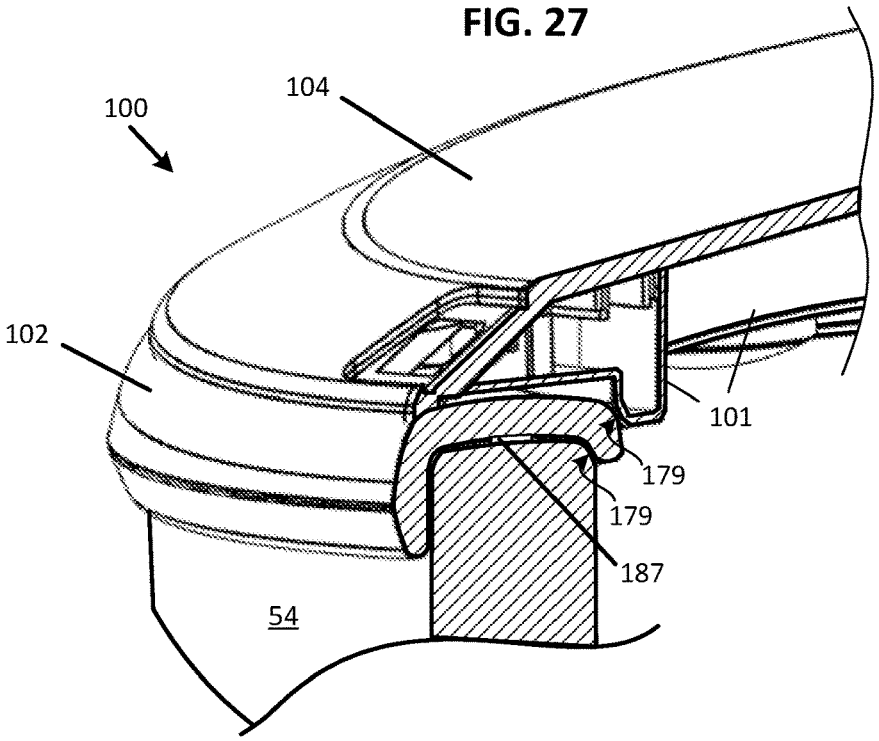
FIG. 27 illustrates a perspective cross-sectional view of part of a toilet seat assembly and toilet bowl showing the relationship between a shroud and the toilet seat, in accordance with an embodiment of the present disclosure.

Referring to FIG. 27, a perspective, cross-sectional view shows portions of the lid 104 and seat 102 in a closed position. In this example, the lid 104 includes a shroud 101 that extends away from the lid 104 a distance sufficient to at least partially overlap the seat 102 when the seat 102 and lid 104 are closed. For example, the shroud 101 extends down from the lid 104 to contact and/or overlap the radially inner portion of the seat 102. Adjacent the cleaning assembly 200, the shroud 101 extends down a distance so that it is vertically above the upper spray nozzle 171 (shown in FIG. 26C). In some embodiments, the bottom surface of the shroud 101 is parallel with the horizontal, but this is not required. As such, cleaning solution emitted from the upper spray nozzle 171 or nozzle 170 can effectively coat the inside face of the lid 104 without wetting the seat 102, in accordance with some embodiments. In some embodiments, the radially inner top surface of the seat 102 is angled downward into the bowl 54 so that any liquids on the seat 102 drain into the toilet bowl 54. An advantage of such features is that the shroud 101 can be sprayed or misted with a bleach solution or other cleaning product 164 without wetting the seat 102. Optionally, the shroud 101 can be configured to contact the seat 102 when the seat 102 and lid 104 are closed. Optionally, the bottom surface of the seat 102 located within the area of the shroud 101 (and/or the shroud 101 itself) include a hydrophobic material, such as a coating or sheet of polytetrafluoroethylene (PTFE). The hydrophobic material assists water leaving the lid 104 and shroud 101 after being sprayed with cleaning solution, for example.

The toilet seat 102 can be constructed to form a seal 179 with the rim 56 of the bowl 54. The seal 179 can result from components that sufficiently conform to each other so as to form a seal, or can result from a compressible material between surfaces, such as a gasket 187 or the like between the rim 56 and bottom of the toilet seat 102. Any seal 179 can extend partially or completely around the circumference of the bowl 54.

Figure 28:
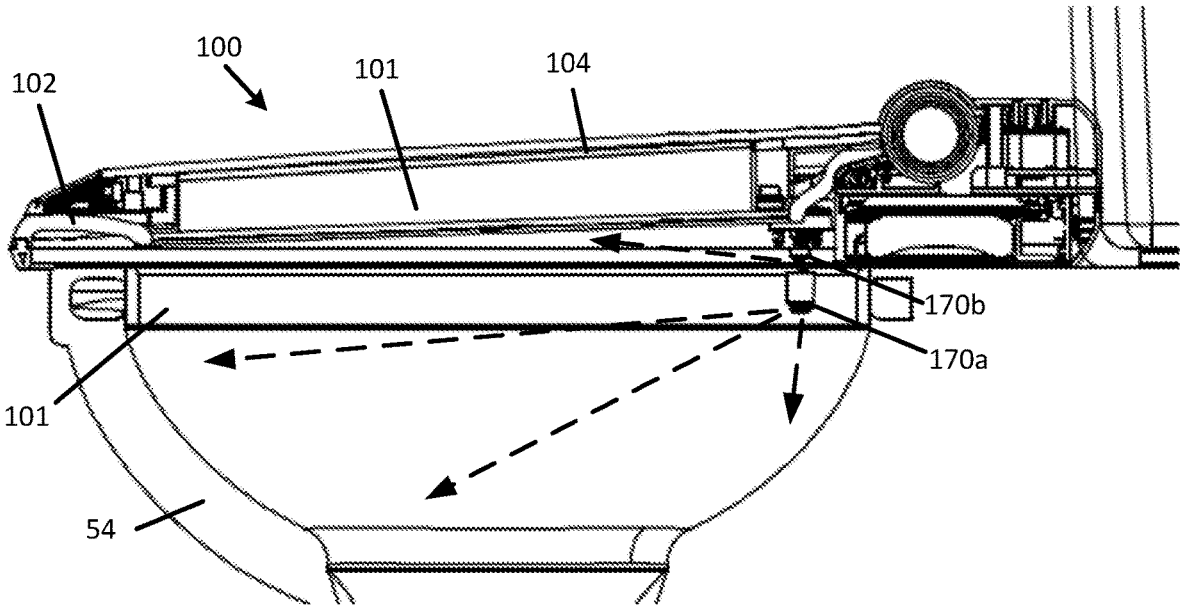
FIG. 28 illustrates a side view of part of a toilet and toilet seat assembly showing example spray directions of a cleaning assembly, in accordance with an embodiment of the present disclosure.

FIG. 28 illustrates a side view of a toilet 50 with a toilet seat assembly 100 and shows example liquid streams from a nozzle 170 and an upper spray nozzle 171 during a cleaning cycle, in accordance with an embodiment of the present disclosure. In this example, the lower nozzle 170 includes a plurality of ports that direct cleaning solution in a jet towards the upper front, lower front, and rear of the toilet bowl 54. Streams of cleaning solution directed to these areas can be used to dislodge solid waste on the inside of the bowl 54. The upper spray nozzle 171 directs cleaning solution to the lid 104 and rim 56 to remove urine stains, for example. The upper spray nozzle 171 and nozzle 170 each can include any number of ports to direct cleaning solution to various locations in the bowl 54, including water in the toilet bowl 54, the toilet bowl 54 above the water, and the rim 56 of the toilet bowl 54. In some embodiments, the nozzle 170 rotates as it dispenses liquid so as to more completely spray the entire bowl. For example, the nozzle 170 rotates 360°, 270°, 180° 135°, 90°, 60°, 45°, or 30° in a single direction or in a reciprocating manner.

Figure 29:
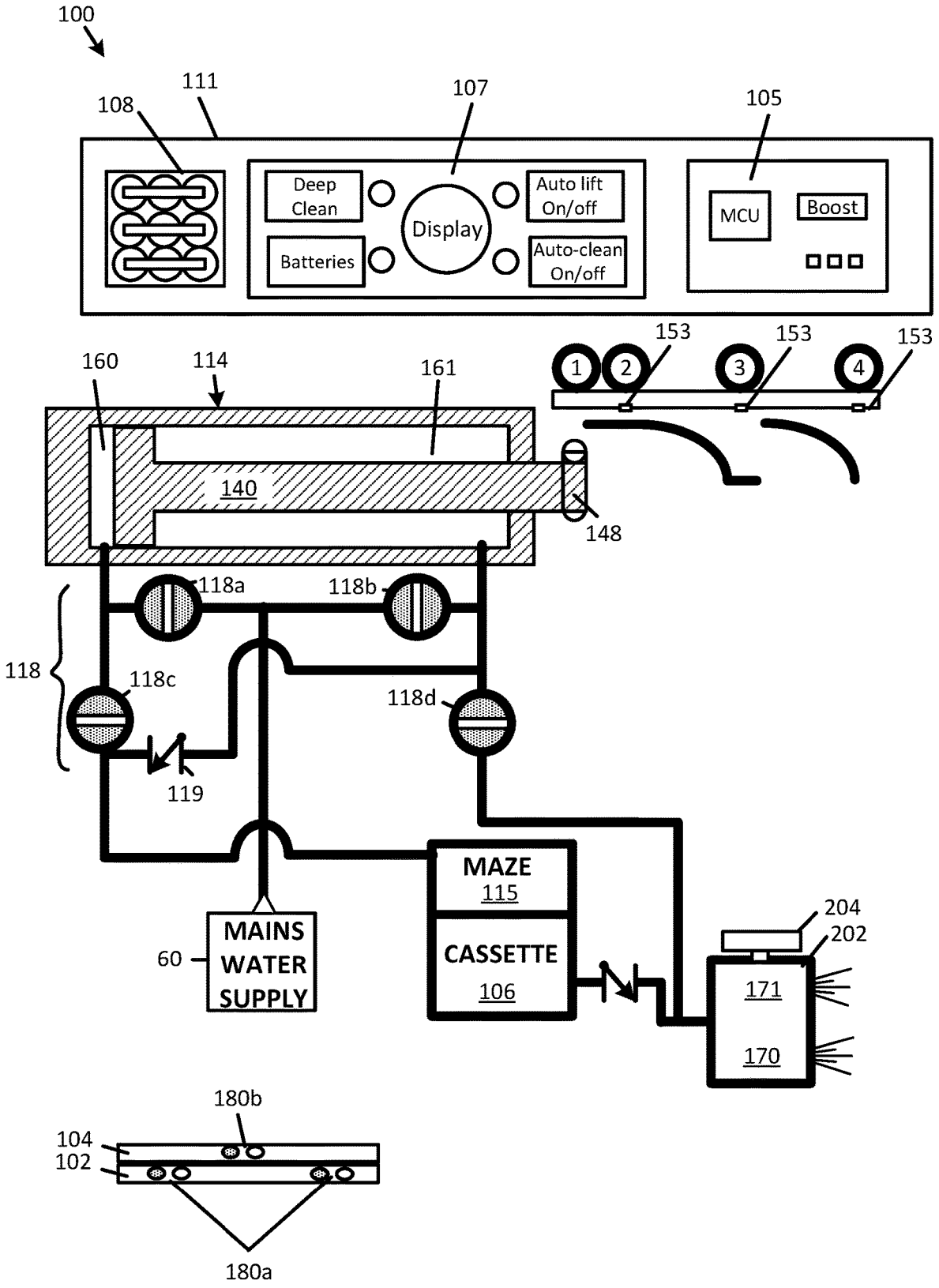
FIG. 29 illustrates a schematic diagram showing components of a toilet seat assembly, in accordance with an embodiment of the present disclosure.

Referring now to FIG. 29, a schematic diagram illustrates some components and plumbing connections of a toilet seat assembly 100, in accordance with an embodiment of the present disclosure. At the top of the diagram is an example of a control panel 111 that includes energy source 108 (e.g., batteries), a processor 105, and a user interface 107. Although shown as a group in this embodiment, the energy source 108 (e.g., batteries), processor 105, and user interface 107 can be separate components that may be positioned together or separately in, on, or near the housing 112 of the toilet seat assembly 100, as will be appreciated. The control panel 111 communicates with sensors 180 on the toilet seat 102, lid 104, and/or shroud 101. For example, the control panel 111 receives and processes inputs from sensors 180 and generally controls operation of the toilet seat assembly 100, such as opening and closing valves responsible for lifting functions and cleaning functions. The control panel 111 also communicates with position sensors 153 on the hydraulic cylinder 114. The position sensors 153 indicate when the cam follower 148 has reached a certain position, for example. In some embodiments, processor 105 or other components may be physically separated from the toilet seat assembly 100 while still being positioned in communication with components of the assembly 100. For example, the processor 105 and user interface 107 are mounted on the wall near the toilet 50 and communicate wirelessly with various sensors and valves of the assembly 100. FIGS. 31-37 schematically illustrate the toilet seat assembly 100 in various states of operation and are discussed in more detail below.

User interface 107 can communicate with the user using lights, sounds, a display screen, and/or other method. In one embodiment, the user interface includes multi-color LEDs adjacent each button. Pressing the "display" button illuminates various LEDs to indicate the current status of the system, such as battery status, whether automatic lifting is enabled, and whether automatic cleaning is enabled. In another example, LEDs flash in a repeating circular pattern during deep cleaning to communicate to the user that the deep cleaning cycle is in progress. In another example, all LEDs flash red in unison to indicate an error. Numerous variations can be used, as will be appreciated.

In one example, the toilet seat assembly 100 has an energy source 108 of batteries to power control circuits, valves, and sensors, and to provide power to other electrical functions of the system. As shown here, the energy source 108 include nine AA batteries. Other types and quantities of batteries or other energy source 108 can be used, as will be appreciated. Examples of other power sources include a solar panel, a cord to AC current from the home's or building's electrical system, a small hydro-electric turbine included in the toilet seat assembly 100, or a super capacitor. The energy source 108 can be readily replaceable or rechargeable batteries in some embodiments.

In one embodiment, the user interface 107 has a sealed panel with lights, display panel, liquid crystal display, or other means of communicating the operating states and system information to the user. The user interface 107 also includes one or more buttons, a touch screen, a microphone, a camera, a foot pedal, a floor mat, or other method of receiving user input to control operating features of the system. For example, the user interface 107 includes non-capacitive push buttons that can be pressed by the user to turn on or off the lift and close functionality of the toilet seat and lid, turn the auto clean feature on or off, initiate a deep clean cycle, and perform a battery check, to name a few examples. A "display" button can be pressed to illuminate indicators to show the user the current state and active functions of the system.

In one embodiment, the toilet seat assembly 100 operates with a hydraulic cylinder 114 to open and close the toilet seat 102 and lid 104. In one such embodiment, the hydraulic cylinder 114 is a double acting cylinder that includes a first volume 160 and a second volume 161, where the first volume 160 is on one side of a piston 140 (e.g., in front of the piston head 140*a*) and the second volume 161 is on the opposite side of the piston 140 (e.g., behind the piston head 140*a*). Water filling the first volume 160 while emptying the second volume 161 extends the piston 140 and filling the second volume 161 while emptying the first volume 160 retracts the piston 140, as will be appreciated. Valves 118 control water flow into and out of the hydraulic cylinder 114 to open or close the toilet seat 102 and/or lid 104 as well as to perform cleaning functions, in accordance with some embodiments. In other embodiments, the hydraulic cylinder 114 has a single chamber (e.g., first volume 160) that moves the piston 140 in a first direction and uses a spring for moving the piston 140 in the opposite direction. In yet other embodiments, the hydraulic cylinder 114 is a single action or double action diaphragm cylinder. Numerous variations and embodiments will be apparent in light of the present disclosure. In other embodiments, the toilet seat assembly 100 is configured only with a cleaning function, and therefore omits the hydraulic cylinder 114 used to raise and lower the seat 102 and lid 104. In one such embodiments, fewer valves 118 are needed, as will be appreciated.

In the example of FIG. 29, the assembly includes four valves 118*a*-118*d*. Valves 118*a*-118*d* are used to control the flow of water for opening and closing the seat 102 and lid 104 and for cleaning. Each valve 118 in this example is configured as a two-way valve, such as solenoid valve. Three-way, four-way, and other valves can be arranged with an equivalent functional result, as will be appreciated. In some embodiments, check valves 119 can be included to prevent reverse water flow in some plumbing lines.

Water enters the system from the mains water supply 60 and passes through a first valve 118*a* to fill the first volume 160 or through a second valve 118*b* to fill the second volume 161 of the hydraulic cylinder 114. A third valve 118*c* controls water flow to the maze 115 and cleaning cassette 106, which then flows through a plunger valve 202 to the bowl 54. Third valve 118*c* may include water from the mains water supply 60, from emptying first volume 160 of the hydraulic cylinder 114, or both. A fourth valve 118*d* controls water flow from the mains water supply 60, from emptying the second volume 161 of the hydraulic cylinder 114, or both, to the bowl 54 via the plunger valve 202. Sensors 180 on the lid 104, seat 102, and/or shroud 101 provide signals to the processor 105 that are used to control valves 118.

The system configuration shown in FIG. 29 represents a low or lowest power state referred to as quiescent mode, in accordance with one embodiment. In this example of quiescent mode, the system is on and automatic lifting of the lid 104 and seat 102 is disabled. The piston 140 of the hydraulic cylinder is in an unlocked position ("position 1") with the first volume 160 empty or nearly empty. The plunger 204 of the plunger valve 202 is down, directing water flow to the bowl 54 via the nozzle 170. When water flows through the nozzle 170 under pressure, such as when flowing from the third valve 118*c*, the nozzle 170 provides a jet of water. On the other hand, when water flows through the nozzle 170 under lower pressure or no added pressure, the nozzle 170 can function as a simple drain.

When the piston 140 is in position 1, the seat 102 and lid 104 are unlocked and the user can manually lift and lower the lid 104 and seat 102. In another example of quiescent state, the piston 140 is in a locked position ("position 2") with automatic lifting of the seat 104 and lid 102 enabled. In either example of the quiescent state, the processor 105 is in a low power state and only first sensor(s) 180*a* on the lid 104 or seat 102 is active. In one example, the first sensor 180*a* includes a passive infrared (PIR) sensor configured to detect a person entering the room. When activated, the first sensor 180*a* activates an infrared sensor 180 on the assembly that has a sensing region 182 with a diameter of about 7-10 cm. In one embodiment, for example, IR pulsing can be used in the quiescent mode or wake-up mode so that the first sensor 180*a* is "on" for 1-20 milliseconds per second (ms/s), including 1-10 ms/s, 5-10 ms/s, less than 20 ms/s, less than 10 ms/s, or less than 5 ms/s.

The toilet seat assembly 100 can be configured for automatic operation, manual operation, or both. For example, a cleaning cycle, toilet flush, opening or closing of the seat or lid, or other process can be initiated automatically by the processor in response to receiving a sensor signal. Alternately, the user may press a button with the hand or foot, step on a mat or foot pedal, speak a command, or perform some other action to initiate an action. Further, the toilet seat 102 and lid 104 are not restricted to operation with a hydraulic cylinder or mechanized device, and such operation can be bypassed or defeated so that the user can open and close the seat 102 and lid 104 manually in the traditional manner. Numerous variations will be apparent in light of the present disclosure.

Figure 30:
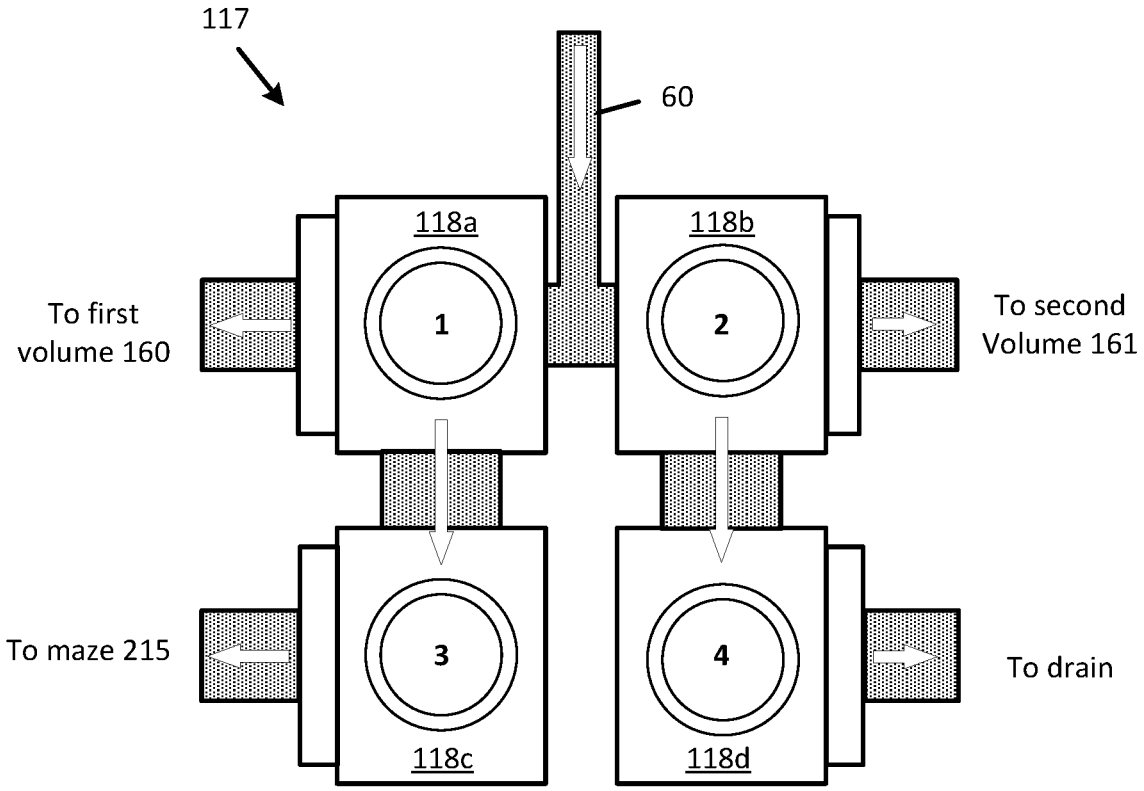
FIG. 30 illustrates a top view of a four-valve assembly, in accordance with an embodiment of the present disclosure.

FIG. 30 illustrates a top plan view of a valve assembly 117 that includes four valves 118*a*-118*d* as depicted, for example, in the schematic of FIG. 29. In this example, the mains water supply 60 is connected to the inlet of the first valve 118*a* and the inlet of the second valve 118*b*. In an open position, the first valve 118*a* directs water to the first volume 160 of the hydraulic cylinder 114. The outlet of the first valve 118*a* is connected to the inlet of the third valve 118*c* by a conduit that is internal or external to the valve assembly 117. For the second valve 118*b*, the open position directs water to the second volume 161 of the hydraulic cylinder 114. The outlet of the second valve 118*b* is connected to inlet the fourth valve 118*d* by a conduit that is either internal or external to the valve assembly 117. For the third valve 118*c*, an open position directs water to its outlet that is connected to the plunger valve 202 via the maze 115 and cleaning cassette 106. For the fourth valve, an open position directs water to drain into the bowl 54 via the plunger valve 202. Numerous valve types and arrangements can be used to accomplish the desired water flow, as will be appreciated.

Figure 31:
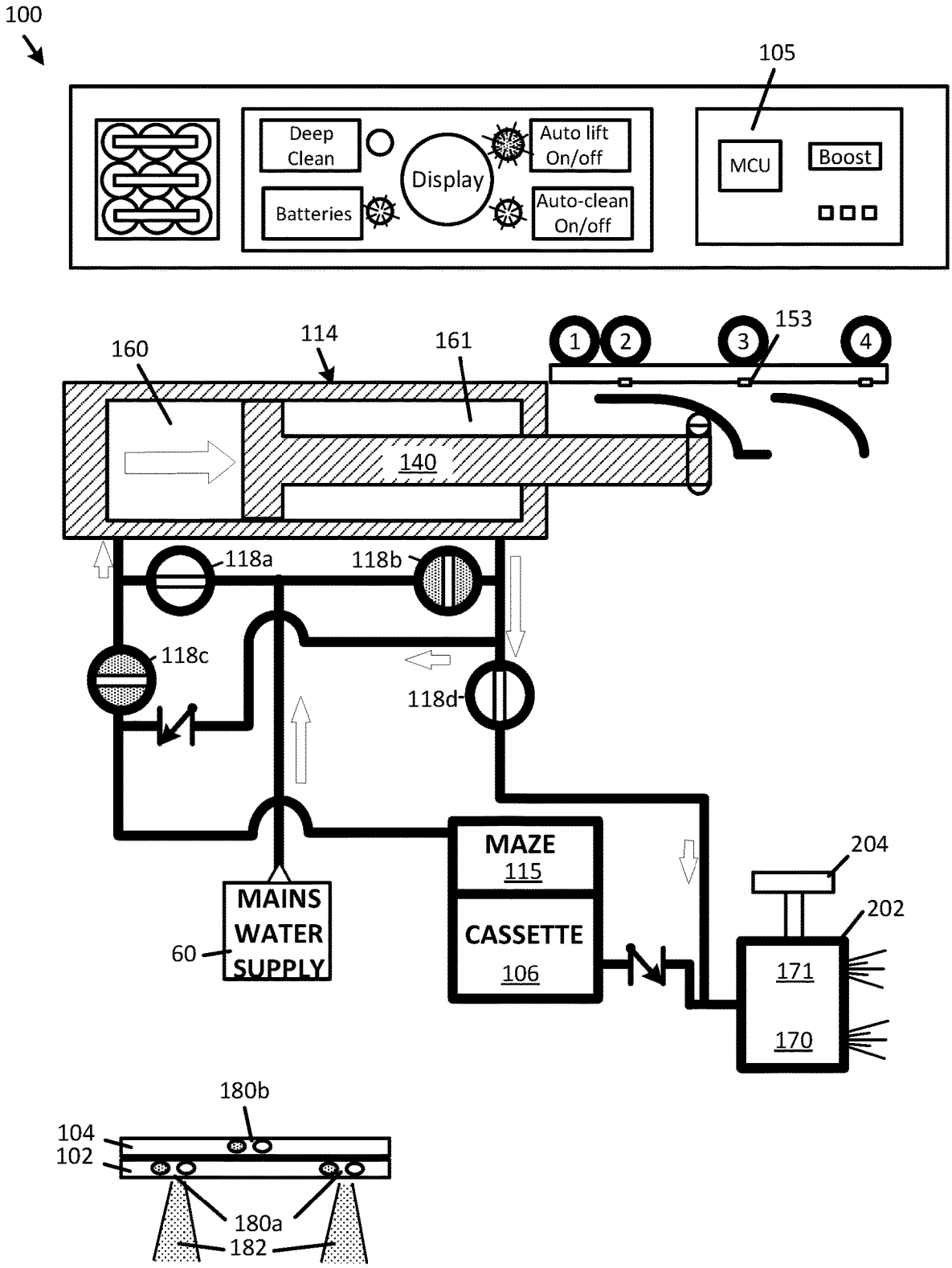
FIGS. 31-37 illustrate schematic diagrams showing the toilet seat assembly in various stages of operation, in accordance with some embodiments of the present disclosure.

Referring now to FIG. 31, a schematic diagram illustrates the toilet seat assembly 100 in "wake-up mode" during which the lid 104 is lifted. In wake-up mode, sensor 180*a* has been triggered and the processor 105 is in an operational state with power boosted to an operational level (e.g., to 12 volts). The first valve 118*a* and fourth valve 118*d* are open, and the plunger valve 202 is in a down position so long as the lid 104 is closed. As the lid 104 opens, the plunger 204 of the plunger valve 202 raises to an up position. These valve positions fill the first volume 160 of the hydraulic cylinder 114 from the mains water supply 60, drain the second volume 161 to the toilet via plunger valve 202, and add water to the cassette 106. The lid 104 is raised as the piston 140 moves to position 3, at which point a position sensor 153 (e.g., Hall effect sensor, optical encoder, electrical contact pad, etc.) is triggered and processed by the processor 105 to close the first and fourth valves 118*a*, 118*d*. In one example, each valve 118 requires about 1.5 Amps of power for about 30 ms to open and then uses pulsed power of 0.5 A to maintain the valve 118 in an open state. The wake-up mode is expected to occur ten times per day during normal usage, but wake-up mode may occur more or fewer times.

Figure 32:
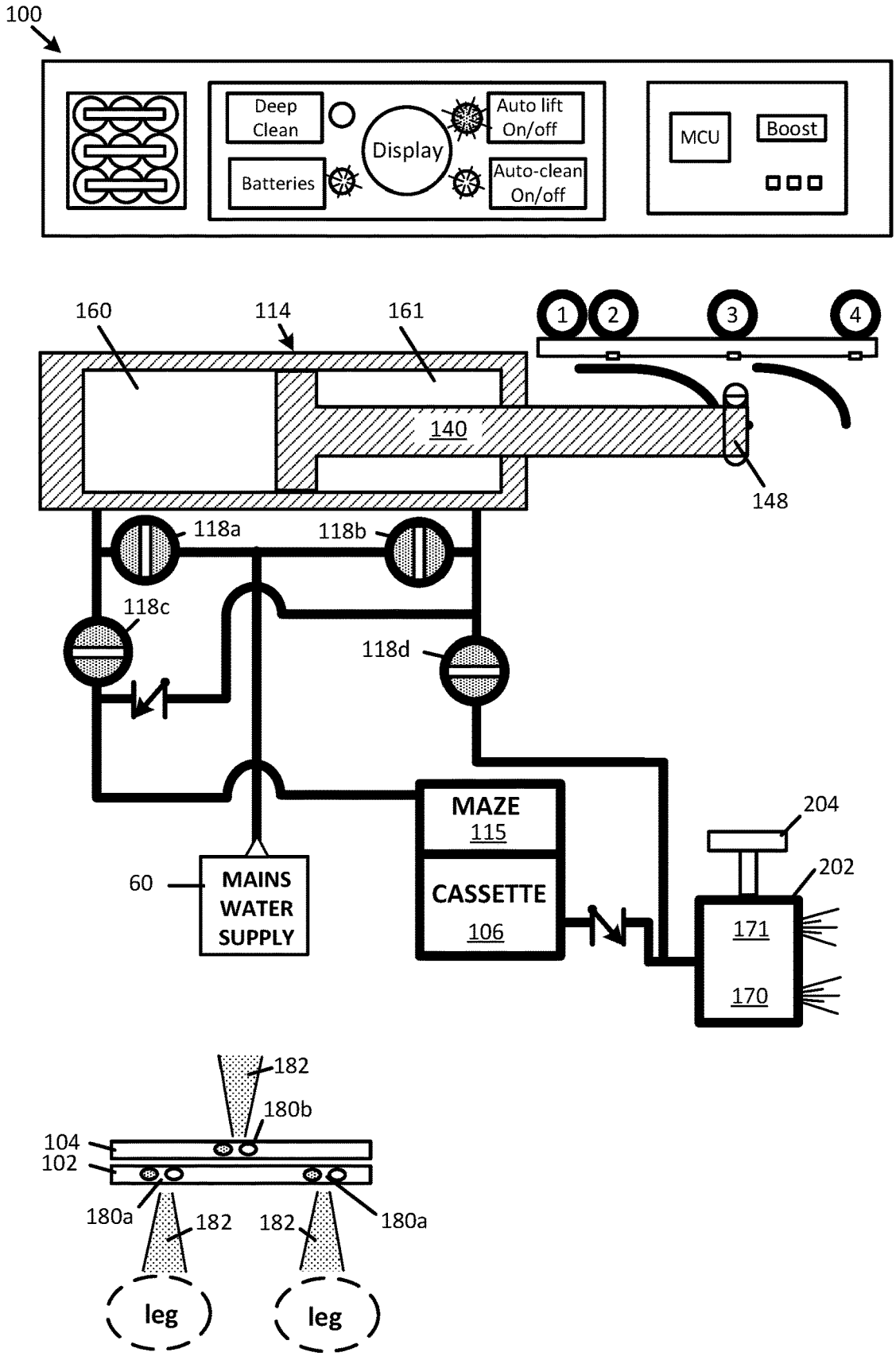

Referring now to FIG. 32, a schematic diagram illustrates the toilet seat assembly 100 in a "lid up" state in which the lid 104 is maintained in an open position. In this condition, all four valves 118 are closed, the piston 140 is in position 3 in which the lid 104 is raised and both the seat 102 and lid 104 locked by engagement between the cam follower 148 and the helical pathway 158. First sensor(s) 180*a* and second sensor 180*b* are active to detect a signal within the maximum sensing region 182. For example, first sensor(s) 180*a* have a sensing region 182 of 20 cm and second sensor 180*b* has a sensing region 182 of 45 cm, such as may be used to detect the presence of a person on or in front of the toilet or a gesture above the toilet. When the lid 104 is in the up position, the plunger 204 of the plunger valve 202 in the up position so that water flow (if any) is directed to the bowl 54 via nozzle 170.

Figure 33:
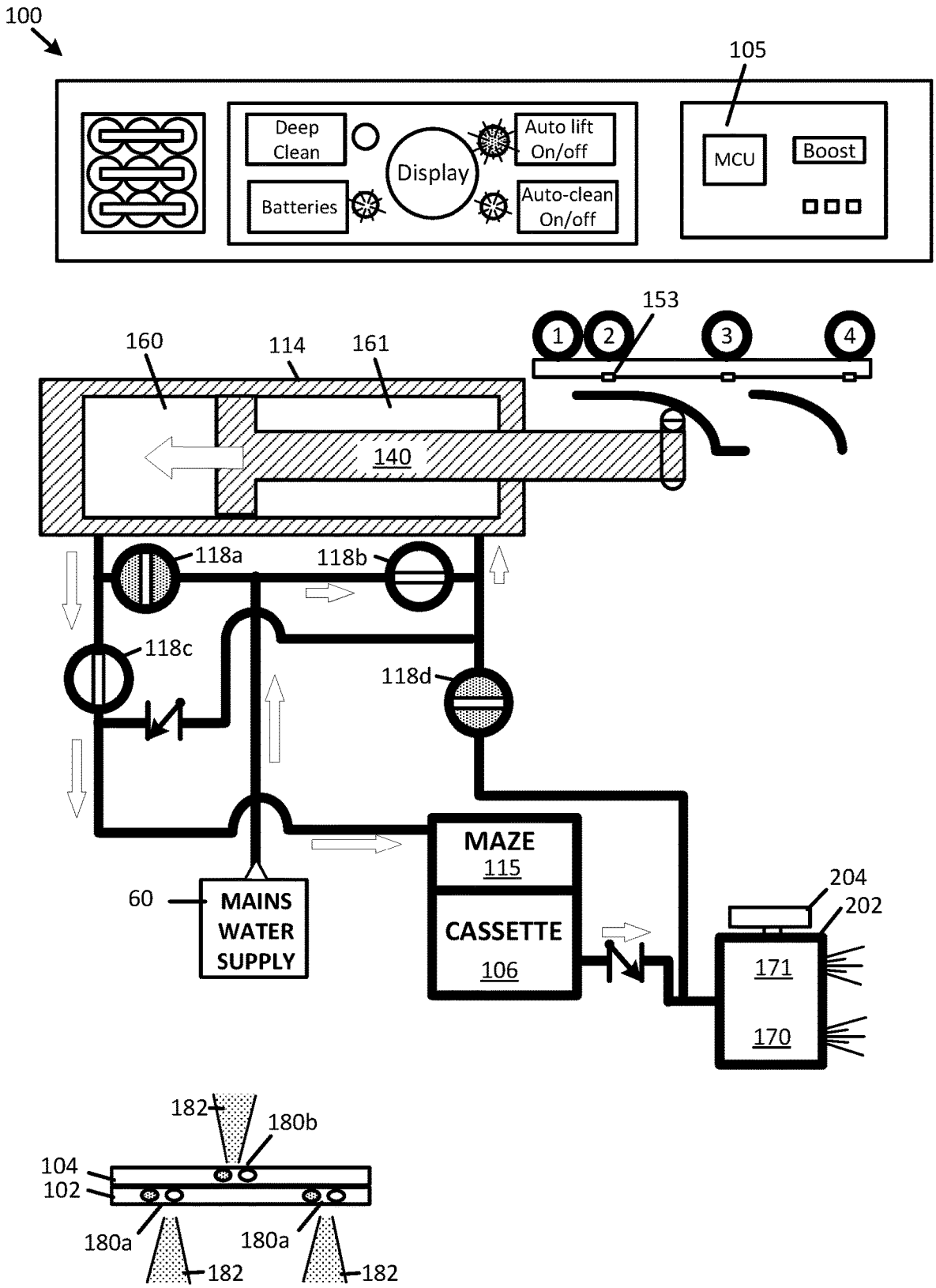

Referring now to FIG. 33, a schematic diagram illustrates the toilet seat assembly 100 in a "lid close" mode during which the lid 104 is moved from an open position to a closed position. In one example, the processor 105 begins to close the lid 104 ten seconds after first sensor(s) 180*a* fail to detect the presence of a person. The power is boosted to the higher operational power state (e.g., 12 Volts) and second valve 118*b* and third valve 118*c* are opened to allow water to fill the second volume 161 of the hydraulic cylinder 114 and drain the first volume 160. In doing so, the piston 140 moves into the first volume 160 toward position 2. Water draining from the first volume 160 is directed to the plunger valve 202 via the maze 115 and cleaning cassette 106. The plunger 204 of the plunger valve 202 is in the up position initially and is depressed as the lid 104 closes, directing water to the nozzle 170. First sensors 180*a* and second sensor 180*b* continue to sense within the maximum sensing region 182. Upon the piston 140 reaching position 2, a position sensor 153 triggers the processor 105 to return the system to the quiescent state. In one embodiment, the system returns to the quiescent state ten seconds after the lid 104 closes and the plunger 204 of the plunger valve 202 moves to the down position.

Figure 34:
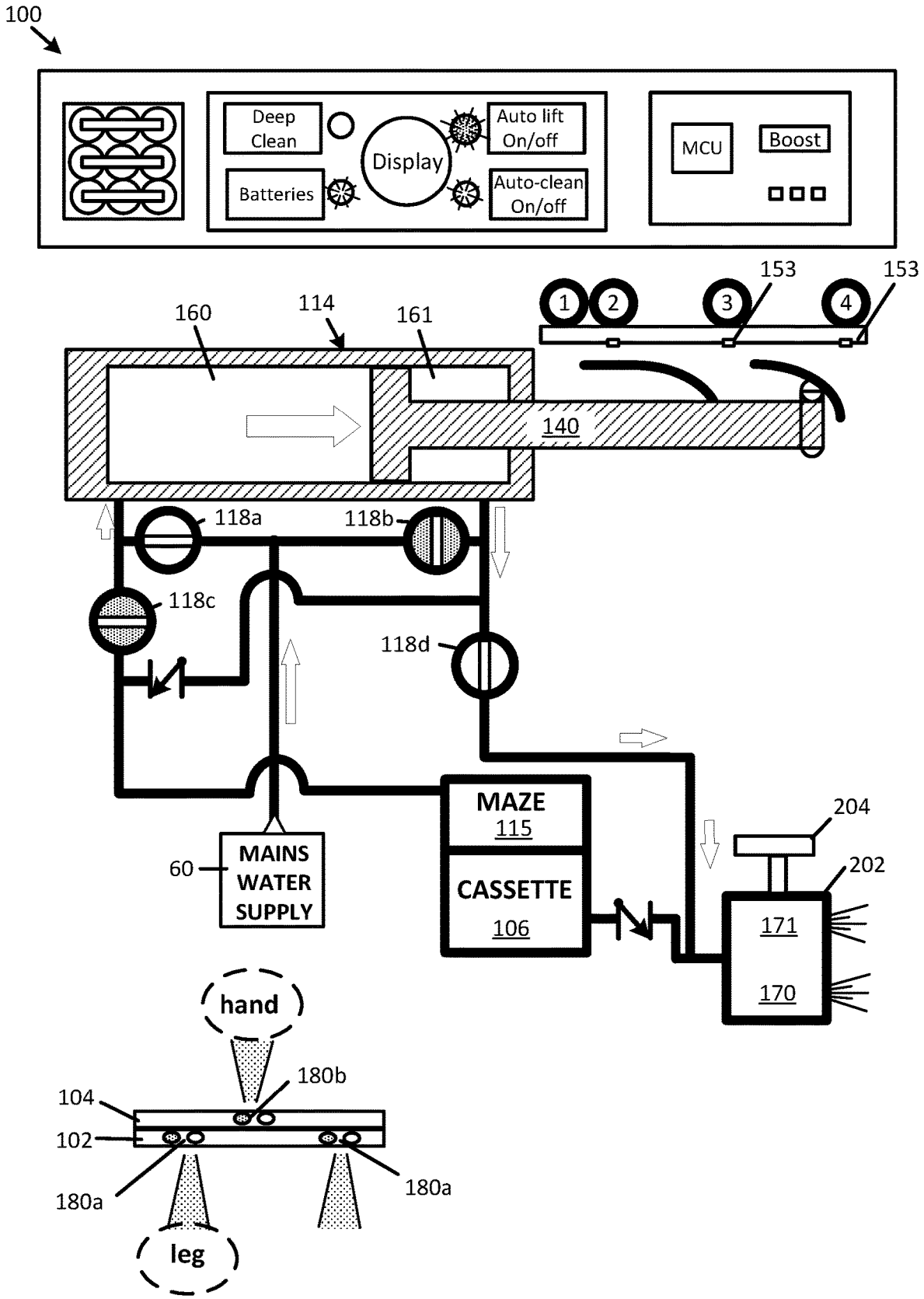

Referring now to FIG. 34, a schematic diagram illustrates the toilet seat assembly 100 in another embodiment of the wake-up mode in which both the lid 104 and seat 102 lift automatically. In this example, the processor 105 is set to the operational state and power is boosted to the operational level after receiving input from one or both of first sensors 180*a* and second sensor 180*b*. The first valve 118*a* and fourth valve 118*d* are opened, filling the first volume 160 of the hydraulic cylinder 114 and draining water from the second volume 161 to the toilet via plunger valve 202. In doing so, the piston 140 moves towards position 3 at which point the lid 104 is raised and position sensor 153 sends a signal to the processor 105. When the processor 105 receives an additional signal from second sensor 180*b* (e.g., user gesture), first valve 118*a* and fourth valve 118*d* are opened again (or remain open) to move the piston 140 to position 4 and open the seat 102. Upon reaching position 4, the seat 102 is also open and a position sensor 153 at position 4 is triggered. Position sensor 153 at position 4 communicates with the processor 105, which closes the first and fourth valves 118*a*, 118*d* to maintain the open position of the seat 102 and lid 104. While the lid 104 is open, the plunger 204 of the plunger valve 202 remains in the up position.

Figure 35:
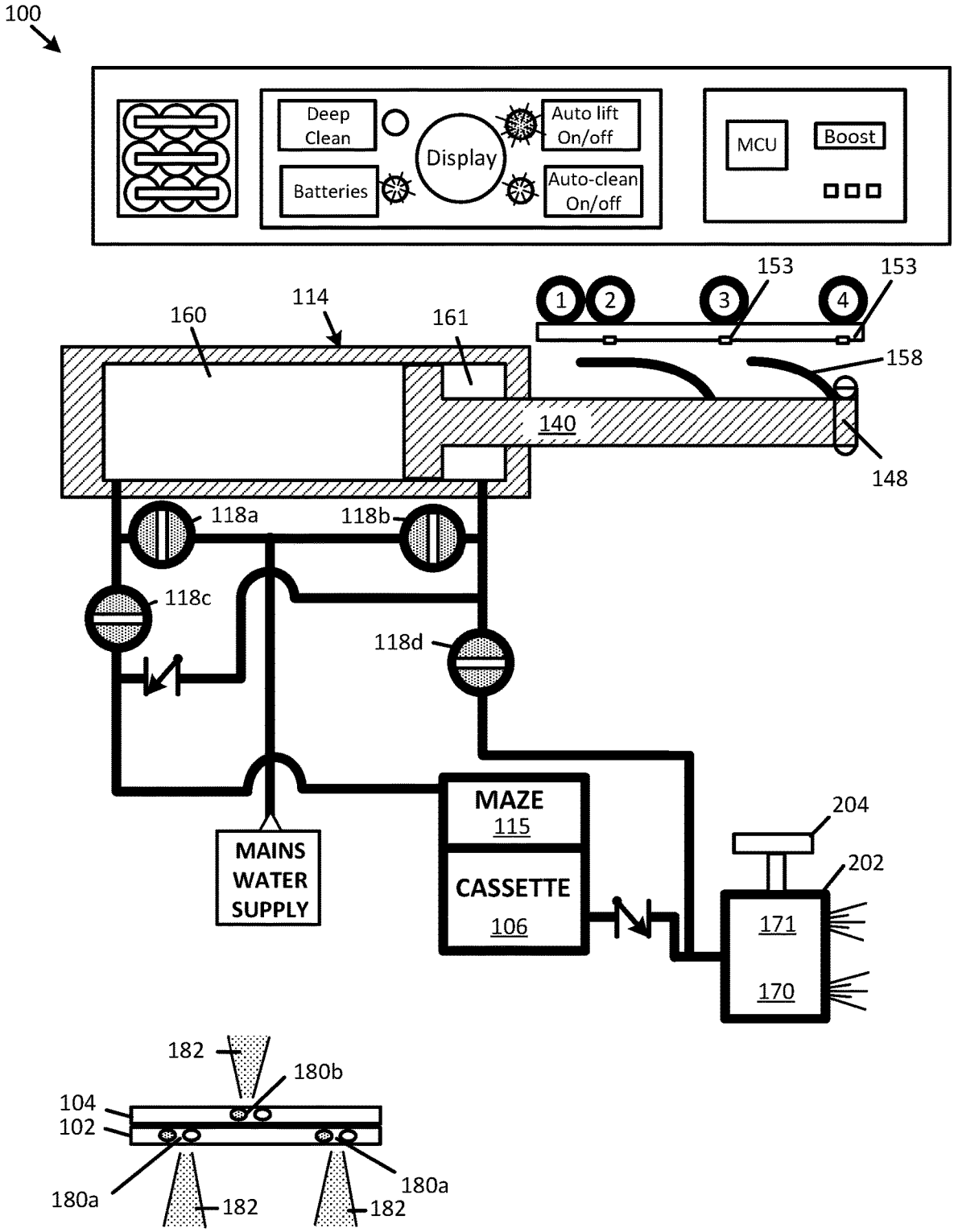

Referring now to FIG. 35, a schematic diagram illustrates the toilet seat assembly 100 in a "seat up" condition in which the seat 102 and lid 104 are maintained an open position. Optionally, the seat 102 can be locked open due to engagement between the cam follower 148 and the helical pathway 158. In this example, all valves 118 are closed and sensors 180 operate with the maximum sensing region 182. The plunger 204 of the plunger valve 202 is in the up position to direct water flow (if any) to the bowl 54.

Figure 36:
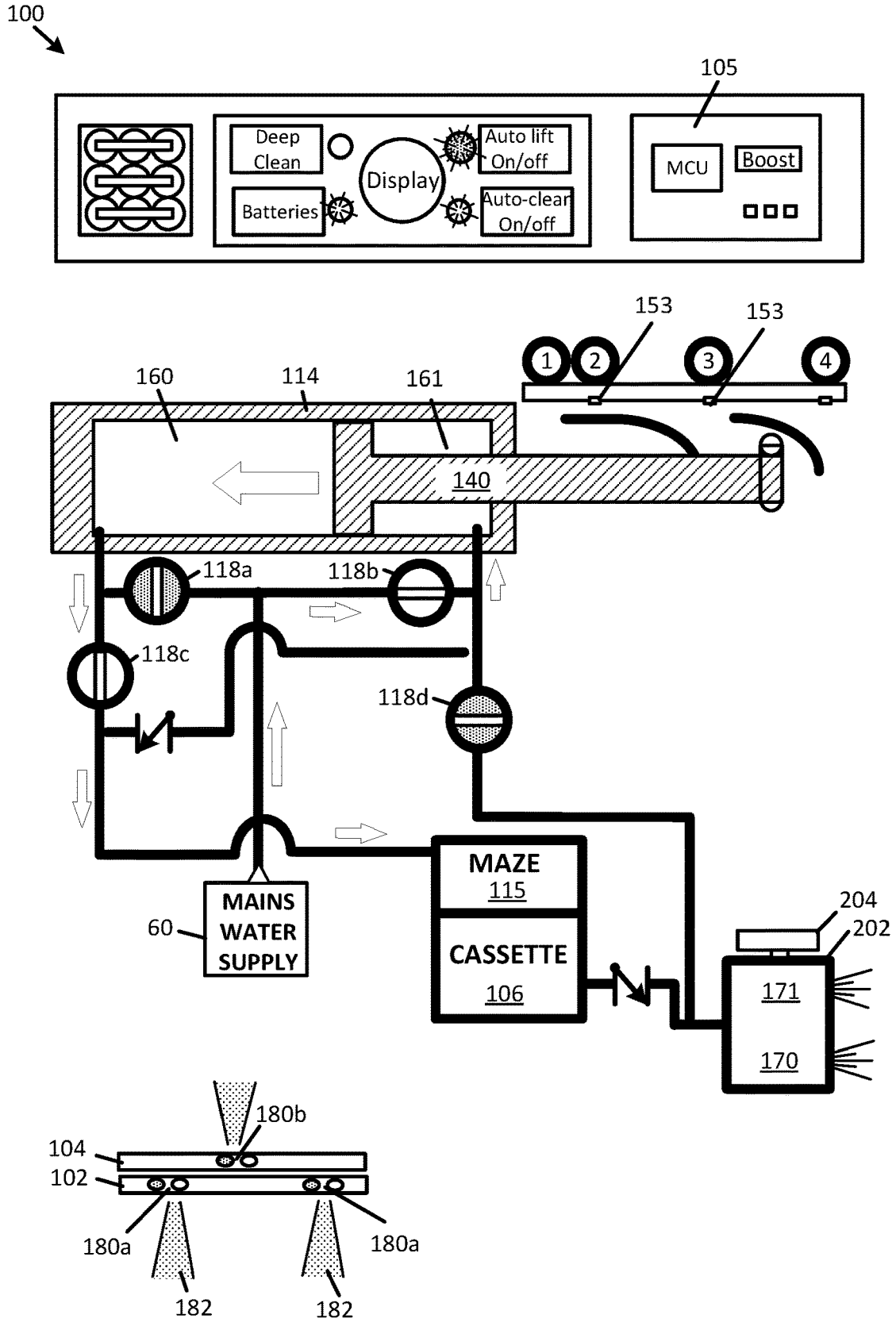

Referring now to FIG. 36, a schematic diagram illustrates the toilet seat assembly 100 in a "lid and seat close" mode during which the lid 104 and the seat 102 are moved from an open position to a closed position. In one example, the processor 105 begins to close the seat 102 ten seconds after first sensor(s) 180*a* fail to detect the presence of a person. The power is boosted to the higher operational power state (e.g., 12 volts) and second valve 118*b* and third valve 118*c* are opened to allow water from the mains water supply 60 to enter the second volume 161 of the hydraulic cylinder 114 and drain from the first volume 160, moving piston 140 into the first volume 160 towards position 3 while also lowering the seat 102. At position 3, the seat 102 is down and the processor 105 receives input from position sensor 153. In response, the processor 105 continues to fill the second volume 161 to advance the piston 140 to position 2 and lower the lid 104. Water draining from the first volume 160 is directed to the maze 115 and cleaning cassette 106 and then to the bowl 54 via plunger valve 202, which moves to the down position as the lid 104 closes. Cleaning solution from the cleaning cassette 106 (e.g., diluted bleach) is sprayed into the toilet bowl 54 under pressure through nozzle 170. Additionally, the upper spray nozzle 171 may be activated to dispense a mist or spray of cleaning solution when the lid 104 is closed. In yet other embodiments, cleaning product 164 in the cleaning cassette 106 is dispensed to the toilet bowl 54 separately from the nozzle 170 or upper spray nozzle 171, rather than mixing with the flow of water. For example, the cleaning cassette 106 is a consumable product containing liquid cleaning product 164. Cleaning product 164 is dispensed from the cleaning cassette 106 directly to the toilet bowl 54 by a pump, compressed air, gravity feed, or other suitable method. Sensors 180 continue to sense within the maximum sensing region 182. Upon reaching position 2, a position sensor 153 triggers the processor 105 to return to the quiescent state. In one embodiment, the plunger 204 of the plunger valve 202 moves to the down position and the system returns to the quiescent state about ten seconds after the lid 104 closes.

Figure 37:
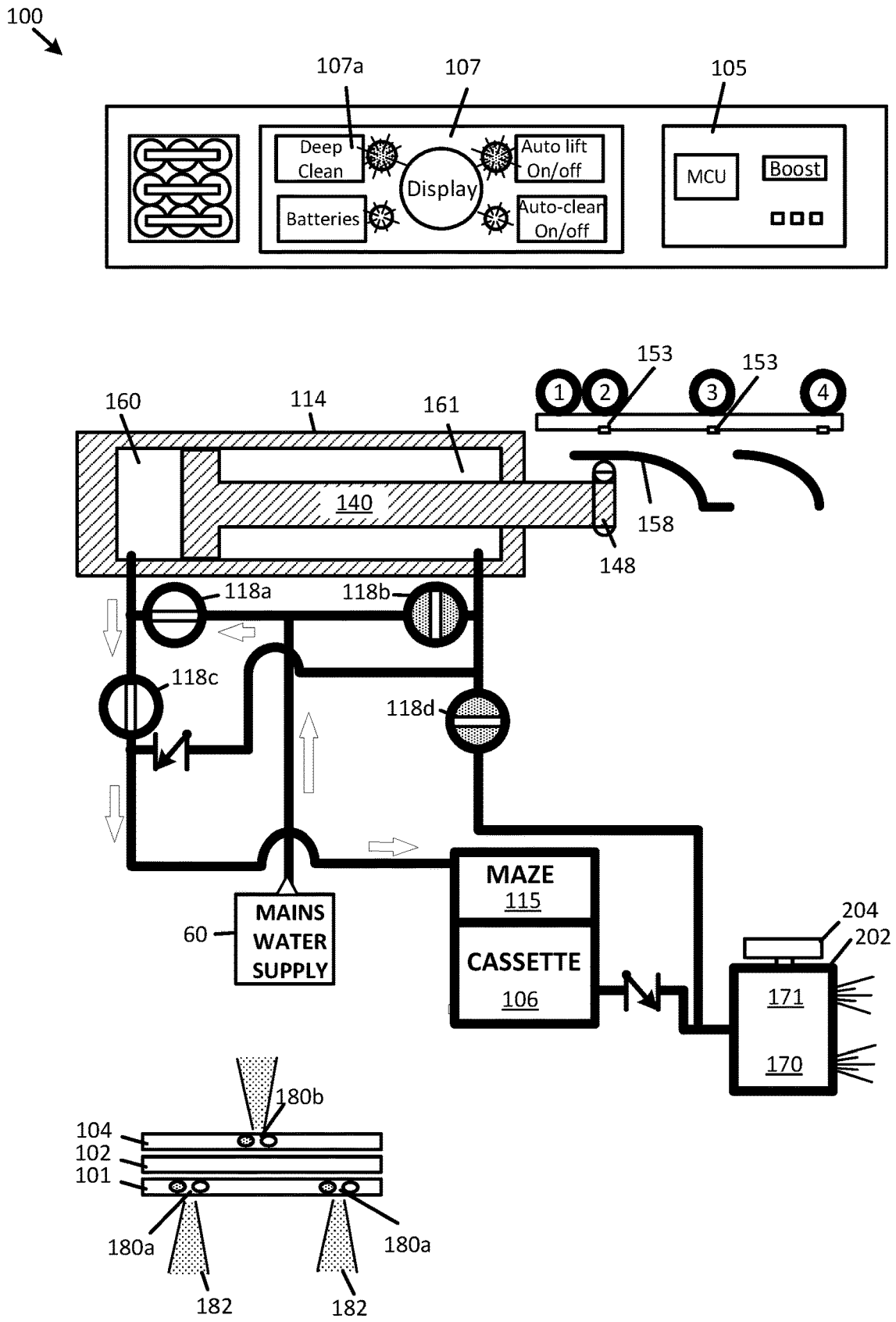

Referring now to FIG. 37, a schematic diagram illustrates the toilet seat assembly 100 in a "deep clean" mode. In one embodiment, deep cleaning is expected to occur once per day (or 24-hour cycle) but can be performed more often or less often as deemed suitable by the user. The frequency of deep cleaning can be set by the user, determined by the assembly 100 based on use of the toilet, or set during manufacture to occur once in a given time frame (e.g., every 24 hours). Deep cleaning can be initiated automatically, manually, or both. In addition, the user may manually initiate deep cleaning by pressing the "Deep Clean" button 107*a* on the user interface 107, such as when additional or more frequent cleaning is desired. In another example, automatic deep cleaning is not activated, so deep cleaning occurs only when the user presses the "Deep Clean" button 107*a* or otherwise initiates a deep cleaning cycle.

Deep cleaning can be manually started when the user presses the deep clean button 107*a* on the user interface 107 or otherwise indicates a selection to initiate deep cleaning. In some embodiments, the toilet seat assembly 100 is configured to automatically initiate deep cleaning within a predetermined length of time (e.g., 24 hours, 48 hours, 72 hours, 1 week, etc.). For example, the processor 105 monitors when the seat 102 and lid 104 lifts occur during a 24-hour cycle and determines the longest duration of non-use based on data collected over time (e.g., an average over one week, two weeks, etc.). In one example, the processor 105 is configured to select the time to initiate deep cleaning as the mid-point of the average longest period of non-use based on recent use. Note that the 24-hour cycle need not coincide with a calendar day and other points during the period of non-activity can be used.

Whether initiated automatically or manually, the processor 105 determines the position of the piston 140 or cam follower 154. If the piston 140 is not in position 2 (seat 102 and lid 104 locked), the processor 105 opens valves 118 as needed to move the piston 140 to position 2. For example, if the piston 140 is in position 1 (e.g., unlocked and ready for manual lifting of seat 102 and lid 104), processor 105 opens the first valve 118*a* and the fourth valve 118*d* for a length of time needed to move the piston 140 to position 2. As noted above, in position 2, the lid 104 and seat 102 are both closed and locked, and the plunger 204 of the plunger valve 202 is in the down position, in accordance with some embodiments.

With the piston 140 in position 2, the processor 105 turns on the upper spray nozzle 171 to spray the lid 104 and bowl 54 with a mist or stream of cleaning solution. Optionally, exposed portions of the seat 102 can be sprayed. In some embodiments, the upper spray nozzle 171 is operated for a relatively short time (e.g., up to 10 seconds, such as about 5 seconds). The system power is boosted to the higher operational level (e.g., 12 volts) and the first valve 118*a* and the third valve 118*c* are opened to spray the bowl 54 using the nozzle 170 with water from the mains water supply 60 via the maze 115 and cleaning cassette 106. In some embodiments, this spray occurs for a relatively short duration (e.g., up to 10 seconds, such as 5 seconds). Note that during this spray, the plunger 204 of the plunger valve 202 is down since it was moved to the down position when the lid 104 closed. Optionally, the upper spray nozzle 171 is activated after cleaning (e.g., about 5 seconds) using fresh water from the mains water supply 60 to clean it. For example, the fourth valve 118*d* is opened to direct water to the plunger valve 202. Longer or shorter cleaning times, intermittent or pulsed spray, combinations of high-pressure and low-pressure spray, and other variations can be used, as will be appreciated.

In one embodiment, after deep cleaning is complete (e.g., ~10 seconds after), the processor 105 opens the second valve 118*b* and the third valve 118*c* to move the piston 140 (back) to position 1. When the cam follower 154 is in position 1, it is disengaged from the helical pathway 158 and the lid 104 and seat 102 are unlocked for manual raising. Following deep cleaning, the assembly 100 returns to the quiescent state, in accordance with some embodiments.

Figure 38:
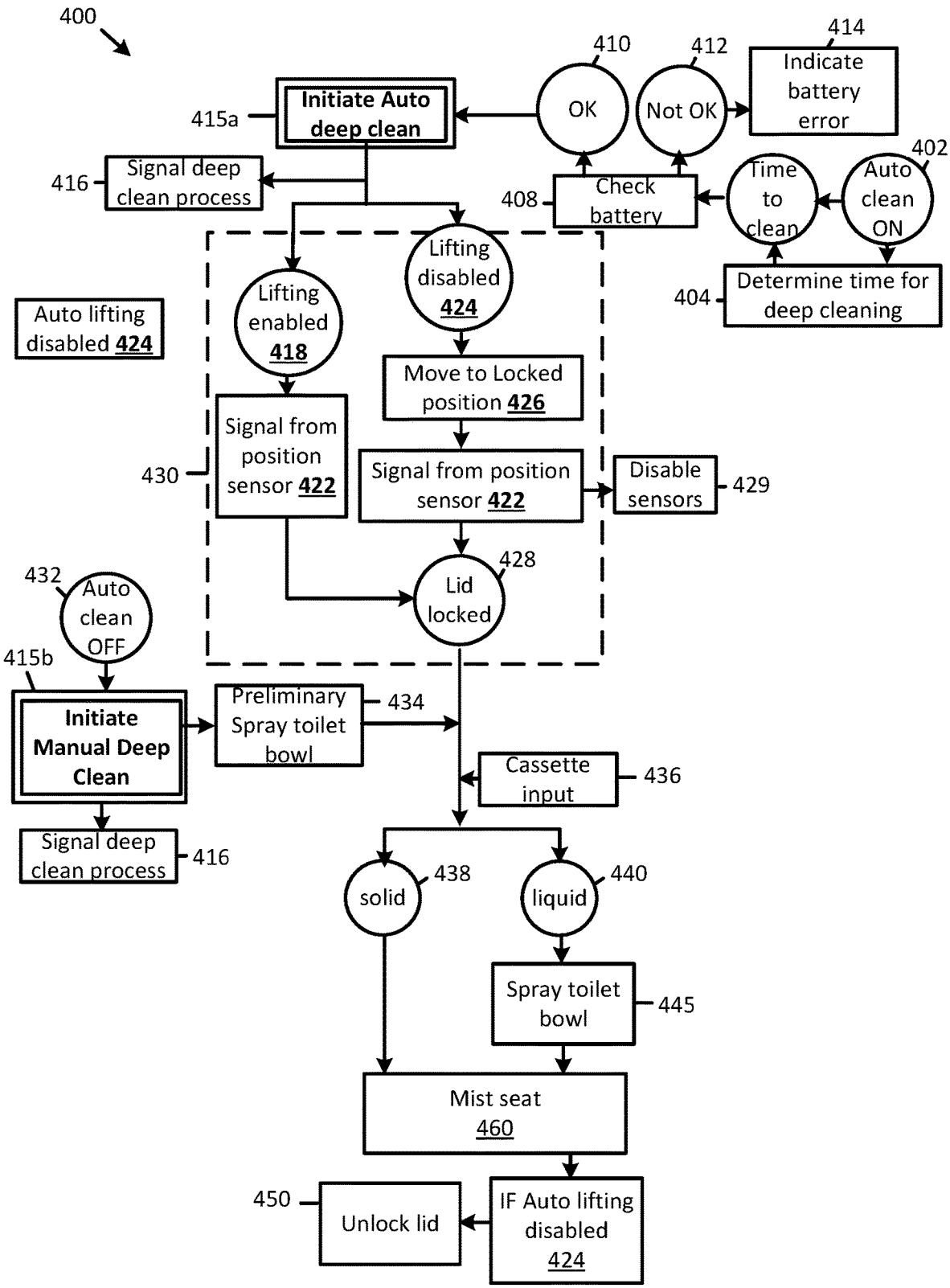
FIG. 38 illustrates a flow diagram showing example processes in a method of cleaning a toilet, in accordance with some embodiment of the present disclosure.

Referring now to FIG. 38, a flow chart illustrates processes in a method 400 of cleaning a toilet, in accordance with one embodiment of the present disclosure. In FIG. 38, rectangular blocks generally represent actions or processes that can be performed by processor 105, for example, and circular blocks generally represent a condition that may be input to or detected by the processor 105. As a general overview, method 400 includes initiating 415 a deep cleaning cycle, which may occur either automatically or manually. When the cleaning cycle is initiated automatically 415*a* by the processor, for example, method 400 includes moving 430 the piston to lock the lid in a closed position (e.g., to position 2), if it is not already in this position. Method 400 includes spraying 445 the toilet bowl, either with clean water from the mains water supply, with a liquid mixture of water and cleaning product, or both. Method 400 also includes misting 460 the seat and lid. In one embodiment, a mist valve or atomizer is energized to mist the seat and lid with a liquid mixture of water and cleaning product (e.g., bleach). Additional details and optional processes of method 400 are discussed in more detail below.

When method 400 involves an automatic deep cleaning cycle, several processes or conditions may occur prior to automatically initiating 415*a* the deep cleaning cycle, in accordance with some embodiments. In one such embodiment, the automatic deep cleaning is enabled 402. In some embodiments, enabling automatic deep cleaning can be a default setting capable of deactivation by user input, can be a setting that can be selected by the user as desired, or can be a permanent setting. In one example in which auto cleaning is enabled 402, the processor determines 404 the time to perform deep cleaning during a period of non-use, as discussed above. Upon reaching the time to clean 406, the processor optionally performs a battery check 408. If the battery has 410 sufficient power to complete the cleaning cycle, then the processor initiates 415*a* the deep clean cycle. On the other hand, if the battery fails 412 the battery check, then the processor indicates 414 a battery error to the user. After initiating 415*a* the deep cleaning cycle, the processor optionally signals 416 that deep cleaning is in progress, such as by a sequence of flashing LEDs.

Moving 430 the piston to lock the lid occurs both when automatic lifting is enabled 418 or disabled 424. When lifting is enabled, the processor receives 422 input from a position sensor to indicate that both the seat and lid are in a closed position and the cam follower is engaged to lock the lid closed. When auto lifting is disabled 424, on the other hand, the piston typically is in an unlocked position (e.g., position 1) where the cam follower is disengaged to permit manual lifting of the lid and seat. In such case, the processor moves 426 the piston to the locked position, such as by opening the first valve and fourth valve as discussed above. The processor receives 422 a signal from the position sensor to indicate the lid is locked 428. In this example, the processor then closes the first valve and fourth valve to maintain the position of the piston. Optionally, the processor disables 429 the sensors on the seat, lid, and/or shroud.

When automatic cleaning is disabled or off 432, the deep cleaning cycle can be manually initiated 415*b* by the user, such as pressing the "deep clean" button. When deep cleaning is manually initiated 415*b* and automatic deep cleaning is enabled, method 400 optionally includes preliminary spraying 434 water into the toilet bowl to dislodge solids. In some embodiments, preliminary spraying 434 can alternately be performed any time deep cleaning is initiated manually. Preliminary spraying 434 can include water only or may include a mixture of water and cleaning product (e.g., bleach). In other embodiments, the preliminary spraying 434 is performed only when automatic deep cleaning is disabled 432.

Whether cleaning is initiated automatically or manually, method 400 can use an input 436 about the type of cleaner installed in the cleaning cassette to determine which valves to open for cleaning. In one example, the user inputs a value into the user interface to indicate the cleaning product being either solid or liquid, such as after filling or refilling the cleaning cassette. In another example, the cleaning cassette is configured for only one form of cleaning product and the setting is fixed or not used by the processor. In another example, the cleaning cassette detects and communicates the form of the cleaning product to the processor. In one such embodiment, the cleaning cassette is disposable and includes an identifier (e.g., code, chip, or RF tag) used by the processor to identify the type of cleaner. When the cleaning cassette is installed, the processor identifies its type and performs an algorithm appropriate to that type.

When the cleaning cassette contains a solid cleaning product 438 (e.g., a bleach tablet), method 400 continues with spraying 460 the lid and rim. When the cleaning cassette contains a liquid cleaning product 440 (e.g., liquid bleach), method 400 continues with spraying 445 the toilet bowl and spraying 460 the lid and rim. In one embodiment in which automatic lifting is disabled 424, the processor unlocks 450 the lid. For example, the processor opens the second valve and third valve to move the piston to an unlocked position (e.g., position 1) where the cam follower is disengaged from the helical pathway and allows manual lifting of the seat and lid.

Figure 39:
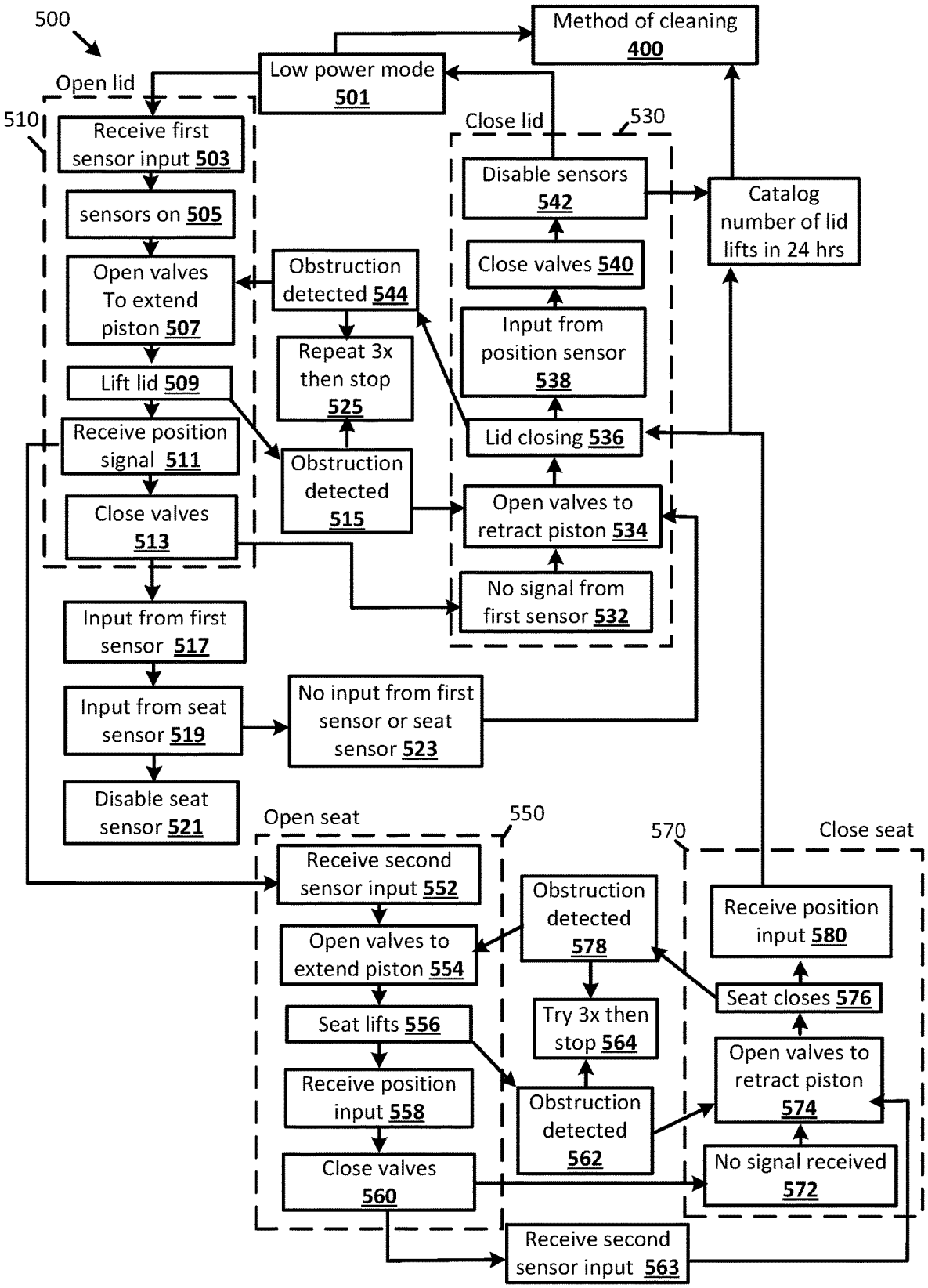
FIG. 39 illustrates a flow diagram showing example processes in a method of opening and closing a toilet seat assembly, in accordance with some embodiments of the present disclosure.

Referring now to FIG. 39, a flow diagram shows example processes in a method 500 of opening and closing a toilet seat and/or lid, in accordance with one embodiment. Method 500 can be combined with or performed in sequence with method 400, such as when the toilet seat assembly is configured for both cleaning and automatic lifting. As a general overview, method 500 includes major functions of opening 510 the lid, closing 530 the lid, opening 550 the seat, and closing 570 the seat, each of which is performed with a combination of processes in this example. Additionally, method 500 optionally includes safeguarding processes, such as detecting an obstruction during opening or closing of a seat or lid and disabling one sensor when another sensor detects the presence of a user.

In one embodiment, method 500 begins from a low power mode 501 in which the toilet seat assembly "looks" for a user. For example, a first sensor on the toilet seat or lid is active and triggered when a person is within the sensing region. When the processor receives 503 an input from the first sensor, indicating the presence of a user, additional sensors are turned "on" 505, followed by opening 507 valves to extend the piston of the hydraulic cylinder and begin lifting 509 the lid. In other embodiments, all sensors remain on or active when the system is powered. After the processor receives 511 a signal from a position sensor to indicate the lid is open, the processor closes 513 the appropriate valves and maintains the lid in the open position. If an obstruction is detected 515 while lifting 509 the lid, method 500 may try three times (or some other number of times) before stopping 525. In one embodiment, after detecting 515 an obstruction during opening, method 500 opens 534 valves to retract the piston and close 536 the lid.

During lid opening or after it is open, the processor may receive 517 input from the second sensor, in which case the processor opens 554 valves (or maintains the valves open) to further extend the piston and lift 556 the seat. When the processor receives 558 input from the position sensor to indicate the lid is open, the processor closes 560 the valves to maintain the seat and lid in an open position. If the processor receives 563 additional second sensor input (e.g., a hand gesture after the user finishes using the toilet) or if the processor receives 572 no input from the first sensor for a predetermined length of time (e.g., 10-30 seconds), method 500 proceeds to closing 570 the seat. If during lifting 556 the seat an obstruction is detected 562, method 500 can try three times (or some other number of times) before stopping 564. In one embodiment, after detecting 562 an obstruction during opening, method 500 proceeds with opening 574 valves to retract the piston and close 576 the seat.

Closing 570 the seat includes opening 574 valves to retract the piston and close 576 the seat. When the processor receives 580 input from a position sensor to indicate the seat has closed, method 500 proceeds with closing 530 the lid. Alternately, when the lid is in an open position, if no signal is received 532 for a predetermined period of time (e.g., 10-30 seconds), thus indicating the absence of a user, method 500 continues with closing 530 the lid. In yet another scenario, in which the lid is maintained open, and the processor continues to receive 517 input from the first sensor and additionally receives 519 input from seat sensor (e.g., a capacitive sensor), method 500 optionally disables 521 the second sensor, such as to prevent inadvertent attempts to open the seat while a user is sitting on it. After no input has been received 523 from the first sensor or seat sensor, method 500 proceeds to closing 530 the lid.

Closing 530 the lid may begin upon not receiving 532 input from the first sensor for a predetermined period of time. Closing 530 the lid continues with opening 534 valves to retract the piston and start closing 536 the lid. The processor receiving 538 input from the position sensor to indicate the lid is closed, method 500 continues with closing 540 valves to maintain the lid in a closed position. Optionally, the processor disables 542 sensors for a predetermined period of time (e.g., 10-30 seconds), followed by entering low power mode 501. If an obstruction is detected during closing 536 the lid, method 500 can try three times (or some other number of times) before stopping 525. In one embodiment, after detecting 544 an obstruction during closing 536 the lid, method 500 opens 507 valves to extend the piston and lift 509 the lid.

In some embodiments, method 500 method optionally records the number of lid lifts in a 24-hour period, the timing of those lifts, or both. Such data can be used in the method 400 of cleaning, in accordance with some embodiments.

Further Example Embodiments

The following examples pertain to further embodiments, from which numerous permutations and configurations will be apparent.

Example 1 is a toilet seat assembly for a toilet having a toilet bowl with a top surface and plumbed to a mains water supply, the toilet seat assembly comprising a base configured to be secured to the top surface of the toilet bowl; a toilet seat attached to the base and movable between an open position and a closed position; a lid attached to the base and movable between an open position and a closed position; and a cleaning assembly at least partially housed in the base, the cleaning assembly including (i) a valve assembly configured to control a flow of water between the mains water supply and an outlet to the toilet bowl, (ii) a cleaning cassette configured to contain a cleaning product and to dispense the cleaning product to the toilet bowl, (iii) a processor configured to control operation of the valve assembly, and (iv) an energy source electrically coupled to the processor.

Example 2 includes the subject matter of Example 1, wherein the outlet to the toilet bowl comprises a plunger valve including a first spray nozzle, a second spray nozzle, and a drain opening, the plunger valve including a plunger positioned for actuation by the lid, wherein when the lid is open, the plunger is in a first position and directs water to the drain opening or the first spray nozzle, and when the lid is closed the plunger is in a second position and directs water to the second spray nozzle.

Example 3 includes the subject matter of Examples 1 or 2, wherein the cleaning cassette is in fluid communication with the outlet to the toilet bowl.

Example 4 includes the subject matter of Example 2, wherein the cleaning cassette is configured to dispense the cleaning product to the toilet bowl via the plunger valve.

Example 5 includes the subject matter of any of Examples 2-4, wherein the second spray nozzle comprises an ultrasonic spray valve or a piezoelectric spray valve.

Example 6 includes the subject matter of any of Examples 2-5, wherein at least one of the first spray nozzle and the second spray nozzle is a reciprocating nozzle.

Example 7 includes the subject matter of any of any of Examples 1-6 and further comprises a shroud on the lid, the shroud sized and generally having an annular shape consistent with an opening of the toilet seat, the shroud extending away from an inside face of the lid and at least partially overlapping the toilet seat when the toilet seat and the lid are in a closed position.

Example 8 includes the subject matter of Example 7, wherein the shroud blocks a spray from the first spray nozzle and the second spray nozzle to the toilet seat.

Example 9 includes the subject matter of any of Examples 1-8, wherein the toilet seat forms a seal with a rim of the toilet bowl.

Example 10 includes the subject matter of any of Examples 1-9, wherein the valve assembly defines a first fluid pathway through the cleaning cassette to the toilet bowl and defines a second fluid pathway bypassing the cleaning cassette to the toilet bowl.

Example 11 includes the subject matter of any of Examples 1-10, wherein the processor is configured to initiate a cleaning cycle subsequent to use of the toilet. For example, the cleaning cycles is initiated after or upon closing the lid, in response to user input, or during a period of non-use.

Example 12 includes the subject matter of Example 11, wherein the cleaning cycle includes a flow of water through the cleaning cassette.

Example 13 includes the subject matter of any of Examples 1-12, wherein the cleaning cassette is removably installed in the base.

Example 14 includes the subject matter of any of Examples 1-13, wherein the cleaning cassette includes a fluid maze upstream of the cleaning product, the fluid maze including a plurality of alternating baffles.

Example 15 includes the subject matter of any of Examples 1-14, wherein the energy source is a stored energy source.

Example 16 includes the subject matter of any of Examples 1-15 and further comprises a hydraulic cylinder operatively connected to the toilet seat and to the lid, and fluidly connected to the valve assembly, the hydraulic cylinder including a piston movable within the hydraulic cylinder, the hydraulic cylinder defining a first volume on a first side of the piston and a second volume on a second side of the piston, wherein the hydraulic cylinder is operable with water from the mains water supply, wherein adding the water to the first volume moves the piston in a first direction and draining the water from the first volume moves the piston in an opposite second direction, wherein moving the piston a first distance in the first direction raises the lid and retracting the piston the first distance in the opposite second direction lowers the lid, and wherein moving the piston a second distance in the first direction raises the lid and the toilet seat, the second distance greater than the first distance.

Example 17 includes the subject matter of Example 16, wherein water drained from the hydraulic cylinder is directed to the outlet to the toilet bowl.

Example 18 includes the subject matter of Example 16 or 17 and further comprises one or more sensors disposed in communication with the processor and the energy source, wherein the one or more sensors are configured to detect a person adjacent the toilet and wherein in response to a signal from the one or more sensors the processor operates the valve assembly to move the piston in the first direction.

Example 19 includes the subject matter of Example 18, wherein the one or more sensors includes a first sensor on a forward end of the toilet seat or a forward end of the lid, and a second sensor on an inside face the lid.

Example 20 includes the subject matter of Example 18 or 19, wherein the one or more sensors are configured to detect one or more of (i) a specific movement, (ii) a sound, (iii) a temperature differential, (iv) a general movement, and (v) an object within a predefined distance of the one or more sensors.

Example 21 includes the subject matter of any of Examples 16-20 and further comprises a cam follower on the piston; a lid hinge portion defining a camway along the lid hinge portion, wherein moving the cam follower in engagement with the camway along the lid hinge portion raises or lowers the lid; and a seat hinge portion defining a second camway along the seat hinge portion, wherein moving the cam follower in engagement with the second camway on the seat hinge portion raises or lowers the toilet seat.

Example 22 includes the subject matter of Example 21, wherein the camway has a helical path along the lid hinge portion and wherein the second camway has a helical path along the seat hinge portion.

Example 23 includes the subject matter of any of Example 18-22, wherein the processor is configured to (i) operate the valve assembly to open the lid in response to receiving a first signal from the one or more sensors, (ii) operate the valve assembly to open the toilet seat in response to receiving a second signal from the one or more sensors, the second signal subsequent to the first signal.

Example 24 includes the subject matter of Example 23, wherein the processor is further configured to operate the valve assembly to close the lid subsequent to opening the lid and after failing to receive a signal from the one or more sensors for a predetermined length of time.

Example 25 includes the subject matter of Examples 23 or 24, wherein the first signal is in response to detecting a user within a predefined distance of the toilet.

Example 26 is a toilet seat assembly for a toilet having a toilet bowl with a top surface and plumbed to a mains water supply, the toilet seat assembly comprising: a base configured to be secured to a top surface of a toilet bowl; a toilet seat attached to the base and movable between an open position and a closed position; a lid attached to the base and movable between an open position and a closed position; a hydraulic cylinder operatively connected to the toilet seat and to the lid, the hydraulic cylinder including a piston movable within the hydraulic cylinder, the hydraulic cylinder defining a first volume on a first side of the piston and a second volume on a second side of the piston, wherein the hydraulic cylinder is operable with water from the mains water supply to open the lid and toilet seat, wherein adding the water to the first volume moves the piston in a first direction and draining the water from the first volume moves the piston in an opposite second direction, wherein moving the piston from a start position to a first position opens the lid, moving the piston from the start position to a second position opens the lid and toilet seat, and returning the piston to the start position from the second position closes the lid and toilet seat; a valve assembly configured to control a flow of water into and out of the hydraulic cylinder; a processor configured to control operation of the valve assembly; one or more sensors in communication with the processor; and an energy source electrically coupled to the processor and to the valve assembly; wherein, in response to a signal from the one or more sensors, the processor operates the valve assembly to open or close one or both of the toilet seat and the lid.

Example 27 includes the subject matter of Example 26, wherein the one or more sensors comprises a first sensor on a forward end of the toilet seat or the lid and a second sensor on an underside of the lid, on the toilet seat, or on the base.

Example 28 includes the subject matter of Examples 26 or 27, wherein the one or more sensors are configured to detect one or more of (i) a specific movement, (ii) a sound, (iii) a temperature differential, (iv) a general movement, and (v) an object within a predefined distance of the one or more sensors.

Example 29 includes the subject matter of any of Examples 26-28, wherein the processor is configured to (i) operate the valve assembly to open the lid in response to receiving a first signal from the one or more sensors, (ii) operate the valve assembly to open the toilet seat in response to receiving a second signal from the one or more sensors, the second signal subsequent to the first signal.

Example 30 includes the subject matter of Example 29, wherein the processor is further configured to operate the valve assembly to close the lid subsequent to opening the lid and after failing to receive a signal from the one or more sensors for a predetermined length of time.

Example 31 includes the subject matter of Example 29 or 30, wherein the first signal is in response to detecting a user within a predefined distance of the toilet.

Example 32 includes the subject matter of any of Examples 26-31 wherein a return force moves the piston in the second direction, at least part of the return force provided by one or more of (i) water filling the second volume, or (ii) a spring.

Example 33 includes the subject matter of any of Examples 26-32 and further comprises a cam follower on the piston; a lid hinge portion on the lid, the lid hinge portion defining a first camway, wherein moving the cam follower in engagement with the first camway raises or lowers the lid; and a seat hinge portion on the toilet seat, the seat hinge portion defining a second camway, wherein moving the cam follower in engagement with the second camway raises or lowers the toilet seat.

Example 34 includes the subject matter of Example 33, wherein the first camway follows a helical pathway along the lid hinge portion and the second camway follows a helical pathway along the seat hinge portion.

Example 35 includes the subject matter of any of Examples 26-34 and further comprises a cleaning assembly in fluid communication with the valve assembly, the cleaning assembly including a nozzle configured to spray water into the toilet bowl.

Example 36 includes the subject matter of Example 35, wherein the cleaning assembly further includes a cleaning cassette configured to contain a cleaning product and to dispense the cleaning product to the toilet bowl.

Example 37 includes the subject matter of Example 36, wherein the cleaning cassette is in fluid communication with the nozzle.

Example 38 includes the subject matter of Example 36 or 37, wherein the cleaning cassette is removably installed in the base.

Example 39 includes the subject matter of Examples 36-38 and further comprises a fluid maze on the cleaning cassette, the fluid maze including a plurality of alternating baffles.

Example 40 includes the subject matter of any of Examples 35-39, wherein the processor is configured to initiate a cleaning cycle during a period of non-use of the toilet, in response to a user input, or subsequent to use of the toilet. For example, the cleaning cycle includes a flow of water through the cleaning cassette to the toilet bowl.

Example 41 includes the subject matter of any of Examples 36-40, wherein the valve assembly defines a first fluid pathway from the hydraulic cylinder to the toilet bowl via the cleaning assembly and defines a second fluid pathway bypassing the cleaning cassette.

Example 42 includes the subject matter of any of Examples 36-41, wherein the cleaning assembly further includes a plunger valve including the nozzle and a drain opening, the plunger valve including a plunger positioned for actuation by the toilet seat, wherein when the toilet seat is open, the plunger is in a first position and directs water to the drain opening and when the toilet seat is closed the plunger is in a second position and directs water to the nozzle.

Example 43 includes the subject matter of any of Examples 36-42, wherein the cleaning assembly includes a mist valve in fluid communication with the cleaning cassette.

Example 44 includes the subject matter of Example 43, wherein the mist valve comprises an ultrasonic spray valve or a piezoelectric spray valve. For example, the mist valve is actuated by the processor.

Example 45 includes the subject matter of any of Examples 35-44 and further comprising a shroud on the lid, the shroud sized and generally having an annular shape consistent with an opening of the toilet seat, the shroud extending away from an inside face of the lid and sized to overlap the toilet seat when the toilet seat and the lid are in a closed position.

Example 46 includes the subject matter of Example 45, wherein the shroud blocks a linear path from the nozzle to the toilet seat.

Example 47 is a toilet seat assembly comprising a base; a toilet seat hingedly attached to the base; a lid hingedly attached to the base; a cleaning assembly at least partially housed in the base, the cleaning assembly including a cleaning cassette configured to contain a cleaning product and to dispense the cleaning product to the toilet bowl; a hydraulic cylinder on the base and operable to open and close the toilet seat and the lid using water from a mains water supply; a valve assembly configured to control a flow of water from the mains water supply to the hydraulic cylinder and from the hydraulic cylinder to the toilet; a processor; and one or more sensors disposed in communication with the processor; wherein the processor is configured to control operation of the valve assembly in response to a signal received from the one or more sensors.

Example 48 includes the subject matter of Example 47, wherein, in response to receiving a signal from the one or more sensors, the processor operates the valve assembly to direct water from the mains water supply to the hydraulic cylinder, thereby opening the toilet seat.

Example 49 includes the subject matter of Example 48, wherein the processor is further configured to direct water from the hydraulic cylinder to the toilet bowl via a pathway in fluid communication with the cleaning cassette.

Example 50 includes the subject matter of Example 49, wherein the pathway includes a Venturi eductor in fluid communication with the cleaning cassette.

Example 51 includes the subject matter of Example 49, wherein the pathway includes a path through the cleaning cassette.

Example 52 includes the subject matter of Example 49, wherein the pathway includes a nozzle configured to direct water into the toilet bowl.

Example 53 includes the subject matter of Example 52, wherein the nozzle is a reciprocating nozzle.

Example 54 includes the subject matter of Example 52, wherein the toilet seat is configured to form a seal with at least part of a rim of a toilet bowl when the toilet seat is in a closed position.

Example 55 includes the subject matter of Example 54, wherein the lid forms a seal with the toilet seat when both the lid and toilet seat are in a closed position.

Example 56 includes the subject matter of any of Examples 47-55, wherein the cleaning cassette is removably installed in the base.

Example 57 is a method of cleaning a toilet, the method comprising providing a toilet having a toilet bowl and a toilet seat assembly on the toilet bowl, the toilet seat assembly including (i) a base connected to the toilet along a rear portion of the toilet bowl, (ii) a toilet seat connected to the base and operable between an open seat position and a closed seat position, (iii) a lid connected to the base and operable between an open lid position and a closed lid position, (iv) a hydraulic cylinder on the base, the hydraulic cylinder operable to open and close the toilet seat and the lid using water from a mains water supply, and (v) a cleaning assembly at least partially housed in the base, the cleaning assembly including a cleaning cassette configured to contain a cleaning product, a valve assembly configured to control flow of water between a mains water supply and the toilet bowl, a nozzle configured to spray water into the toilet bowl, one or more sensors, and a processor in communication with the one or more sensors, the processor configured to operate the valve assembly; receiving, by the processor, a signal from the one or more sensors; the processor operating the valve assembly to close the lid; and the processor operating the valve assembly, in response to receiving the signal, to direct water through the cleaning assembly and the nozzle to the toilet bowl.

Example 58 includes the subject matter of Example 57, wherein the signal from the one or more sensors is a second signal, the method further comprising receiving, by the processor, a first signal from the one or more sensors, the first signal indicative of a user adjacent the toilet; and the processor operating the valve assembly, in response to receiving the first signal, to direct water into the hydraulic cylinder and open the lid.

Example 59 includes the subject matter of Example 58, wherein the processor operating the valve assembly to direct water into the hydraulic cylinder also opens the toilet seat.

Example 60 includes the subject matter of Examples 58 or 59 and further comprises detecting a gesture of a user by the one or more sensors.

Example 61 includes the subject matter of any of Examples 58-60 and further comprises detecting a user within a predefined distance of the toilet by the one or more sensors.

Example 62 includes the subject matter of any of Examples 58-61 and further comprises detecting a sound by the one or more sensors.

Example 63 includes the subject matter of any of Examples 58-62 and further comprises detecting a position of a user by the one or more sensors.

Example 64 includes the subject matter of any of Examples 57-63 and further comprises detecting a position of the hydraulic cylinder; receiving a position signal at the processor; and in response to receiving the position signal, the processor operating the valve assembly to maintain a position of the toilet seat and the lid.

Example 65 includes the subject matter of any of Examples 57-64, wherein providing the toilet seat assembly includes providing a mist valve in fluid communication with the cleaning cassette, the method further comprising the processor operating the valve assembly to direct a liquid contained in the cleaning cassette through the mist valve.

Example 66 includes the subject matter of Example 65 and further comprises the processor actuating the mist valve.

Example 67 is a method of operating a toilet seat assembly, the method comprising providing a toilet having a toilet bowl and a toilet seat assembly on the toilet bowl, the toilet seat assembly including (i) a base connected to the toilet along a rear portion of the toilet bowl, (ii) a toilet seat connected to the base and operable between an open seat position and a closed seat position, (iii) a lid connected to the base and operable between an open lid position and a closed lid position, (iv) a hydraulic cylinder on the base, the hydraulic cylinder operable to open and close the toilet seat and the lid using water from a mains water supply, (v) one or more sensors, and (vi) a processor in communication with the one or more sensors, the processor configured to operate the valve assembly; receiving, by the processor, a signal from the one or more sensors, the signal indicative of a user adjacent the toilet; the processor operating the valve assembly to open the lid; and the processor operating the valve assembly to close the lid.

Example 68 includes the subject matter of Example 67 and further comprises receiving, by the processor, a second signal from the one or more sensors; and the processor operating the valve assembly, in response to receiving the second signal, to direct water into the hydraulic cylinder and open the toilet seat; and the processor operating the valve assembly to close the toilet seat.

Example 69 includes the subject matter of Example 68 and further comprises the processor determining an elapsed time with no signal from the one or more processors; and the processor operating the valve assembly to close the lid in response to the elapsed time.

Example 70 includes the subject matter of any of Examples 67-69 and further comprises detecting a gesture of a user by the one or more sensors.

Example 71 includes the subject matter of any of Examples 67-70 and further comprises detecting a user within a predefined distance of the toilet by the one or more sensors.

Example 72 includes the subject matter of any of Examples 67-71 and further comprises detecting a sound by the one or more sensors.

Example 73 includes the subject matter of any of Examples 67-72 and further comprises detecting a user on the toilet seat by the one or more sensors.

Example 74 includes the subject matter of any of Examples 67-70 and further comprises detecting a position of the hydraulic cylinder; receiving a position signal at the processor; and in response to receiving the position signal, the processor operating the valve assembly to maintain a position of the toilet seat and the lid.

Example 75 is a toilet seat assembly for a toilet having a toilet bowl with a top surface and plumbed to a mains water supply, the toilet seat assembly comprising a base configured to be secured to the top surface of the toilet bowl; a toilet seat attached to the base and movable between an open position and a closed position; a lid attached to the base and movable between an open position and a closed position; a cleaning assembly at least partially housed in the base, the cleaning assembly including a cleaning cassette configured to contain a cleaning product and to dispense the cleaning product to the toilet bowl; a pump configured to control a flow of the cleaning product between the cleaning cassette and the toilet bowl; a processor configured to control operation of the pump; and an energy source electrically coupled to the processor.

Example 76 includes the subject matter of Example 75 and further comprises: a valve assembly configured to control a flow of water between the mains water supply and an outlet to the toilet bowl, the valve assembly coupled to the processor, wherein the processor is further configured to control operation of the valve assembly.

Example 77 includes the subject matter of Example 76, wherein the processor is further configured to concurrently cause the flow of water from the mains water supply to the toilet bowl and to cause the flow of the cleaning product from the cleaning cassette to the toilet bowl.

The foregoing description of the embodiments of the disclosure has been presented for the purpose of illustration; it is not intended to be exhaustive or to limit the claims to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the invention, which is set forth in the following claims.

What is claimed is:

1. A toilet seat assembly for cleaning a toilet having a toilet bowl with a top surface and plumbed to a mains water supply, the toilet seat assembly comprising:

a base configured to be secured to the top surface of the toilet bowl;

a toilet seat attached to the base and movable between an open position and a closed position;

a lid attached to the base and movable between an open position and a closed position; and a cleaning assembly at least partially housed in the base, the cleaning assembly including:

one or more valves housed in the base, the one or more valves configured to control a flow of water between the mains water supply and an outlet to the toilet bowl;

a cleaning cassette housed in the base, the cleaning cassette configured to contain a cleaning product and to dispense the cleaning product to the toilet bowl;

a processor including computer executable code that, when executed by the processor, causes the one or more valves to direct pressurized water from the mains water supply to flow through the cleaning cassette and the outlet to spray the toilet bowl; and an energy source electrically coupled to the processor.

2. The toilet seat assembly of claim 1, wherein the outlet to the toilet bowl comprises a plunger valve including a first spray nozzle and a second spray nozzle, the plunger valve including a plunger positioned for actuation by the lid, wherein when the lid is open, the plunger is in a first position and directs water to the first spray nozzle, and when the lid is closed the plunger is in a second position and directs water to the second spray nozzle.

3. The toilet seat assembly of claim 2, wherein the cleaning cassette is configured to dispense the cleaning product to the toilet bowl via the plunger valve.

4. The toilet seat assembly of claim 2, wherein at least one of the first spray nozzle and the second spray nozzle is a reciprocating nozzle.

5. The toilet seat assembly of claim 1, wherein the toilet seat forms a seal with a rim of the toilet bowl.

6. The toilet seat assembly of claim 1, wherein the one or more valves define a first fluid pathway through the cleaning cassette to the toilet bowl and defines a second fluid pathway bypassing the cleaning cassette to the toilet bowl.

7. The toilet seat assembly of claim 1, wherein the processor is configured to initiate a cleaning cycle during a period of non-use of the toilet or in response to user input.

8. The toilet seat assembly of 1 further comprising a shroud on the lid, the shroud sized and generally having an annular shape consistent with an opening of the toilet seat, the shroud extending away from an inside face of the lid and at least partially overlapping the toilet seat when the toilet seat and the lid are in a closed position.

9. The toilet seat assembly of claim 1, wherein the cleaning cassette is removably installed in the base.

10. The toilet seat assembly of claim 1 further comprising a fluid maze on the cleaning cassette between the inlet and the container, the fluid maze including a plurality of alternating baffles.

11. The toilet seat assembly of claim 1, wherein the energy source is a stored energy source housed in the base.

12. The toilet seat assembly of claim 1 further comprising:

a hydraulic cylinder operatively connected to the toilet seat and to the lid, and fluidly connected to the one or more valves, the hydraulic cylinder including a piston movable within the hydraulic cylinder, the hydraulic cylinder defining a first volume on a first side of the piston and a second volume on a second side of the piston, wherein the hydraulic cylinder is operable with water from the mains water supply, wherein adding the water to the first volume moves the piston in a first direction and draining the water from the first volume moves the piston in an opposite second direction; and wherein moving the piston a first distance in the first direction raises the lid and retracting the piston the first distance in the opposite second direction lowers the lid, and wherein moving the piston a second distance in the first direction raises the lid and the toilet seat, the second distance greater than the first distance.

13. The toilet seat assembly of claim 12 further comprising:

one or more sensors disposed in communication with the processor and the energy source, wherein the one or more sensors are configured to detect a person adjacent the toilet and wherein in response to a signal from the one or more sensors the processor operates the one or more valves to move the piston in the first direction.

14. The toilet seat assembly of claim 13, wherein the one or more sensors includes a first sensor on a forward end of the toilet seat or a forward end of the lid, and a second sensor on an inside face the lid.

15. The toilet seat assembly of claim 13, wherein the one or more sensors are configured to detect one or more of (i) a specific movement, (ii) a sound, (iii) a temperature differential, (iv) a general movement, and (v) an object within a predefined distance of the one or more sensors.

16. The toilet seat assembly of claim 13 further comprising:

a cam follower on the piston;

a lid hinge portion on the lid, the lid hinge portion defining a first camway configured to engage the cam follower, wherein moving the cam follower along the first camway raises or lowers the lid; and a seat hinge portion on the toilet seat, the seat hinge portion defining a second camway configured to engage the cam follower, wherein moving the cam follower along the second camway raises or lowers the toilet seat.

17. The toilet seat assembly of claim 16, wherein first camway follows a helical path along the lid hinge portion and wherein the second camway follows a helical path along the seat hinge portion.

18. The toilet seat assembly of claim 13, wherein the processor is configured to (i) operate the one or more valves to open the lid in response to receiving a first signal from the one or more sensors, and (ii) operate the one or more valves to open the toilet seat in response to receiving a second signal from the one or more sensors, the second signal subsequent to the first signal.

19. The toilet seat assembly of claim 18, wherein the processor is further configured to operate the one or more valves to close the lid subsequent to opening the lid and after failing to receive a signal from the one or more sensors for a predetermined length of time.

20. The toilet seat assembly of claim 18, wherein the first signal is related to detecting a user within a predefined distance of the toilet.

21. A toilet seat assembly for cleaning a toilet having a toilet bowl with a top surface and plumbed to a mains water supply, the toilet seat assembly comprising:

a base configured to be secured to the top surface of the toilet bowl;

a toilet seat attached to the base and movable between an open position and a closed position;

a lid attached to the base and movable between an open position and a closed position;

a cleaning assembly at least partially housed in the base, the cleaning assembly including a cleaning cassette configured to contain a cleaning product and to dispense the cleaning product to the toilet bowl, wherein the cleaning cassette is removably retained in the base;

a pump configured to control a flow of the cleaning product between the cleaning cassette and the toilet bowl;

a processor configured to control operation of the pump; and an energy source electrically coupled to the processor.

22. The toilet seat assembly of claim 21 further comprising:

a valve assembly housed in the base, the valve assembly configured to control a flow of water between the mains water supply and an outlet to the toilet bowl, the valve assembly coupled to the processor, wherein the processor is further configured to control operation of the valve assembly.

23. The toilet seat assembly of claim 12, wherein the computer-executable code is further configured to operate the one or more valves to direct pressurized water from the mains water supply into the hydraulic cylinder.

* * * * *